US010757760B2

(12) United States Patent
Komaki et al.

(10) Patent No.: US 10,757,760 B2
(45) Date of Patent: Aug. 25, 2020

(54) INFRARED HEATER AND INFRARED PROCESSING DEVICE

(71) Applicant: NGK Insulators, Ltd., Nagoya (JP)

(72) Inventors: Takeshi Komaki, Nagoya (JP); Taiki Kinnan, Nagoya (JP); Yoshio Kondo, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 1086 days.

(21) Appl. No.: 14/953,566

(22) Filed: Nov. 30, 2015

(65) Prior Publication Data

US 2016/0157300 A1 Jun. 2, 2016

(30) Foreign Application Priority Data

Nov. 28, 2014 (JP) ..... 2014-241192
Apr. 23, 2015 (JP) ..... 2015-088633
Apr. 23, 2015 (JP) ..... 2015-088634

(51) Int. Cl.

| | |
|---|---|
| ***F21V 9/00*** | (2018.01) |
| ***F21V 7/00*** | (2006.01) |
| ***H05B 3/00*** | (2006.01) |
| ***F26B 3/30*** | (2006.01) |
| ***H05B 3/22*** | (2006.01) |
| ***F26B 15/18*** | (2006.01) |

(52) U.S. Cl.

CPC ..... *H05B 3/009* (2013.01); *F26B 3/30* (2013.01); *F26B 15/18* (2013.01); *H05B 3/22* (2013.01); *H05B 2203/032* (2013.01)

(58) Field of Classification Search

CPC .. F26B 15/18; F26B 3/30; F26B 3/305; B29C 65/14; B29C 65/1412–1422; H05B 2203/032; H05B 3/009; H05B 3/22

USPC ..... 392/407, 408, 411–429

See application file for complete search history.

(56) References Cited

U.S. PATENT DOCUMENTS 5,960,158 A * 9/1999 Gat ..... G01J 5/06 219/390
5,970,213 A 10/1999 Cord et al.
(Continued)

FOREIGN PATENT DOCUMENTS

DE 103 52 184 A1 6/2005
JP H06-349813 A1 12/1994
(Continued)

OTHER PUBLICATIONS

Extended European Search Report (Application No. 15196718.9) dated Apr. 11, 2016.
(Continued)

*Primary Examiner* — Sang Y Paik
(74) *Attorney, Agent, or Firm* — Burr & Brown, PLLC

(57) ABSTRACT

An infrared heater 10 includes a heating element 40 that emits infrared radiation when heated and that is capable of absorbing infrared radiation in a predetermined reflection wavelength range, and a filter unit 50 that is disposed so as to be separated by a first space 47, which is open to an outside space, from the heating element 40. The filter unit 50 includes one or more transmission layers (a first transmission layer 51) that transmit at least a part of the infrared radiation from the heating element 40, and a reflective section (the first transmission layer 51) that reflects infrared radiation in the reflection wavelength range toward the heating element 40.

16 Claims, 14 Drawing Sheets

(56) References Cited

U.S. PATENT DOCUMENTS

| | | | | |
|---|---|---|---|---|
| 6,021,152 | A * | 2/2000 | Olsen | C23C 14/12 372/99 |
| 6,534,904 | B1 * | 3/2003 | Dieudonne | H01K 1/06 313/271 |
| 6,717,158 | B1 * | 4/2004 | Gat | F27B 5/04 219/411 |
| 2007/0090293 | A1 * | 4/2007 | Ichihara | H01L 37/00 250/339.1 |

FOREIGN PATENT DOCUMENTS

| | | | |
|---|---|---|---|
| JP | 09-136055 | A1 | 5/1997 |
| JP | 2006-261095 | A1 | 9/2006 |
| WO | 2014/168229 | A1 | 10/2014 |

OTHER PUBLICATIONS

Taiwanese Office Action (Application No. 104139577) dated Jul. 2, 2019 (with English translation).

* cited by examiner

※HEATING ELEMENT AREA S = X·Y

※HEATING ELEMENT AREA S = X·Y

※HEATING ELEMENT AREA S = X·Y

INFRARED HEATER AND INFRARED PROCESSING DEVICE

BACKGROUND OF THE INVENTION

1. Field of the Invention

The present invention relates to an infrared heater and an infrared processing device.

2. Description of the Related Art

Infrared heaters that emit infrared radiation (in a wavelength range of 0.7 to 1000 μm) and devices including the infrared heaters, having various structures, have been developed. For example, PTL 1 describes a device including an infrared heater that emits infrared radiation toward a workpiece and an infrared selective transmission filter that is disposed between the workpiece and the infrared heater. In this device, the infrared selective transmission filter selectively transmits a part of the infrared radiation in a wavelength range that can be efficiently absorbed by a sealant applied to the workpiece and reflects infrared radiation outside the wavelength range. It is described that, with such a structure, the infrared selective transmission filter is not heated, and deterioration of a workpiece due to increase in the ambient temperature caused by heating of the infrared selective transmission filter does not occur.

CITATION LIST

Patent Literature

PTL 1: JP 9-136055 A

SUMMARY OF THE INVENTION

However, with the device described in PTL 1, the energy of infrared radiation reflected by the filter is unnecessary energy that is not used to heat the sealant. The energy of reflected infrared radiation may heat the furnace wall or the inside of the furnace, and thereby the temperature of the filter may be increased. If the temperature of the filter increases, for example, the output power or the continuous duty of the infrared heater may become limited in view of the heat resistance of the filter.

The main object of the present invention, which has been devised to solve such a problem, is to increase the temperature difference between a heating element and a filter unit during use.

To achieve the object, the present invention uses the following means.

An infrared heater according to the present invention includes a heating element that emits infrared radiation when heated and that is capable of absorbing infrared radiation in a predetermined reflection wavelength range; and a filter unit including one or more transmission layers that transmit at least a part of the infrared radiation from the heating element and a reflective section that reflects infrared radiation in the reflection wavelength range toward the heating element, the filter unit being disposed so as to be separated by a first space, which is open to an outside space, from the heating element.

With the infrared heater, infrared radiation is emitted when the heating element is heated. The infrared radiation passes through the filter unit, including one or more transmission layers, and, for example, the infrared radiation is emitted toward an object. The reflective section has reflection characteristics of reflecting infrared radiation in a predetermined reflection wavelength range. The heating element can absorb infrared radiation in the reflection wavelength range. Therefore, because the transmission layer transmits infrared radiation from the heating element, the temperature of the transmission layer does not easily increase as compared with a case where the transmission layer absorbs the infrared radiation. On the other hand, because the heating element can absorb a part of the infrared radiation emitted by itself and use it to heat itself, the temperature of the heating element can be easily increased. As a result, the temperature difference between the heating element and the filter unit (in particular, a transmission layer closest to the heating element) during use can be increased. Because the temperature difference between the heating element and the filter unit can be increased, for example, the temperature of the heating element can be increased while maintaining the temperature of the transmission layer to be the heatproof temperature or less, and the energy of infrared radiation emitted to the object can be increased. Even when the temperature of the heating element is the same, with the infrared heater according to the present invention, the temperature of the filter unit can be maintained to be lower. Moreover, the distance between the heating element and the transmission layer can be reduced while maintaining the temperature of the transmission layer to be the heatproof temperature or less, and, as a result, the distance between the heating element and the object can be also reduced. The outside space may be a vacuum atmosphere a non-vacuum atmosphere.

In the infrared heater according to the present invention, the one or more transmission layers may include a first transmission layer. The first transmission layer also serves as at least a part of the reflective section. The first transmission layer may have reflection characteristics of reflecting infrared radiation in the predetermined reflection wavelength range and transmit at least a part of the infrared radiation from the heating element.

The infrared heater according to the present invention may satisfy $0.08 \leq D/L \leq 0.23$, where a distance D [cm] is a distance between the heating element and the first transmission layer, a heating element area S [$cm^2$] is an area of a smallest quadrangular or circular region that surrounds an entirety of a projection region that is formed by projecting the heating element onto the first transmission layer in a direction perpendicular to the first transmission layer (where $0\ cm^2 < S \leq 400\ cm^2$), and a representative dimension L [cm]= $2\times\sqrt{(S/\pi)}$. As the ratio D/L decreases, heat transfer from the heating element to the first transmission layer becomes increasingly and inevitably dependent on heat transfer through an atmosphere in the first space. As a result, heat accumulation in the first space increases, and the temperature of the first transmission layer may be easily increased. By making the ratio D/L be 0.08 or more, excessive increase of the conductive heat flux can be prevented, the amount of heat transfer between the heating element and the filter unit during use can be reduced, and increase in the temperature of the filter unit (in particular, the first transmission layer) can be sufficiently suppressed. As the ratio D/L increases, heat transfer in the first space becomes increasingly dependent on convection, and when the ratio D/L becomes excessively high, convective loss in the first space becomes large, and the temperature of the heating element may be easily reduced. In this case, by making the ratio D/L be 0.23 or less, increase in convective heat transfer coefficient is prevented, decrease in the temperature of the heating element due to convective loss can be sufficiently suppressed. Thus, by making the ration D/L be in the range of $0.08 \leq D/L \leq 0.23$, the temperature difference between the heating element and the filter unit (in particular, the first transmission layer) can be further increased, while suppressing decrease in the temperature of the heating element during use. Consequently, a larger amount of the energy of infrared radiation from the heating element is transmitted by the filter unit, is emitted toward the object, and infrared processing (such as heating) can be efficiently performed. The phrase, "the area of the smallest quadrangular or circular region that surrounds the entirety of a projection region" refers to the area of a smaller one of the smallest quadrangular region and the smallest circular region that surrounds the entirety of the projection region. The term "quadrangle" includes a square, a rectangle, a parallelogram, and other quadrangles. The term "circle" includes a circle and an ellipse. Preferably, (the area of the projection region)/(the heating element area S)≥0.5 so that the aforementioned effect of satisfying $0.08 \leq D/L \leq 0.23$ can be more reliably obtained. In the infrared heater according to the present invention that satisfies $0.08 \leq D/L \leq 0.23$, a state in which "the first space is open to the outside space" refers to a state in which the first space and the outside space are connected to each other so that air can freely flow therebetween to the extent that the aforementioned effect (the effect of suppressing heat accumulation in the first space and suppressing increase in the temperature of the first transmission layer) can be obtained. It is sufficient that the outside space is a non-vacuum atmosphere. The outside space may be an air atmosphere. That is, the first space may be open to the air atmosphere.

In the infrared heater according to the present invention, the filter unit may include a second transmission layer that is disposed so as to be separated by a second space from the first transmission layer, the second transmission layer reflecting at least a part of the infrared radiation emitted from the heating element and passed through the first transmission layer. In this case, increase in the temperature of the filter unit, in particular, the second transmission layer on the object side can be suppressed. Thus, increase in the temperatures of the object and the surrounding components (such as the furnace body or the processing space in the furnace) can be suppressed. The second space may be a non-vacuum atmosphere. The second transmission layer may have reflection characteristics of reflecting infrared radiation in the reflection wavelength range. The second space may be a coolant channel that allows a coolant to flow therethrough.

In the infrared heater according to the present invention, the filter unit may include, as the one or more transmission layers, a first transmission layer and a second transmission layer that is disposed so as to be separated by a second space from the first transmission layer on a side opposite to the heating element when seen from the first transmission layer. The first transmission layer transmits infrared radiation in the reflection wavelength range. The second transmission layer is at least a part of the reflective section, and the second transmission layer reflects infrared radiation in the reflection wavelength range and transmits at least a part of the infrared radiation emitted from the heating element and passed through the first transmission layer. In this case, the second space need not be directly connected to the processing space.

In the infrared heater including the second transmission layer according to the present invention, the filter unit may include a partition member that partitions the second space from the outside of the filter unit, and the reflective section may include a transmission-layer-side reflective member that is at least a part of the partition member and that reflects infrared radiation in the reflection wavelength range. In this case, both the transmission-layer-side reflective member and the second transmission layer can reflect infrared radiation in the reflection wavelength range that has reached the second space, the temperature of the heating element can be more easily increased. Because the transmission-layer-side reflective member is at least a part of the partition member, increase in the number of components of the infrared heater can be suppressed, as compared with a case where a component independent from the partition member is used as the transmission-layer-side reflective member.

In the infrared heater including the second transmission layer according to the present invention, the second space may be a coolant channel that allows a coolant to flow therethrough. In this case, increase in the temperature of the filter unit is suppressed by using the coolant, and the temperature difference between the heating element and the filter unit during use can be further increased.

In the infrared heater according to the present invention, the one or more transmission layers may include a first transmission layer. The first transmission layer also serves as a part of the reflective section. The first transmission layer includes a selective reflection region that has reflection characteristics of reflecting infrared radiation in the reflection wavelength range and that transmits at least a part of the infrared radiation from the heating element and a transmission region that transmits infrared radiation in the reflection wavelength range. The selective reflection region is disposed closer than the transmission region to a center of the heating element. The transmission region is disposed farther than the selective reflection region from the center of the heating element. The reflective section includes a transmission-layer-side reflective member that is disposed on a side opposite to the heating element when seen from the first transmission layer. The transmission-layer-side reflective member has a reflective surface that is inclined with respect to a surface of the transmission region facing the heating element and that reflects toward the heating element infrared radiation in the reflection wavelength range passed through the transmission region. That is, the infrared heater according to the present invention may include a heating element and a filter unit. The heating element emits infrared radiation when heated and is capable of absorbing infrared radiation in a predetermined reflection wavelength range. The filter unit is disposed so as to be separated by a first space, which is open to an outside space, from the heating element. The filter unit includes one or more transmission layers and a transmission-layer-side reflective member. The one or more transmission layers include a first transmission layer and transmit at least a part of the infrared radiation from the heating element. The first transmission layer includes a selective reflection region that has reflection characteristics of reflecting infrared radiation in the reflection wavelength range and that transmits at least a part of the infrared radiation from the heating element and a transmission region that transmits infrared radiation in the reflection wavelength range. The selective reflection region is disposed closer than the transmission region to a center of the heating element, and the transmission region is disposed farther than the selective reflection region from the center of the heating element. The transmission-layer-side reflective member is disposed on a side opposite to the heating element when seen from the first transmission layer. The transmission-layer-side reflective member has a reflective surface that is inclined with respect to a surface of the transmission region facing the heating element and that reflects infrared radiation in the reflection wavelength range passed through the transmission region toward the heating element. In the infrared heater, the filter unit includes one or more transmission layers including the first transmission layer and the transmission-layer-side reflective member. When heating element is heated, the heating element emits infrared radiation, the infrared radiation passes through the selective reflection region of the first transmission layer, and, for example, the infrared radiation is emitted to the object. Infrared radiation in the reflection wavelength range emitted from the heating element is reflected by the selective reflection region of the first transmission layer or is reflected by the transmission-layer-side reflective member after passing through the transmission region of the first transmission layer. The heating element absorbs infrared radiation in the reflection wavelength range reflected by the selective reflection region or the transmission-layer-side reflective member. Therefore, the temperature of the heating element is easily increased by absorbing the reflected infrared radiation. When, for example, the first transmission layer does not include the transmission region and the entire surface of the first transmission layer is the selective reflection region, it may occur that infrared radiation in the reflection wavelength range may be emitted toward the outside space without being reflected toward the heating element. In particular, such a phenomenon is more likely to occur in a part of the first transmission layer away from the center of the heating element. In contrast, with the infrared heater according to the present invention, the transmission region is disposed at a position farther than the selective reflection region from the center of the heating element, and the transmission-layer-side reflective member, which has the inclined reflective surface, is disposed on a side opposite to the heating element when seen from the first transmission layer. Therefore, infrared radiation in the reflection wavelength range emitted toward a part of the first transmission layer far from the center of the heating element can be reflected by the inclined reflective surface toward the heating element. As a result, emission of infrared radiation in the reflection wavelength range to the outside space is suppressed, and the temperature of the heating element can be easily increased. Because the temperature of the heating element can be easily increased, the amount of energy supplied from the outside to maintain the temperature of the heating element to be the operating temperature can be reduced. Accordingly, the energy efficiency in emitting infrared radiation is improved. The outside space may be a vacuum atmosphere or a non-vacuum atmosphere.

With the infrared heater according to the present invention including the transmission-layer-side reflective member, because the transmission layer transmits infrared radiation from the heating element, the temperature of the transmission layer does not increase easily, as compared with a case where, for example, the transmission layer absorbs infrared radiation in the reflection wavelength range. The temperature of the heating element is easily increased as described above. Because the first space between the heating element and the filter unit is open to the outside space, heat accumulation in the first space is suppressed, and increase in the temperature of the filter unit is suppressed. Thus, with the infrared heater, the temperature difference between the heating element and the filter unit (in particular, a transmission layer closest to the heating element) during use can be increased. Because the temperature difference between the heating element and the filter unit can be increased, for example, the temperature of the heating element can be increased while maintaining the temperature of the transmission layer to be the heatproof temperature or less, and the energy of infrared radiation emitted to the object can be increased. With the infrared heater according to the present invention, even when the temperature of the heating element is the same, the temperature of the filter unit can be maintained to be lower, and increase in the temperatures of the object and the surrounding components (such as the furnace body and the processing space) due to increase in the temperature of the filter unit can be suppressed. In order to suppress emission of infrared radiation in the reflection wavelength range described above to the outside space, a reflection member may be disposed between the filter unit and the heating element. In this case, however, the reflection member may impair the aforementioned effect of suppressing increase in the temperature of the filter unit, which is obtained because the first space is open to the outside space. In contrast, with the infrared heater according to the present invention, because the transmission-layer-side reflective member is disposed on a side opposite to the heating element when seen from the first transmission layer, the transmission-layer-side reflective member does not prevent the first space from being open. Accordingly, the energy efficiency in emitting infrared radiation can be further improved, while allowing the temperature difference between the heating element and the filter unit to increase.

In the infrared heater according to the present invention, the transmission region of the first transmission layer may be located so as to surround the selective reflection region when seen from the heating element. In this case, the aforementioned effect of suppressing emission of infrared radiation in the reflection wavelength range to the outside space is increased, and the energy efficiency in emitting infrared radiation is improved.

In the infrared heater according to the present invention, the transmission-layer-side reflective member may be disposed so that the reflective surface does not overlap the selective reflection region when the reflective surface is projected onto a surface of the first transmission layer facing the heating element. In this case, the transmission-layer-side reflective member is not likely to block infrared radiation that has passed through the selective reflection region, so that infrared radiation can be easily emitted to the object.

In the infrared heater according to the present invention, the reflective surface of the transmission-layer-side reflective member may be a concave surface. In this case, the reflective surface can intensively reflect infrared radiation toward the heating element, and the aforementioned effect of suppressing emission of infrared radiation in the reflection wavelength range to the outside space can be easily increased.

In the infrared heater according to the present invention, a closest transmission layer, which is one of the one or more transmission layers that is closest to the heating element, may have a surface that faces the heating element and that is exposed to the first space. The infrared heater may satisfy $0.06 \leq D/L \leq 0.23$, where a distance D [cm] is a distance between the heating element and the closest transmission layer, a heating element area S [$cm^2$] is an area of a smallest quadrangular or circular region that surrounds an entirety of a projection region that is formed by projecting the heating element onto the closest transmission layer in a direction perpendicular to the closest transmission layer (where $0\ cm^2 < S \leq 400\ cm^2$), and a representative dimension L [cm]= $2\times\sqrt{(S/\pi)}$. As the ratio D/L decreases, heat transfer from the heating element to the closest transmission layer becomes increasingly and inevitably dependent on heat transfer through an atmosphere in the first space. As a result, heat accumulation in the first space increases, and the temperature of the closest transmission layer may be easily increased. By making the ratio D/L be 0.06 or more, excessive increase of the conductive heat flux can be prevented, the amount of heat transfer between the heating element and the filter unit during use can be reduced, and increase in the temperature of the filter unit (in particular, the closest transmission layer) can be sufficiently suppressed. As the ratio D/L increases, heat transfer in the first space becomes increasingly dependent on convection. If the ratio D/L becomes excessively high, convective loss in the first space increases, and the temperature of the heating element may be easily reduced. In this case, by making the ratio D/L be 0.23 or less, increase in convective heat transfer coefficient can be prevented, decrease in the temperature of the heating element due to convective loss can be sufficiently suppressed. Thus, by making the ratio D/L be in the range of $0.06 \leq D/L \leq 0.23$, the temperature difference between the heating element and the filter unit (in particular, the closest transmission layer) can be further increased, while suppressing decrease in the temperature of the heating element during use. Consequently, a larger amount of the energy of infrared radiation from the heating element is transmitted by the filter unit and emitted toward an object, so that infrared processing (such as heating) of the object can be efficiently performed. The phrase, "the area of the smallest quadrangular or circular region that surrounds the entirety of a projection region" refers to the area of a smaller one of the smallest quadrangular region and the smallest circular region that surrounds the entirety of the projection region. The term "quadrangle" includes a square, a rectangle, a parallelogram, and other quadrangles. The term "circle" includes a circle and an ellipse. Preferably, (the area of the projection region)/(the heating element area S)≥0.5 so that the aforementioned effect of satisfying $0.06 \leq D/L \leq 0.23$ can be more reliably obtained. In the infrared heater according to the present invention that satisfies $0.06 \leq D/L \leq 0.23$, a state in which "the first space is open to the outside space" refers to a state in which the first space and the outside space are connected to each other so that air can freely flow therebetween to the extent that the aforementioned effect (the effect of suppressing heat accumulation in the first space and suppressing increase in the temperature of the filter unit) can be obtained. It is sufficient that the outside space is a non-vacuum atmosphere. The outside space may be an air atmosphere. That is, the first space may be open to the air atmosphere. The ratio D/L may be 0.08 or more.

The infrared heater according to the present invention may further include a heating-element-side reflective member that is disposed on a side opposite to the one or more transmission layers when seen from the heating element and that reflects infrared radiation in the reflection wavelength range. In this case, the heating-element-side reflective member reflects, toward the one or more transmission layers, infrared radiation emitted in a direction opposite to the one ore more transmission layers when seen from the heating element, and thereby the heating element can be heated by the infrared radiation reflected by the heating-element-side reflective member. Therefore, the temperature difference between the heating element and the filter unit during use can be further increased. The heating-element-side reflective member may reflect infrared radiation outside the reflection wavelength range.

In the infrared heater according to the present invention, the heating element may be a planar heating element having a flat surface that is capable of emitting infrared radiation toward the one or more transmission layers and absorbing infrared radiation in the reflection wavelength range. In this case, the heating element can easily absorb infrared radiation reflected by the reflective section as compared with a case where, for example, the heating element is a linear heating element, and the temperature of the heating element can be easily increased. Accordingly, the temperature difference between the heating element and the filter unit during use can be further increased.

An infrared processing device according to the present invention, for performing infrared processing by emitting infrared radiation toward an object, includes any one of the infrared heaters according to the present invention described above; and a furnace body that forms a processing space which is not directly connected to the first space and in which the infrared processing is performed by using infrared radiation emitted from the heating element and passed through the filter unit.

The infrared processing device includes any one of the infrared heaters according to the present invention described above. Therefore, it is possible to obtain the advantages the same as those of the aforementioned infrared heater according to the present invention, for example, the effect of increasing the temperature difference between the heating element and the filter unit (in particular, the transmission layer) during use can be increased.

An infrared processing device according to the present invention, which is a device for performing infrared processing by emitting infrared radiation toward an object, may include an infrared heater and a furnace body. The infrared heater includes a heating element that emits infrared radiation when heated; and a filter unit including a first transmission layer that has reflection characteristics of reflecting infrared radiation in a predetermined reflection wavelength range and transmits at least a part of the infrared radiation from the heating element. The heating element is capable of absorbing infrared radiation in the reflection wavelength range and a first space between the heating element and the first transmission layer is open to an outside space. The furnace body forms a processing space which is not directly connected to the first space and in which the infrared processing is performed by using infrared radiation emitted from the heating element and passed through the filter unit.

In the infrared processing device according to the present invention, the heating element and the first space may be located outside the furnace body. In this case, because the first space is located outside the furnace body, increase in the temperature of the transmission layer (in particular, a transmission layer closest to the heating element) is further suppressed. Therefore, the temperature difference between the heating element and the filter unit during use can be further increased. In the case where the infrared heater includes the second transmission layer, the second space may be also located outside the furnace body. In this case, increase in the temperature of the filter unit can be further suppressed, so that the temperature difference between the heating element and the filter unit during use can be increased further.

In the infrared processing device according to the present invention, when the infrared heater has the second space, the processing space in the furnace body need not be directly connected to the second space. The infrared processing device according to the present invention may include a cooling unit for cooling the filter unit by making a coolant flow through the second space. In this case, increase in the temperature of the filter unit is suppressed by using the coolant, and the temperature difference between the heating element and the filter unit during use can be further increased.

DESCRIPTION OF THE PREFERRED EMBODIMENTS

First Embodiment

Figure 1:
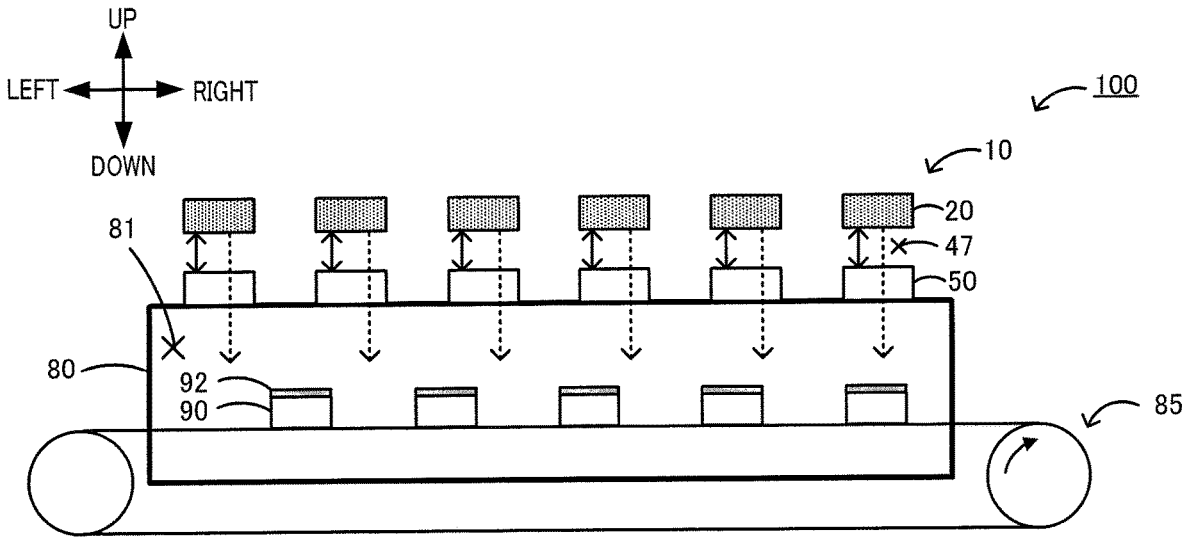
FIG. 1 is a longitudinal sectional view of an infrared processing device 100 according to a first embodiment.
Figure 2:
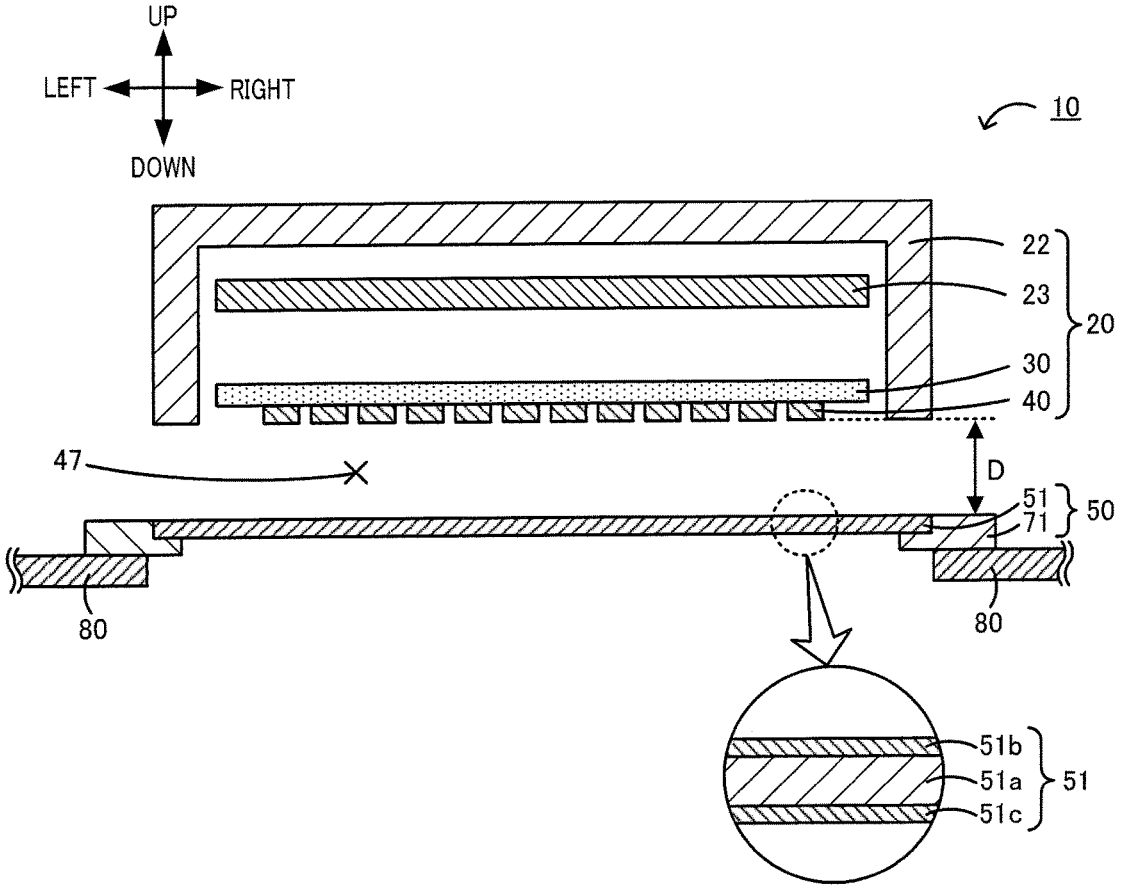
FIG. 2 is an enlarged sectional view of an infrared heater 10 according to the first embodiment.
Figure 3:
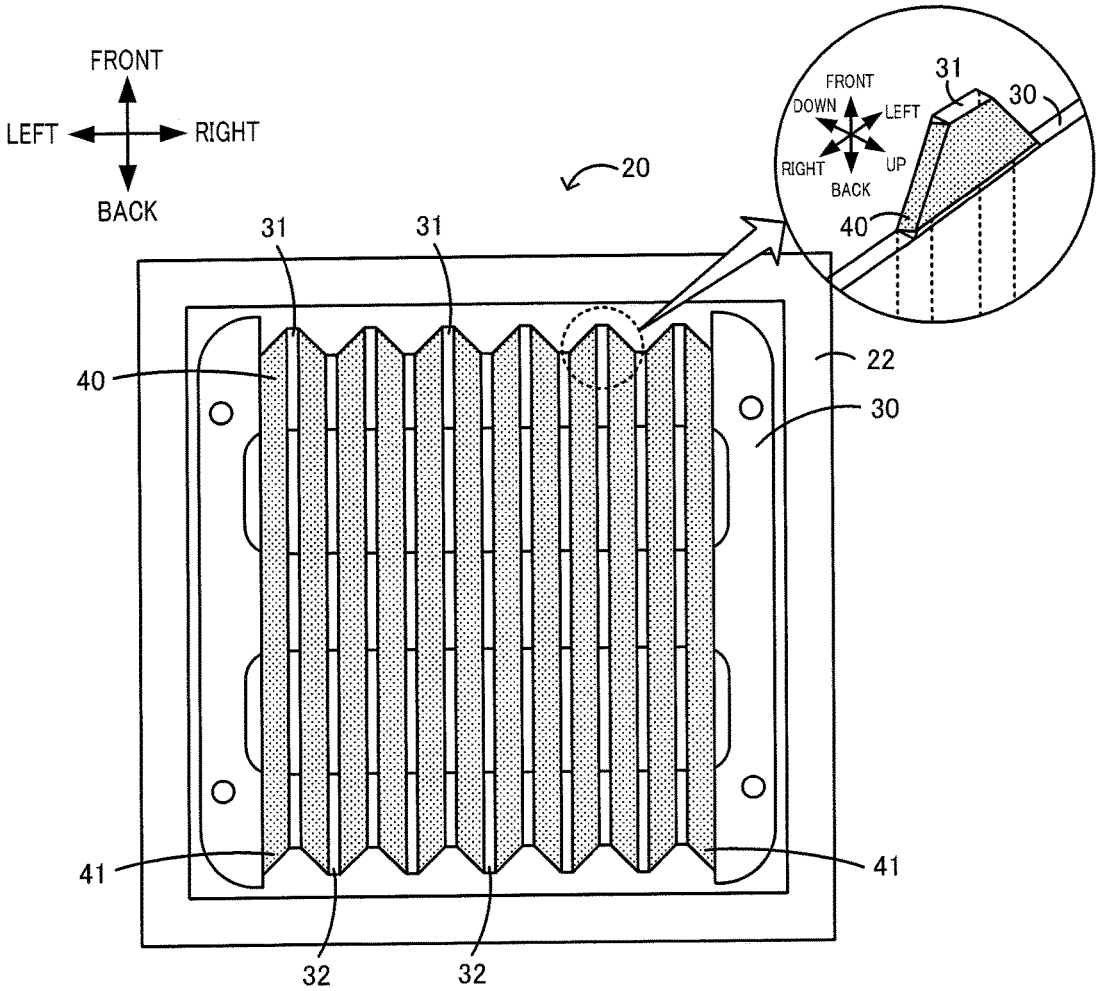
FIG. 3 is a bottom view of a heat generating unit 20 according to the first embodiment.

Next, embodiments of the present invention will be described with reference to the drawings. FIG. 1 is a longitudinal sectional view of an infrared processing device 100 including a plurality of infrared heaters 10. FIG. 2 is an enlarged sectional view of one of the infrared heaters 10. FIG. 3 is a bottom view of a heat generating unit 20. In the present embodiment, the up-down direction, the left-right direction, and the front-back direction are as shown in FIGS. 1 to 3.

The infrared processing device 100 is a drying furnace that performs infrared processing (here, drying of a coating 92) by emitting infrared radiation toward an object (the coating 92) formed on a semiconductor device 90. The infrared processing device 100 includes a furnace body 80 that forms a processing space 81, a belt conveyer 85, and the plurality of infrared heaters 10. The furnace body 80 is a heat insulating structure having a substantially rectangular-parallelepiped shape and forms the processing space 81 therein. The plurality of (in FIG. 1, six) infrared heaters 10 are attached to the upper surface of the furnace body 80. The infrared heaters 10 emit infrared radiation into the processing space 81. The belt conveyer 85, which includes a belt extending through the left and right ends of the furnace body 80 and through the processing space 81, conveys the semiconductor device 90 from left to right. The coating 92 formed on the semiconductor device 90 is, for example, a coating including silicone and toluene, which becomes a protective film of the semiconductor device 90 after being dried.

As illustrated in FIGS. 1 and 2, the infrared heater 10 includes the heat generating unit 20 and a filter unit 50, which is disposed below the heat generating unit 20. The heat generating unit 20 includes a case 22 that covers the upper side of the infrared heater 10, a heating element 40 that emits infrared radiation when heated, a support plate 30 that supports the heating element 40 in the case 22, and a heating-element-side reflective member 23 that is disposed between the case 22 and the heating element 40 and the support plate 30 in the up-down direction.

The case 22, in which the heating element 40 and other components are disposed, is a box-like member having a substantially rectangular parallelepiped shape and is opened downward. The case 22 includes fixing members (not shown) for fixing the heating-element-side reflective member 23 and the support plate 30 in the case 22. The case 22 includes an attachment member (not shown) for attaching and fixing the infrared heater 10 to another member (not shown).

The heating-element-side reflective member 23 is a plate-shaped member that is disposed on a side opposite to a first transmission layer 51 when seen from the heating element 40 (above the heating element 40). The heating-element-side reflective member 23, which can reflect infrared radiation emitted from the heating element 40, is made of a metal (such as SUS (stainless steel) or aluminum) in the present embodiment.

The support plate 30 is a flat plate-shaped member around which the heating element 40 is wound and that supports the heating element 40. The support plate 30 is made of an insulator, such as mica or alumina ceramics. As illustrated in FIG. 3, the support plate 30 includes a plurality of (in the present embodiment, six) front-side protruding portions 31 formed on the front side thereof and a plurality of (in the present embodiment, five) back-side protruding portions 32 formed on the back side thereof. Each of the front-side protruding portions 31 and the back-side protruding portions 32 has a trapezoidal shape in a bottom view and includes a top portion and inclined surfaces. The top portion has a surface parallel to the left-right direction. The inclined surfaces are disposed on the left and right sides of the top portion and each have an angle (for example, 45°) with respect to the left-right direction. The front-side protruding portions 31 and the back-side protruding portions 32 are arranged in the left-right direction at a regular pitch. Thus, the front side and the back side of the support plate 30 each have protrusions and recesses. The front-side protruding portions 31 and the back-side protruding portions 32 are displaced from each other with a ½ pitch in the left-right direction. The support plate 30 has holes (in FIG. 3, two holes), through which infrared radiation from the heating element 40 can reach the heating-element-side reflective member 23 above the support plate 30.

The heating element 40 is a ribbon-shaped heating element, which is a so-called planar heating element. The heating element 40 is made of a metal, such as a Ni—Cr alloy. The heating element 40 can absorb, through a surface (lower surface) thereof facing the first transmission layer 51, at least a part of the infrared radiation in the reflection wavelength range (described below) of the first transmission layer 51. The absorptance is preferably 70% and more, more preferably 80% or more, and further preferably 90% or more. In the present embodiment, the infrared absorptance of the heating element 40 in the wavelength range of 2 μm to 8 μm is 70% or more. In the present embodiment, the infrared emissivity and the infrared absorptance of the heating element 40 are increased by coating the surface of the heating element 40 with a thermally sprayed ceramic coating. Examples of the material of the thermally sprayed ceramic coating include alumina and chromia. Preferably, the infrared emissivity of the surface of the heating element 40 facing the first transmission layer 51 (the lower surface of the heating element 40) is higher than that of a surface of the heating element 40 facing away from the first transmission layer 51 (the upper surface of the heating element 40). In the present embodiment, only the lower surface of the heating element 40 is coated with a thermally sprayed ceramic coating, and the infrared emissivity of the upper surface of the heating element 40 is lower than that of the lower surface of the heating element 40. Preferably, the infrared emissivity of the upper surface of the heating element 40 is 30% or less. The shapes of the support plate 30 and the heating element 40 illustrated in FIGS. 2 and 3 are publicly known and described in, for example, Japanese Unexamined Patent Application Publication No. 2006-261095.

As illustrated in FIG. 3, the heating element 40 is wound around the support plate 30 from a left-back folded end 41 to a right-back folded end 41 to pass across the lower surface of the support plate 30 a plurality of times (in the present embodiment, twelve times) in the front-back direction. To be more specific, the heating element 40 extends from the left-back folded end 41 over the lower surface of the support plate 30 toward the front-side protruding portion 31, is folded back along the left inclined surface of the front-side protruding portion 31, and passes over the upper surface of the front-side protruding portion 31 (see the enlarged view in the upper right part of FIG. 3). The heating element 40, which has passed over the upper surface of the front-side protruding portion 31, is folded back along the right inclined surface of the front-side protruding portion 31, extends over the lower surface of the support plate 30 toward the back-side protruding portion 32, is folded back along an inclined surface of the back-side protruding portion 32, passes over the upper surface of the back-side protruding portion 32, and extends over the lower surface of the support plate 30 toward the front-side protruding portion 31. In this way, the heating element 40 is alternately wound around the front-side protruding portions 31 and the back-side protruding portions 32 while passing over the lower surface of the support plate 30 in the front-back direction, and extends to the right-back folded end 41. Although not illustrated, the heating element 40 is folded back toward the upper surface of the support plate 30 at the folded ends 41 and extend further. Both ends of the heating element 40 are connected to a pair of input terminals (not shown) attached to the case 22. Electric power can be supplied to the heating element 40 from the outside through the pair of input terminals. The lower surface of the heating element 40 and the upper surface of the first transmission layer 51, which face each other, are substantially parallel to the horizontal direction (the front-back and left-right directions).

Figure 4:
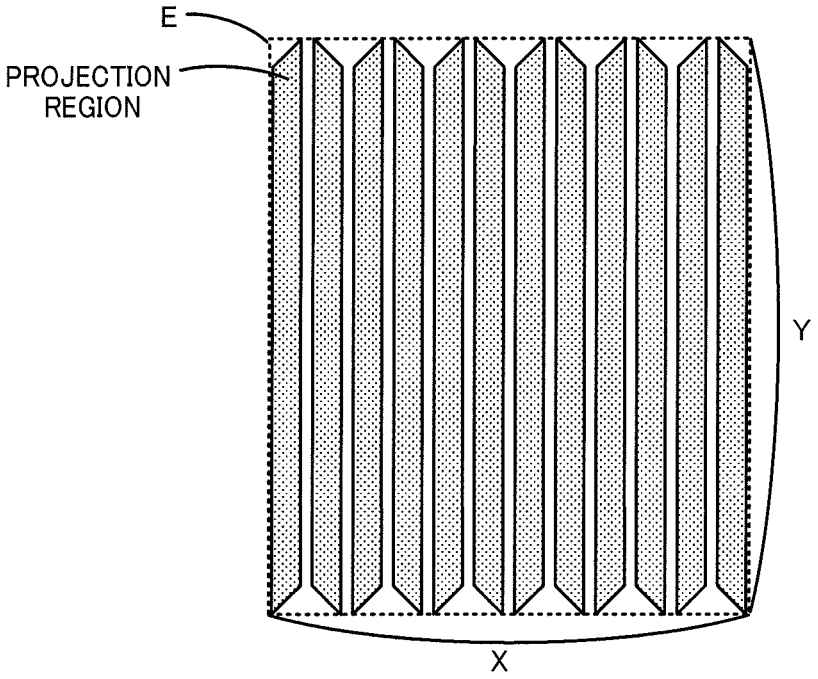
FIG. 4 illustrates the relationship between a projection region and a heating element area S according to the first embodiment.

The heating element 40 preferably satisfies $0.08 \leq D/L \leq 0.23$ and more preferably $0.14 \leq D/L \leq 0.19$, where a distance D [cm] is the distance between the heating element 40 and the first transmission layer 51, a heating element area S [$cm^2$] is the area of a smallest quadrangular or circular region that surrounds an entirety of a projection region that is formed by projecting the heating element 40 onto the first transmission layer 51 in a direction perpendicular to the first transmission layer 51 (where $0\ cm^2 < S \leq 400\ cm^2$), and a representative dimension L [cm]$=2\times\sqrt{(S/\pi)}$. In the present embodiment, the first transmission layer 51 is a flat plate-shaped member, and the heating element 40 and the first transmission layer 51 are disposed parallel to each other. Therefore, the projection region is the same as a region of the lower surface of the heating element 40 (a region having the shape of the heating element 40 in FIG. 3) when the heating element 40 is seen from below (in a direction perpendicular to the lower surface of the heating element 40 and the upper surface of the first transmission layer 51). The smallest quadrangular region that surrounds the projection region is a rectangular heating element region E shown in FIG. 4. The heating element area S is the product of the length of X of the rectangular heating element region E in the left-right direction (=the length from the left end to the right end of the heating element 40) and the length of Y of the rectangular heating element region E in the front-back direction (=the length of the heating element 40 in the front-back direction). Thus, the heating element area S is defined as the area of a region including portions in which the heating element 40 is not present, such as gaps, in the left-right direction, between parts of the heating element 40 extending in the front-back direction. The representative dimension L is equal to the diameter of a circle whose area is the same as the heating element area S. In the present embodiment, the smallest heating element region E that surrounds the projection region of the heating element 40 is quadrangular. However, if, for example, the shape of the heating element 40 is similar to a circle and the heating element area S becomes smaller when the projection region of the heating element 40 is surrounded by a circular region, the heating element area S is defined as the area of the smallest circular region that surrounds the projection region. Preferably, (the area of the projection region)/(the heating element area S)$\geq 0.5$ so that the effect of satisfying $0.08 \leq D/L \leq 0.23$ can be more reliably obtained. That is, preferably, the ratio of the area of the region in which the heating element 40 (projection region) is present to the area of the heating element region E in FIG. 4 is 50% or more. The heating element area S may be in the range of $1\ cm^2 < S \leq 400\ cm^2$. Although this is not a limitation, the distance D may be in the range of 8 mm to 30 mm. The ratio D/L may be 0.06 or more. The ratio D/L may be 0.20 or less.

The heat generating unit 20 and the filter unit 50 are connected to each other through a connection member (not shown), so that the positional relationship between these units are fixed. Thus, the heating element 40 and the filter unit 50 (the first transmission layer 51) are separated from each other with a first space 47 therebetween. As illustrated in FIG. 2, the case 22 is separated from a first fixing plate 71 vertically, and the first space 47 is open to the outside space (space outside the furnace body 80) through the vertical gap between the case 22 and the first fixing plate 71. The heating element 40 and the first transmission layer 51 are exposed to the first space 47. In the present embodiment, the outside space is an air atmosphere.

The filter unit 50 includes the first transmission layer 51, which transmits at least a part of the infrared radiation from the heating element 40; and the first fixing plate 71, which is a quadrangular frame-shaped member onto which the first transmission layer 51 is placed and fixed. The first fixing plate 71 is attached to an upper part of the furnace body 80.

The first transmission layer 51 is a plate-shaped member that is quadrangular in a bottom view. The first transmission layer 51 has a first transmission peak of infrared transmittance; a second transmission peak of infrared transmittance, whose wavelength is longer than that of the first transmission peak; and reflection characteristics of reflecting infrared radiation in a predetermined wavelength range between the wavelength of the first transmission peak and the wavelength of the second transmission peak. In the present embodiment, the first transmission layer 51 is an interference filter (optical filter). As illustrated in FIG. 2, the first transmission layer 51 includes a substrate 51*a*, an upper coating layer 51*b* that covers the upper surface of the substrate 51*a*, and a lower coating layer 51*c* that covers the lower surface of the substrate 51*a*. The upper coating layer 51*b*, which functions as a bandpass layer, transmits downward a part of the light that is emitted from above the first transmission layer 51 and that has the wavelengths of the first and second transmission peaks or is in wavelength ranges around the wavelengths of the first and second transmission peaks. The upper coating layer 51*b* reflects infrared radiation in the reflection wavelength range upward. The lower coating layer 51*c*, which functions as an anti-reflection layer, suppresses upward reflection of infrared radiation (in particular, infrared radiation outside the reflection wavelength range) by the lower surface of the substrate 51*a*. Examples of the material of the substrate 51*a* include silicon. Examples of the material of the upper coating layer 51*b* include zinc selenide, germanium, and zinc sulfide. Examples of the material of the lower coating layer 51*c* include germanium, silicon monoxide, and zinc sulfide. At least one of the upper coating layer 51*b* and the lower coating layer 51*c* may have a multilayer structure in which layers made of different materials are stacked.

In the present embodiment, the wavelength of the first transmission peak of the first transmission layer 51 is in the range of 2 μm to 3 μm, and the wavelength of the second transmission peak of the first transmission layer 51 is in the range of 5 μm to 8.5 μm, and the reflection wavelength range of the first transmission layer 51 is 3.5 μm to 4.5 μm. For example, such filter characteristics can be obtained by using a multilayer film in which zinc sulfide and germanium are alternately stacked as the upper coating layer 51*b*, by using a multilayer film in which zinc sulfide and germanium are alternately stacked as the lower coating layer 51*c*, and by appropriately adjusting the thicknesses of the substrate 51*a*, the upper coating layer 51*b*, and the lower coating layer 51*c*. The infrared transmittance at each of the first transmission peak and the second transmission peak is preferably 80% or more, and more preferably 90% or more. The infrared reflectance in the reflection wavelength range is preferably 70% or more, more preferably 80% or more, and further preferably 90% or more. The infrared transmittance of the first transmission layer 51 in at least a part of the reflection wavelength range is preferably 10% or less, and more preferably 5% or less. The infrared transmittance of the first transmission layer 51 in the entire reflection wavelength range is preferably 10% or less, and more preferably 5% or less.

Although this it not a limitation, the infrared transmittance of the first transmission layer 51 in the wavelength range of 2 μm to 3 μm may be 40% or more. The infrared transmittance of the first transmission layer 51 in the wavelength range of 5 μm to 8.5 μm may be 80% or more. The infrared transmittance of the first transmission layer 51 in the wavelength range of 8.5 μm to 9.5 μm may be 70% or more. The infrared transmittance of the first transmission layer 51 in the wavelength range of 9.5 μm to 13 μm may be 60% or more.

A plurality of openings, as many as the infrared heaters 10, are formed in the upper surface (ceiling) of the furnace body 80. The plurality of infrared heaters 10 are attached to the upper part of the furnace body 80 so as to close the openings. Therefore, the lower surface of the first transmission layer 51 is exposed to the processing space 81. The processing space 81 and the first space 47 are separated from each other by the first transmission layer 51 and the first fixing plate 71 and are not directly connected to each other. However, because both the processing space 81 and the first space 47 are connected to the outside space outside the infrared processing device 100, they are connected to each other through the outside space. Each of the infrared heaters 10 is disposed so as to protrude upward from the upper surface of the furnace body 80. Therefore, the heating element 40 and the first space 47 are disposed outside the furnace body 80.

An example of the use of the infrared processing device 100, which has the structure described above, will be described below. First, a power source (not shown) is connected to the input terminals of the infrared heater 10, and electric power is supplied to the infrared heater 10 so that the temperature of the heating element 40 becomes a predetermined temperature (here, 700° C.). When the electric power is supplied, the heating element 40 is heated and emits infrared radiation. The belt conveyer 85 conveys the semiconductor device 90, on which the coating 92 has been formed beforehand. Thus, the semiconductor device 90 is conveyed into the furnace body 80 from the left side of the furnace body 80, passes through the processing space 81, and is conveyed out of the processing space 81 from the right side of the furnace body 80. While passing through the processing space 81, the coating 92 is dried (toluene is evaporated) by infrared radiation from the infrared heater 10 and becomes a protective film.

When the heating element 40 is heated, infrared radiation is emitted mainly from the lower surface of the heating element 40 toward the filter unit 50 (the first transmission layer 51) below. The infrared radiation is incident on the upper surface of the first transmission layer 51 substantially perpendicularly. A part of the infrared radiation that is emitted from the heating element 40 and that is in the reflection wavelength range is reflected upward by the filter unit 50 the first transmission layer 51) and is absorbed by the heating element 40 (see solid-line arrows in FIG. 1). Thus, the infrared radiation reflected by the filter unit 50 is used to heat the heating element 40. Therefore, the amount of energy (electric power) that needs to be supplied from the outside to heat the heating element 40 to 700° C. can be reduced. In other words, the temperature of the heating element 40 can be increased easily. On the other hand, because the filter unit 50 (the first transmission layer 51) has reflection characteristics, for example, as compared with a case where the filter unit 50 absorbs infrared radiation in the reflection wavelength range, increase in the temperature of the filter unit 50 is suppressed. Because the first space 47 is open to the outside space, heat accumulation in the first space 47 is suppressed and increase in the temperature of the first transmission layer 51 is suppressed. Thus, in the infrared heater 10, the temperature of the heating element 40 can be easily increased, and the temperature of the filter unit 50 cannot be easily increased. As a result, the temperature difference between the heating element 40 and the filter unit 50 (in particular, the first transmission layer 51) can be easily increased.

A part of the infrared radiation that is emitted from the heating element 40 and that is outside the reflection wavelength range passes through the filter unit 50 (the first transmission layer 51) and is emitted into the processing space 81 (see broken-line arrows in FIG. 1). Because the filter unit 50 (the first transmission layer 51) has the aforementioned filter characteristics, the infrared radiation emitted into the processing space 81 has two radiation peaks and includes substantially no infrared radiation in the reflection wavelength range (3.5 μm to 4.5 μm). Toluene has infrared absorption peaks at the wavelengths of, for example, 3.3 μm and 6.7 μm. Therefore, when the infrared heater 10 emits infrared radiation having radiation peaks near these two absorption peaks into the processing space 81, toluene can be efficiently evaporated from the coating 92. When the toluene evaporates, a protective silicone film can be formed on the surface of the semiconductor device 90. Thus, with the infrared heater 10 according to the present embodiment, infrared radiation in the wavelength range for efficiently performing infrared processing (drying of the coating 92) can pass through the filter unit 50 and can be emitted toward the coating 92. On the other hand, the infrared radiation in the reflection wavelength range, whose wavelength is away from the absorption peaks of toluene, is infrared radiation in an unwanted wavelength range and does not substantially contribute to evaporation of toluene. Therefore, with the infrared heater 10, the infrared radiation in the reflection wavelength range is reflected by the filter unit 50 as described above and is not emitted into the processing space 81, so that the infrared radiation in the reflection wavelength range is used to heat the heating element 40. Even when the first transmission layer 51 has the same filter characteristics, the wavelength characteristics, such as the radiation peaks, of infrared radiation emitted into the processing space 81 vary in accordance with a change in the temperature of the heating element 40. Therefore, by changing the temperature of the heating element 40, the wavelengths of two radiation peaks of infrared radiation emitted into the processing space 81 can be adjusted to some extent. The temperature of the heating element 40 during use can be appropriately adjusted in accordance with an object so that, for example, the radiation peak of infrared radiation emitted into the processing space 81 becomes as close as possible to the wavelength of the absorption peak of the object.

The infrared heater 10 according to the present embodiment described above includes the heating element 40, which emits infrared radiation when heated and which is capable of absorbing infrared radiation in a predetermined reflection wavelength range; and the filter unit 50, which is disposed so as to be separated by the first space 47 from the heating element 40, the first space 47 being open to the outside space. The filter unit 50 includes one or more transmission layers (the first transmission layer 51) that transmit at least a part of the infrared radiation from the heating element 40, and a reflective section (the first transmission layer 51) that reflects infrared radiation in the reflection wavelength range toward the heating element 40. With the infrared heater 10, infrared radiation is emitted when the heating element 40 is heated, the infrared radiation passes through the filter unit 50 including one or more transmission layers (the first transmission layer 51), and the infrared radiation is emitted toward, for example, an object (the coating 92). The reflective section (the first transmission layer 51) has reflection characteristics of reflecting infrared radiation in the predetermined reflection wavelength range. The heating element 40 can absorb infrared radiation in the reflection wavelength range. Therefore, because the one or more transmission layers (the first transmission layer 51) transmit infrared radiation from the heating element 40, the temperature of the transmission layer does not easily increase as compared with a case where the one or more transmission layers absorb the infrared radiation. On the other hand, because the heating element 40 can absorb a part of the infrared radiation emitted by itself and use the infrared radiation to heat itself, the temperature of the heating element 40 can be easily increased. As a result, the temperature difference between the heating element 40 and the filter unit 50 (in particular, the first transmission layer 51, which is closest to the heating element 40) during use can be increased. Because the temperature difference between the heating element 40 and the filter unit 50 can be increased, for example, the temperature of the heating element 40 can be increased while maintaining the temperatures of the one or more transmission layers (the first transmission layer 51) to be the heatproof temperature or less, and the energy of infrared radiation emitted to the object (the coating 92) can be increased. With the infrared heater 10, even when the temperature of the heating element 40 is the same, the temperature of the filter unit 50 can be maintained to be lower. Moreover, the distance between the heating element 40 and the one or more transmission layers (the first transmission layer 51) can be reduced while maintaining the temperatures of the one or more transmission layers (the first transmission layer 51) to be the heatproof temperature or less. As a result, the distance between the heating element 40 and the object (the coating 92) can be also reduced.

In the infrared heater 10, the one or more transmission layers include the first transmission layer 51, and the first transmission layer 51 serves as at least a part of the reflective section. The first transmission layer 51 has reflection characteristics of reflecting infrared radiation in the predetermined reflection wavelength range and transmits at least a part of the infrared radiation from the heating element 40.

With the infrared processing device 100 according to the present embodiment described above, the first transmission layer 51 has reflection characteristics of reflecting infrared radiation in the reflection wavelength range, and the heating element 40 can absorb the infrared radiation in the reflection wavelength range. Therefore, because the first transmission layer 51 reflects the infrared radiation in the reflection wavelength range, the temperature of the first transmission layer 51 does not easily increase as compared with a case where the first transmission layer 51 absorbs the infrared radiation. On the other hand, because the heating element 40 can absorb a part of the infrared radiation emitted by itself and use the infrared radiation to heat itself, the temperature of the heating element 40 can be easily increased. As a result, the temperature difference between the heating element 40 and the filter unit 50 (in particular, the first transmission layer 51) during use can be increased. Because the temperature difference between the heating element 40 and the filter unit 50 can be increased, for example, the temperature of the heating element 40 can be increased while maintaining the temperature of the first transmission layer 51 to be the heatproof temperature or less, and the energy of infrared radiation emitted to the object (the coating 92) in the processing space 81 can be increased. With the infrared processing device 100 according to the present invention, even when the temperature of the heating element 40 is the same, the temperature of the filter unit 50 can be maintained to be lower, and increase in the temperatures of the furnace body 80 and the processing space 81 due to increase in the temperature of the filter unit 50 can be suppressed. In the present embodiment, the outside space is an air atmosphere, and the first space 47 is open to the air atmosphere. Because the outside space is not a vacuum atmosphere and the first space 47 is open to the outside space, heat accumulation in the first space 47 is suppressed and an advantage of suppressing increase in the temperature of the first transmission layer 51 can be obtained.

The infrared heater 10 satisfies $0.08 \leq D/L \leq 0.23$. As the ratio D/L decreases, heat transfer from the heating element 40 to the first transmission layer 51 becomes increasingly and inevitably dependent on heat transfer through the air (atmosphere) in the first space 47. As a result, heat accumulation in the first space 47 increases, and the temperature of the first transmission layer 51 may be easily increased. By making the ratio D/L be 0.08 or more, excessive increase of the conductive heat flux can be prevented, the amount of heat transfer between the heating element 40 and the filter unit 50 during use can be reduced, and increase in the temperature of the filter unit 50 (in particular, the first transmission layer 51) can be sufficiently suppressed. As the ratio D/L increases, heat transfer in the first space 47 becomes increasingly dependent on convection. If the ratio D/L becomes excessively high, convective loss in the first space 47 becomes large, and the temperature of the heating element 40 may be easily reduced. In this case, by making the ratio D/L be 0.23 or less, increase in the convective heat transfer coefficient can be prevented, and decrease in the temperature of the heating element 40 due to convective loss can be sufficiently suppressed. Thus, by making the ratio D/L be in the range of $0.08 \leq D/L \leq 0.23$, the temperature difference between the heating element 40 and the filter unit 50 (in particular, the first transmission layer 51) can be further increased, while suppressing decrease in the temperature of the heating element 40 during use. Consequently, a larger amount of the energy of infrared radiation from the heating element 40 is transmitted by the filter unit 50, guided into the processing space 81, and infrared processing of the coating 92 can be efficiently performed.

In the infrared processing device 100, the heating element 40 and the first space 47 of the infrared heater 10 are located outside the furnace body 80. Because the first space 47 is located outside the furnace body 80, increase in the temperature of the first transmission layer 51 can be further suppressed, and therefore the temperature difference between the heating element 40 and the filter unit 50 during use can be further increased.

The infrared heater 10 includes the heating-element-side reflective member 23, which is disposed on a side opposite to the first transmission layer 51 (above the heating element 40) when seen from the heating element 40 and which reflects infrared radiation at least in the reflection wavelength range. Therefore, the heating-element-side reflective member 23 reflects infrared radiation emitted upward from the heating element 40 toward the first transmission layer 51, and thereby the heating element 40 can be heated by the infrared radiation reflected by the heating-element-side reflective member 23. Therefore, the temperature difference between the heating element 40 and the filter unit 50 (in particular, the first transmission layer 51) during use can be further increased.

The heating element 40 is a planar heating element that can emit infrared radiation toward the first transmission layer 51 and that has a flat surface that can absorb infrared radiation in the reflection wavelength range. Therefore, the heating element 40 can easily absorb infrared radiation reflected by the first transmission layer 51 as compared with a case where, for example, the heating element 40 is a linear heater, and the temperature of the heating element 40 can be easily increased. Accordingly, the temperature difference between the heating element 40 and the filter unit 50 during use can be further increased.

Second Embodiment

Figure 5:
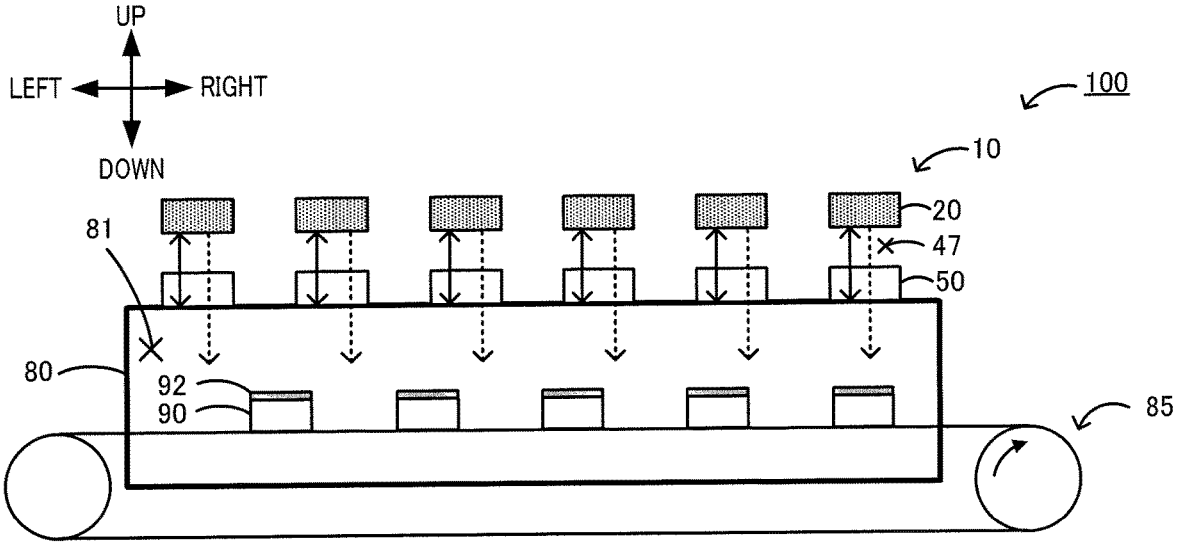
FIG. 5 is a longitudinal sectional view of an infrared processing device 100 according to a second embodiment.
Figure 6:
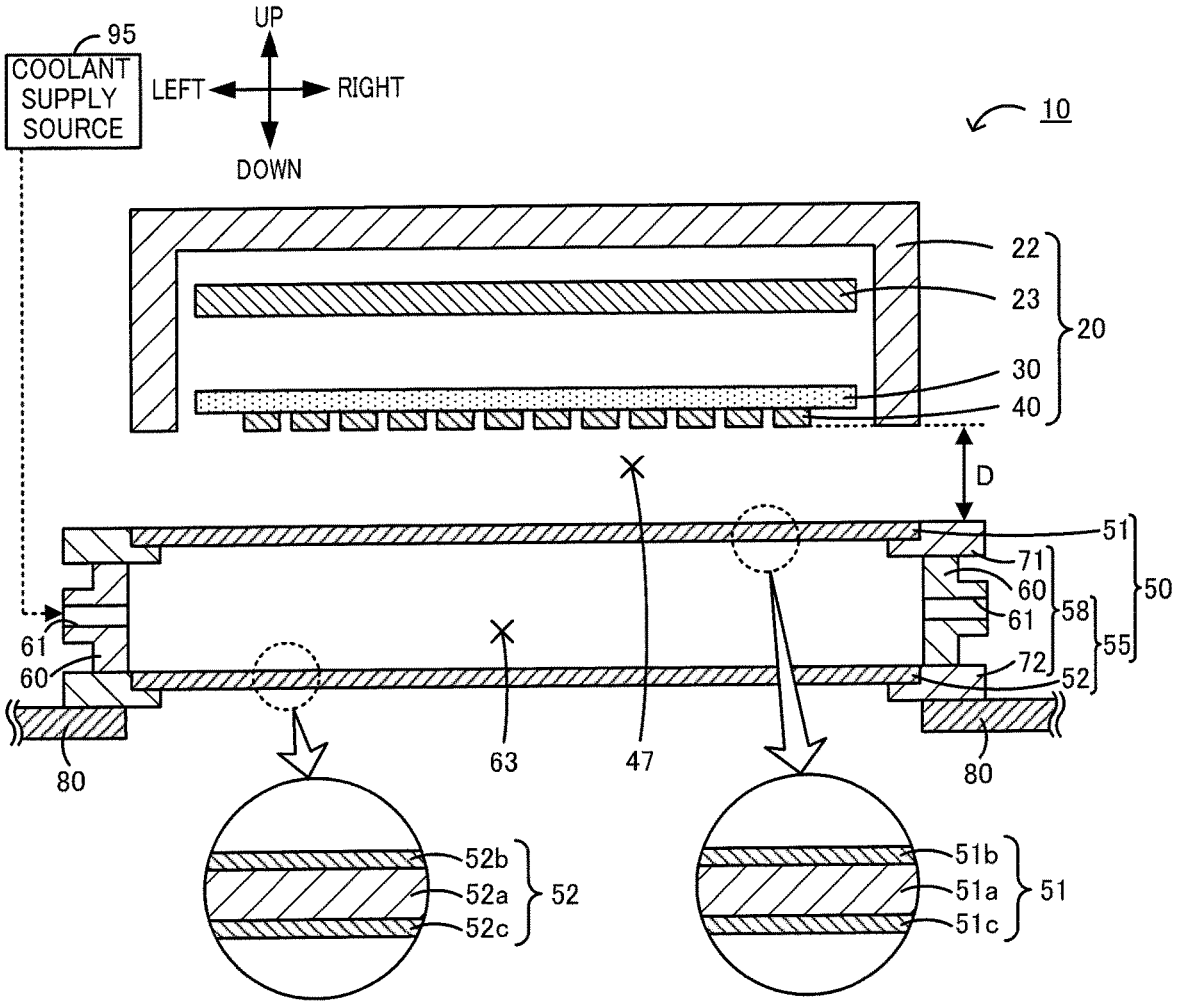
FIG. 6 is an enlarged sectional view of an infrared heater 10 according to the second embodiment.
Figure 7:
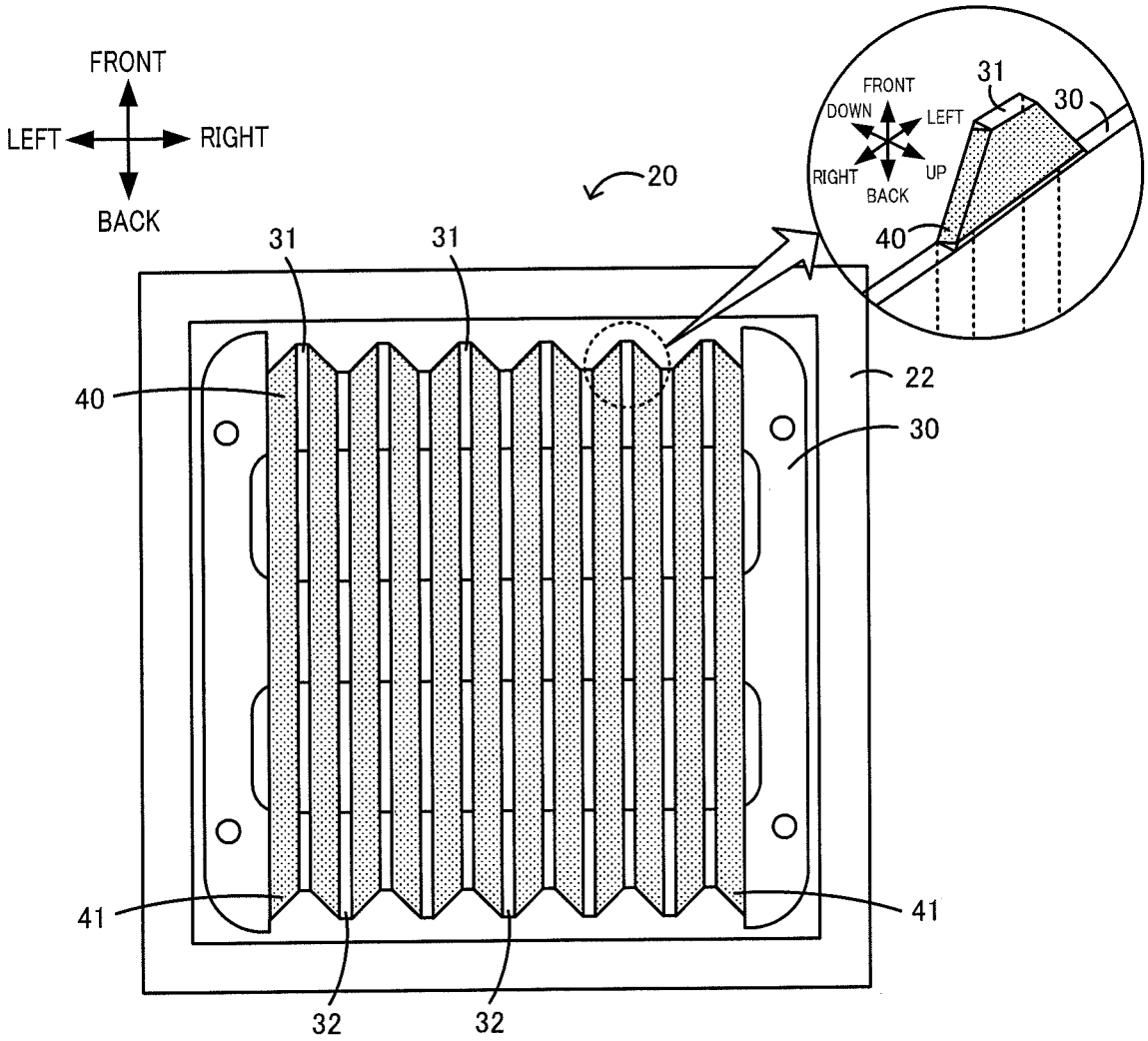
FIG. 7 is a bottom view of a heat generating unit 20 according to the second embodiment.
Figure 8:
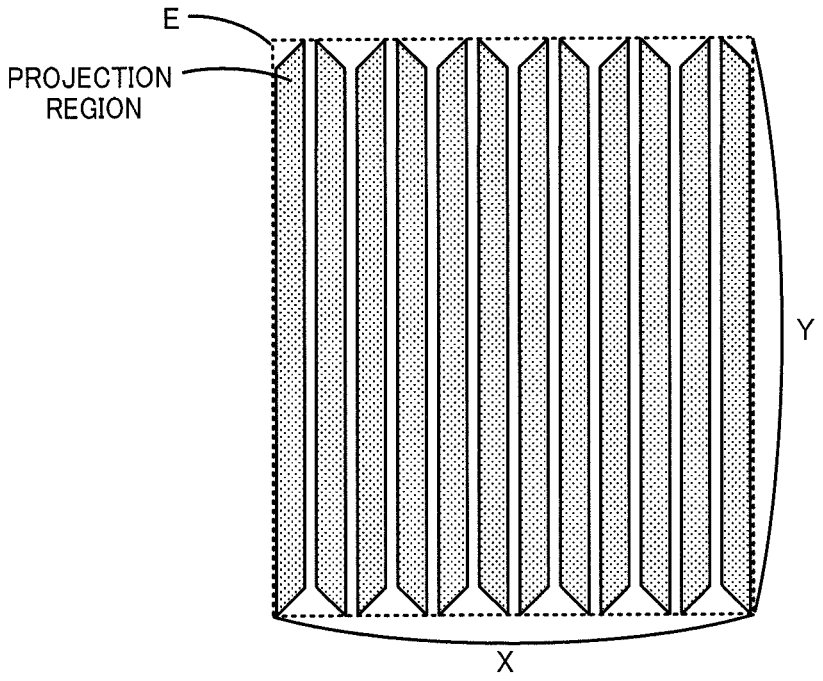
FIG. 8 illustrates the relationship between a projection region and a heating element area S according to the second embodiment.

Next, a second embodiment of the present invention will be described with reference to the drawings. FIG. 5 is a longitudinal sectional view of an infrared processing device 100 including a plurality of infrared heaters 10. FIG. 6 is an enlarged sectional view of one of the infrared heaters 10. FIG. 7 is a bottom view of a heat generating unit 20. FIG. 8 illustrates the relationship between a projection region and a heating element area S. In the present embodiment, the up-down direction, the left-right direction, and the front-back direction are as shown in FIGS. 5 to 7. Descriptions of elements of the second embodiment that are the same as those of the first embodiment will be omitted as appropriate.

The infrared heater 10 preferably satisfies $0.06 \leq D/L \leq 0.23$, where a distance D [cm] is the distance between the heating element 40 and the first transmission layer 51, which is one of one or more transmission layers of the filter unit 50 that is closest to the heating element (see FIG. 6); a heating element area S [$cm^2$] is the area of a smallest quadrangular or circular region that surrounds an entirety of a projection region that is formed by projecting the heating element onto the first transmission layer 51 in a direction perpendicular to the first transmission layer 51 (where $0\ cm^2 < S \leq 400\ cm^2$), and a representative dimension L [cm]$=2\times\sqrt{(S/\pi)}$. The ratio D/L may be 0.08 or more, or 0.20 or less. In the present embodiment, the first transmission layer 51 is a flat plate-shaped member, and the heating element 40 and the first transmission layer 51 are disposed parallel to each other. Therefore, the projection region is the same as a region of the lower surface of the heating element 40 (a region having the shape of the heating element 40 in FIG. 7) when the heating element 40 is seen from below (in a direction perpendicular to the lower surface of the heating element 40 and the upper surface of the first transmission layer 51). The smallest quadrangular region that surrounds the projection region is a rectangular heating element region E shown in FIG. 8. The heating element area S is the product of the length of X of the rectangular heating element region E in the left-right direction (=the length from the left end to the right end of the heating element 40) and the length of Y of the rectangular heating element region E in the front-back direction (=the length of the heating element 40 in the front-back direction). Thus, the heating element area S is defined as the area of a region including portions in which the heating element 40 is not present, such as gaps between parts of the heating element 40 in the left-right direction. The representative dimension L is equal to the diameter of a circle whose area is the same as the heating element area S. In the present embodiment, the smallest heating element region E that surrounds the projection region of the heating element 40 is quadrangular. However, if, for example, the shape of the heating element 40 is similar to a circle and the heating element area S becomes smaller when the projection region of the heating element 40 is surrounded by a circular region, the smallest circular region that surrounds the projection region is defined as the heating element region E, and the heating element area S is defined as the area of the heating element region E. That is, the heating element region E (the smallest quadrangular or circular region that surrounds the entirety of the projection region) is defined as a smaller one of the smallest quadrangular region that surrounds the entirety of the projection region and the smallest circular region that surrounds the entirety of the projection region. Preferably, (the area of the projection region)/(the heating element area S)≥0.5 so that the effect of satisfying $0.06 \leq D/L \leq 0.23$ can be more reliably obtained. That is, preferably, the ratio of the area of the region in which the heating element 40 (projection region) is present to the area of the heating element region E in FIG. 8 is 50% or more. The heating element area S may be in the range of 1 $cm^2 < S \leq 400$ $cm^2$. Although this it not a limitation, the distance D may be in the range of 8 mm to 30 mm.

The filter unit 50 includes, as transmission layers for transmitting at least a part of the infrared radiation from the heating element 40, the first transmission layer 51 and a second transmission layer 52 that is disposed so as to be separated by a second space 63 from the first transmission layer 51 on a side opposite to the heating element 40 when seen from the first transmission layer (below the first transmission layer 51). The filter unit 50 includes a reflective section 55 that reflects infrared radiation in the reflection wavelength range toward the heating element 40. The reflective section 55 includes a partition member 58 that fixes the first transmission layer 51 and the second transmission layer 52 in place and that partitions the second space 63 from the outside of the filter unit 50. The second transmission layer 52 is a part of the reflective section 55.

The first transmission layer 51 is a plate-shaped member that is quadrangular in a bottom view. The first transmission layer 51 transmits a part of the infrared radiation that is emitted from the heating element 40 and that is in a predetermined wavelength range including a wavelength to be emitted toward the coating 92. In the present embodiment, the first transmission layer 51 is an interference filter (optical filter). As illustrated in FIG. 6, the first transmission layer 51 includes a substrate 51*a*, an upper coating layer 51*b* that covers the upper surface of the substrate 51*a*, and a lower coating layer 51*c* that covers the lower surface of the substrate 51*a*. The upper coating layer 51*b*, which functions as a bandpass layer, transmits downward a part of the light that is emitted from above the first transmission layer 51 and that is in a predetermined wavelength range. The lower coating layer 51*c*, which functions as an anti-reflection layer, suppresses upward reflection of infrared radiation by the lower surface of the substrate 51*a*. Examples of the material of the substrate 51*a* include silicon. Examples of the material of the upper coating layer 51*b* include zinc selenide, germanium, and zinc sulfide. Examples of the material of the lower coating layer 51*c* include germanium, silicon monoxide, and zinc sulfide. At least one of the upper coating layer 51*b* and the lower coating layer 51*c* may have a multilayer structure in which layers made of different materials are stacked.

In the present embodiment, the first transmission layer 51 transmits infrared radiation at least in a wavelength range of 2 μm to 8 μm, which includes the reflection wavelength range. The reflection wavelength range is 3.5 μm to 4.5 μm. The wavelength range of infrared radiation that the first transmission layer 51 tranmits includes most of the wavelength range of near-infrared radiation (which is, for example, the range of 0.7 μm to 3.5 μm). For example, such filter characteristics can be obtained by using a multilayer film in which zinc sulfide and germanium are alternately stacked as the upper coating layer 51*b*, by using a multilayer film in which zinc sulfide and germanium are alternately stacked as the lower coating layer 51*c*, and by appropriately adjusting the thicknesses of the substrate 51*a*, the upper coating layer 51*b*, and the lower coating layer 51*c*. The wavelength range of infrared radiation that the first transmission layer 51 transmits may be 1 μm to 10 μm. The infrared transmittance of the first transmission layer 51 in the wavelength range of infrared radiation that the first transmission layer 51 transmits is preferably 70% or more, more preferably 80% or more, and further preferably 90% or more. Preferably, the infrared absorptance of the first transmission layer 51 (for example, in the wavelength range 0.7 to 1000 μm) is low. For example, the infrared absorptance of the first transmission layer 51 is preferably 30% or less, more preferably 20% or less, and further preferably 10% or less. The infrared transmittance of the first transmission layer 51 in the reflection wavelength range is preferably 70% or more, more preferably 80% or more, and further preferably 90% or more. The infrared reflectance of the first transmission layer 51 is preferably 30% or less, more preferably 20% or less, and further preferably 10% or less. The infrared reflectance of the first transmission layer 51 in the reflection wavelength range is preferably 30% or less, more preferably 20% or less, and further preferably 10% or less.

The second transmission layer 52 is a plate-shaped member that is quadrangular in a bottom view. The second transmission layer 52 is disposed below the first transmission layer 51 so as to be separated by the second space 63 from the first transmission layer 51. The upper surface of the second transmission layer 52 faces the lower surface of the first transmission layer 51, and the second transmission layer 52 is disposed so as to be substantially parallel to the first transmission layer 51. The second transmission layer 52 has a first transmission peak of infrared transmittance; a second transmission peak, whose wavelength is longer than that of the first transmission peak; and reflection characteristics of reflecting infrared radiation in a predetermined wavelength range between the wavelength of the first transmission peak and the wavelength of the second transmission peak. In the present embodiment, the second transmission layer 52 is an interference filter (optical filter), as with the first transmission layer 51. As illustrated in FIG. 6, the second transmission layer 52 includes a substrate 52*a*, an upper coating layer 52*b* that covers the upper surface of the substrate 52*a*, and a lower coating layer 52*c* that covers the lower surface of the substrate 52*a*. The upper coating layer 52*b*, which functions as a bandpass layer, transmits downward a part of the light that is emitted from above the second transmission layer 52 and that has the wavelengths of the first and second transmission peaks or is in wavelength ranges around the wavelengths of the first and second transmission peaks. The upper coating layer 52*b* reflects infrared radiation in the reflection wavelength range upward. The lower coating layer 52*c*, which functions as an anti-reflection layer, suppresses upward reflection of infrared radiation (in particular, infrared radiation outside the reflection wavelength range) by the lower surface of the substrate 52*a*. The materials of the substrate 52*a*, the upper coating layer 52*b*, and the lower coating layer 52*c* may be the same as those of the substrate 51*a*, the upper coating layer 51*b*, and the lower coating layer 51*c* of the first transmission layer 51 described above. At least one of the upper coating layer 52*b* and the lower coating layer 52*c* may have a multilayer structure in which layers made of different materials are stacked.

In the present embodiment, the wavelength of the first transmission peak of the second transmission layer 52 is in the range of 2 μm to 3 μm, and the wavelength of the second transmission peak of the second transmission layer 52 is in the range of 5 μm to 8.5 μm, and the reflection wavelength range of the second transmission layer 52 is 3.5 μm to 4.5 μm as described above. For example, such filter characteristics can be obtained by using a multilayer film in which zinc sulfide and germanium are alternately stacked as the upper coating layer 52*b*, by using a multilayer film in which zinc sulfide and germanium are alternately stacked as the lower coating layer 52*c*, and by appropriately adjusting the thicknesses of the substrate 52*a*, the upper coating layer 52*b*, and the lower coating layer 52*c*. The infrared transmittance at each of the first transmission peak and the second transmission peak is preferably 80% or more, and more preferably 90% or more. The infrared reflectance in the reflection wavelength range is preferably 70% or more, more preferably 80% or more, and further preferably 90% or more. The infrared transmittance of the second transmission layer 52 in at least a part of the reflection wavelength range is preferably 10% or less, and more preferably 5% or less. The infrared transmittance of the second transmission layer 52 in the entire reflection wavelength range is preferably 10% or less, and more preferably 5% or less.

Although this it not a limitation, the infrared transmittance of the second transmission layer 52 in the wavelength range of 2 μm to 3 μm may be 40% or more. The infrared transmittance of the second transmission layer 52 in the wavelength range of 5 μm to 8.5 μm may be 80% or more. The infrared transmittance of the second transmission layer 52 in the wavelength range of 8.5 μm to 9.5 μm may be 70% or more. The infrared transmittance of the second transmission layer 52 in the wavelength range of 9.5 μm to 13 μm may be 60% or more.

As illustrated in FIG. 6, the partition member 58 includes a cooling case 60, the first fixing plate 71, and a second fixing plate 72. The first fixing plate 71 and the second fixing plate 72 are quadrangular frame-shaped members onto which the first transmission layer 51 and the second transmission layer 52 are respectively placed and fixed. The second fixing plate 72 is attached to an upper part of the furnace body 80. The cooling case 60 is disposed between the first transmission layer 51 and the second transmission layer 52. The cooling case 60 is a substantially rectangular parallelepiped box-shaped member whose upper and lower sides are open. The upper and lower openings of the cooling case 60 are closed by the first transmission layer 51, the first fixing plate 71, the second transmission layer 52, and the second fixing plate 72. Therefore, the second space 63 is surrounded by the front, back, left, and right walls of the cooling case 60; the first transmission layer 51; and the second transmission layer 52. The cooling case 60 has left and right coolant holes 61. The left coolant hole 61 is connected to a coolant supply source 95 (cooling unit), which is disposed in the outside space, through a pipe. The coolant supply source 95 supplies a coolant to the second space 63 through the left coolant hole 61. After passing through the second space 63, the coolant flows to the outside through the right coolant hole 61. The coolant supplied by the coolant supply source 95 is, for example, a gas, such as air or an inert gas. The coolant cools the filter unit 50 by coming into contact with and absorbing heat from the first transmission layer 51, the second transmission layer 52, and the partition member 58. In the present embodiment, the second space 63 is directly connected to the outside space through the right coolant hole 61. However, a pipe or the like may be connected to the right coolant hole 61, and the second space 63 need not be directly connected to the outside space.

In the present embodiment, the partition member 58 reflects infrared radiation emitted from the heating element 40. In the present embodiment, the partition member 58 is made of a metal (such as SUS or aluminum). The partition member 58 corresponds to a transmission-layer-side reflective member in the present invention. The inner surface of the cooling case 60, that is, the infrared reflective surface exposed to the second space 63, is substantially perpendicular to the lower surface of the heating element 40 and the upper surface of the second transmission layer 52. However, the shape of the cooling case 60 is not limited to such a shape. For example, the inner surface of the cooling case 60 may be inclined with respect to the vertical direction (for example, inclined in such a direction that the width of the second space 63 decreases toward the bottom of the second space 63).

A plurality of openings, as many as the infrared heaters 10, are formed in the upper surface (ceiling) of the furnace body 80. The plurality of infrared heaters 10 are attached to the upper part of the furnace body 80 so as to close the openings. Therefore, the lower surface of the second transmission layer 52 is exposed to the processing space 81. The processing space 81 and the first space 47 are separated from each other by the filter unit 50 and are not directly connected to each other. However, because both the processing space 81 and the first space 47 are connected to the outside space outside of the infrared processing device 100, they are connected to each other through the outside space. Likewise, because the processing space 81 and the second space 63 are separated from each other by the second transmission layer 52 and the second fixing plate 72, they are not directly connected to each other. However, because both processing space 81 and the second space 63 are connected to the outside space outside the infrared processing device 100, they are connected to each other through the outside space. Likewise, the first space 47 and the second space 63 are not directly connected to each other, although they are connected to each other through the outside space. The infrared heater 10 is disposed so as to protrude upward from the upper surface of the furnace body 80. Therefore, the heating element 40, the first space 47, and the filter unit 50 are disposed outside the furnace body 80.

In the infrared processing device 100 having the structure described above, when the heating element 40 is heated, infrared radiation is emitted mainly from the lower surface of the heating element 40 toward the filter unit 50 (the first transmission layer 51) below. The infrared, radiation is incident on the upper surface of the first transmission layer 51 substantially perpendicularly. A part of the infrared radiation that is emitted from the heating element 40 and that is in the reflection wavelength range passes through the first transmission layer 51, is reflected upward by the reflective section 55, and is absorbed by the heating element 40 (see solid-line arrows in FIG. 5). To be more specific, infrared radiation in the reflection wavelength range passed through the first transmission layer 51 and reached the second space 63 is reflected upward by a part of the partition member 58 exposed to the second space 63 (the inner surface of the partition member 58) and by the second transmission layer 52, and is absorbed by the heating element 40. Thus, the infrared radiation reflected by the filter unit 50 (mainly, the reflective section 55) is used to heat the heating element 40. Therefore, the amount of energy (electric power) that needs to be supplied from the outside to heat the heating element 40 to 700° C. can be reduced. In other words, the temperature of the heating element 40 can be increased easily. On the other hand, because the first transmission layer 51 transmits infrared radiation in the reflection wavelength range and the reflective section 55 (the second transmission layer 52 and the partition member 58) reflects infrared radiation in the reflection wavelength range, increase in the temperature of the filter unit 50 is suppressed, as compared with, for example, a case where the first transmission layer 51 and the reflective section 55 absorb infrared radiation in the reflection wavelength range. Because the first space 47 is open to the outside space, heat accumulation in the first space 47 is suppressed and increase in the temperature of the first transmission layer 51 is suppressed. Thus, in the infrared heater 10, the temperature of the heating element 40 can be easily increased, while the temperature of the filter unit 50 cannot be easily increased. As a result, the temperature difference between the heating element 40 and the filter unit 50 (in particular, the first transmission layer 51) can be easily increased.

A part of the infrared radiation that is emitted from the heating element 40 and that is outside the reflection wavelength range passes through the filter unit 50 (the first transmission layer 51 and the second transmission layer 52) and is emitted into the processing space 81 (see broken-line arrows in FIG. 5). Because the filter unit 50 (in particular, the second transmission layer 52) has the aforementioned filter characteristics, the infrared radiation emitted into the processing space 81 has two radiation peaks and includes substantially no infrared radiation in the reflection wavelength range (3.5 μm to 4.5 μm). Toluene has infrared absorption peaks at the wavelengths of, for example, 3.3 μm and 6.7 μm. Therefore, when the infrared heater 10 emits infrared radiation having radiation peaks near these two absorption peaks into the processing space 81, toluene can be efficiently evaporated from the coating 92. When the toluene evaporates, a protective silicone film can be formed on the surface of the semiconductor device 90. As described above, with the infrared heater 10 according to the present embodiment, infrared radiation in a wavelength range for efficiently performing infrared processing (drying of the coating 92) can be emitted toward the coating 92 through the filter unit 50. On the other hand, the infrared radiation in the reflection wavelength range, whose wavelength is away from the absorption peaks of toluene, is infrared radiation in an unwanted wavelength range and does not substantially contribute to evaporation of toluene. Therefore, with the infrared heater 10, the infrared radiation in the reflection wavelength range is reflected by the reflective section 55 as described above and is not emitted into the processing space 81, so that the infrared radiation in the reflection wavelength range is used to heat the heating element 40. Even when each of the first transmission layer 51 and the second transmission layer 52 has the same filter characteristics, the wavelength characteristics, such as the radiation peaks, of infrared radiation emitted into the processing space 81 vary in accordance with a change in the temperature of the heating element 40. Therefore, by changing the temperature of the heating element 40, the wavelengths of two radiation peaks of infrared radiation emitted into the processing space 81 can be adjusted to some extent. The temperature of the heating element 40 during use can be appropriately adjusted in accordance with an object so that, for example, the wavelength of the absorption peak of the object becomes as close as possible to the radiation peak of infrared radiation emitted into the processing space 81.

With the infrared processing device 100 according to the present embodiment described above, the transmission layers (the first transmission layer 51 and the second transmission layer 52) transmit infrared radiation from the heating element 40, the reflective section 55 has reflection characteristics of reflecting infrared radiation in the reflection wavelength range, and the heating element 40 can absorb infrared radiation in the reflection wavelength range. Therefore, the first transmission layer 51 transmits infrared radiation from the heating element 40 and the second transmission layer 52 transmits a part of and reflects a part of the infrared radiation from the heating element 40, so that the temperature of the transmission layers do not easily increase as compared with a case where the transmission layers absorb the infrared radiation. On the other hand, because the heating element 40 can absorb a part of the infrared radiation emitted by itself and use the infrared radiation to heat itself, the temperature of the heating element 40 can be easily increased. As a result, the temperature difference between the heating element 40 and the filter unit 50 (in particular, the first transmission layer 51, which is one of the transmission layers that is closest to the heating element 40 and whose temperature is easily increased) during use can be increased. Because the temperature difference between the heating element 40 and the filter unit 50 can be increased, for example, the temperature of the heating element 40 can be increased while maintaining the temperature of the first transmission layer 51 to be the heatproof temperature or less, and the energy of infrared radiation emitted to the object (the coating 92) can be increased. With the infrared processing device 100 according to the present invention, even when the temperature of the heating element 40 is the same, the temperature of the filter unit 50 can be maintained to be lower. Moreover, the distance D can be reduced while maintaining the temperature of the first transmission layer 51 to be the heatproof temperature or less. As a result, the distance between the heating element 40 and the coating 92 can be reduced. In the present embodiment, the outside space is an air atmosphere, and the first space 47 is open to the air atmosphere. Because the outside space is not a vacuum atmosphere and the first space 47 is open to the outside space, heat accumulation in the first space 47 is suppressed and an advantage of suppressing increase in the temperature of the first transmission layer 51 can be obtained.

The filter unit 50 includes, as transmission layers for transmitting at least a part of the infrared radiation from the heating element 40, the first transmission layer 51, and the second transmission layer 52 that is disposed so as to be separated by the second space 63 from the first transmission layer 51 on a side opposite to the heating element 40 when seen from the first transmission layer 51. The first transmission layer 51 transmits infrared radiation in the reflection wavelength range. The second transmission layer 52, which is a part of the reflective section 55, reflects infrared radiation in the reflection wavelength range and transmits at least part of the infrared radiation emitted from the heating element 40 and passed through the first transmission layer 51. Therefore, the second transmission layer 52 can reflect infrared radiation in the reflection wavelength range toward the heating element 40. As described above, the first transmission layer 51 transmits infrared radiation in the wavelength range including the reflection wavelength range. On the other hand, the second transmission layer 52 transmits infrared radiation in other wavelength range while reflecting infrared radiation in the reflection wavelength range. In general, an interference filter that can transmit infrared radiation in a wider wavelength range (has high infrared transmittance in a wider wavelength range) tends to have a lower infrared absorptance. For example, the first transmission layer 51, which is an interference filter that transmits infrared radiation in the entirety of the wavelength range of 2 μm to 8 μm, which includes the reflection wavelength range, tends to have a lower infrared absorptance than the second transmission layer 52, which is an interference filter that reflects a part of the infrared radiation in the wavelength range of 2 μm to 8 μm (the reflection wavelength range) (has a low transmittance in the reflection wavelength range). Therefore, for example, if the first transmission layer 51, as with the second transmission layer 52, has reflection characteristics of reflecting infrared radiation in the reflection wavelength range, the first transmission layer 51 is likely to have a higher infrared absorptance, and the temperature of the first transmission layer 51 may be easily increased. In the present embodiment, in which the filter unit 50 includes a plurality of transmission layers, the first transmission layer 51, which is closest to the heating element 40, is an interference filter that does not have reflection characteristics (that transmits infrared radiation in a wide wavelength range). Thus, increase in the temperature of the first transmission layer 51, which is closest to the heating element 40 and whose temperature tends to increase easily, is further suppressed. The second transmission layer 52 reflects infrared radiation in the reflection wavelength range to enable the temperature of the heating element 40 to be easily increased. Because the second transmission layer 52 is located farther than the first transmission layer 51 from the heating element 40, the temperature of the second transmission layer 52 is not increased easily.

The filter unit 50 includes the partition member 58, which partitions the second space 63 from the outside of the filter unit 50. The reflective section 55 includes the transmission-layer-side reflective member (the partition member 58), which reflects infrared radiation in the reflection wavelength range. Therefore, both the transmission-layer-side reflective member and the second transmission layer 52 can reflect infrared radiation in the reflection wavelength range that has reached the second space 63, so that the temperature of the heating element 40 can be more easily increased. In particular, in the present embodiment, all members exposed to the second space 63, except for the first transmission layer 51, are included in the reflective section 55. Therefore, infrared radiation in the reflection wavelength range in the second space 63 does not easily travel in directions other than the direction toward the first transmission layer 51 (upward) and travels easily toward the heating element 40. Because the transmission-layer-side reflective member is the partition member 58, increase in the number of components of the infrared processing device 100 can be suppressed, as compared with case where a component independent from the partition member 58 is used as the transmission-layer-side reflective member.

In the infrared heater 10, the second space 63 is a coolant channel that allows a coolant to flow therethrough. Therefore, the coolant can suppress increase in the temperature of the filter unit 50, so that the temperature difference between the heating element 40 and the filter unit 50 during use can be further increased. By maintaining the temperature of the filter unit 50 to be low, increase in the temperatures of the furnace body 80 and the processing space 81 can be also suppressed.

In the infrared heater 10, the closest transmission layer (the first transmission layer 51), which is one of the one or more transmission layers of the filter unit 50 that is closest to the heating element 40, has a surface (upper surface) that faces the heating element 40 and that is exposed to the first space 47. The infrared heater 10 satisfies $0.06 \leq D/L \leq 0.23$. As the ratio D/L decreases, heat transfer from the heating element 40 to the closest transmission layer (the first transmission layer 51) becomes increasingly and inevitably dependent on heat transfer through an atmosphere in the first space 47. As a result, heat accumulation in the first space 47 increases, and the temperature of the closest transmission layer (the first transmission layer 51) may be easily increased. By making the ratio D/L be 0.06 or more, excessive increase in the conductive heat flux can be prevented, the amount of heat transfer between the heating element 40 and the filter unit 50 during use can be reduced, and increase in the temperature of the filter unit 50 (in particular, the first transmission layer 51) can be sufficiently suppressed. As the ratio D/L increases, heat transfer in the first space 47 becomes increasingly dependent on convection. If the ratio D/L becomes excessively high, convective loss in the first space 47 increases, and the temperature of the heating element 40 may be easily reduced. In this case, by making the ratio D/L be 0.23 or less, increase in the convective heat transfer coefficient can be prevented, and decrease in the temperature of the heating element 40 due to convective loss can be sufficiently suppressed. Thus, by making the ratio D/L be in the range of $0.06 \leq D/L \leq 0.23$, the temperature difference between the heating element 40 and the filter unit 50 (in particular, the first transmission layer 51) can be further increased, while suppressing decrease in the temperature of the heating element 40 during use. Consequently, a larger amount of the energy of infrared radiation from the heating element 40 is transmitted by the filter unit 50, emitted toward an object (the coating 92), and infrared processing of the coating 92 can be efficiently performed.

The infrared heater 10 is disposed on a side opposite to the first transmission layer 51 when seen from the heating element 40, and the infrared heater 10 includes the heating-element-side reflective member 23, which reflects infrared radiation in the reflection wavelength range. Therefore, the heating-element-side reflective member 23 reflects, toward the first transmission layer 51 (downward), infrared radiation emitted in a direction opposite to the first transmission layer 51 (upward) when seen from the heating element 40, and thereby the heating element 40 can be heated by the infrared radiation reflected by the heating-element-side reflective member 23. Therefore, the temperature difference between the heating element 40 and the filter unit 50 during use can be further increased.

The heating element 40 is a planar heating element that can emit infrared radiation toward the first transmission layer 51 and that has a flat surface that can absorb infrared radiation in the reflection wavelength range. Therefore, the heating element 40 can easily absorb infrared radiation reflected by the reflective section 55 as compared with a case where, for example, the heating element 40 is a linear heating element, and the temperature of the heating element 40 can be easily increased. Accordingly, the temperature difference between the heating element 40 and the filter unit 50 during use can be further increased.

The infrared processing device 100 includes the infrared heater 10 and the furnace body 80. The furnace body 80 forms the processing space 81, which is not directly connected to the first space 47 and in which the infrared processing is performed by using infrared radiation emitted from the heating element 40 and passed through the filter unit 50.

The heating element 40 and the first space 47 are located outside the furnace body 80. Because the first space 47 is located outside the furnace body 80, increase in the temperature of the first transmission layer 51 can be further suppressed, so that the temperature difference between the heating element 40 and the filter unit 50 during use can be further increased. Because the second space 63 is also located outside the furnace body 80, increase in the temperature of the filter unit 50 can be further suppressed. Thus, the temperature difference between the heating element 40 and the filter unit 50 during use can be further increased.

Third Embodiment

Figure 9:
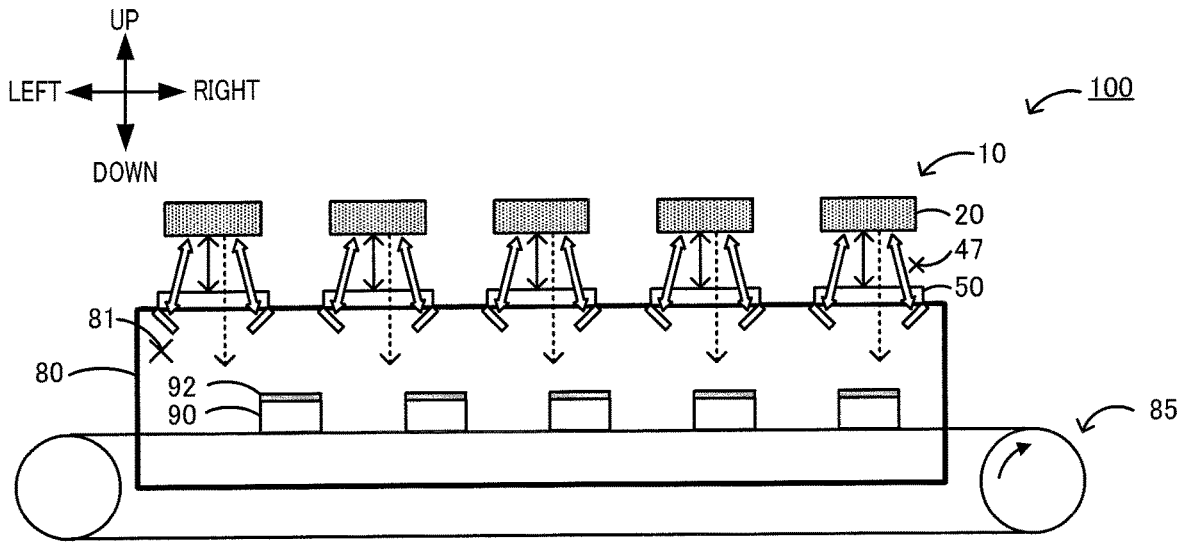
FIG. 9 is a longitudinal sectional view of an infrared processing device 100 according to a third embodiment.
Figure 10:
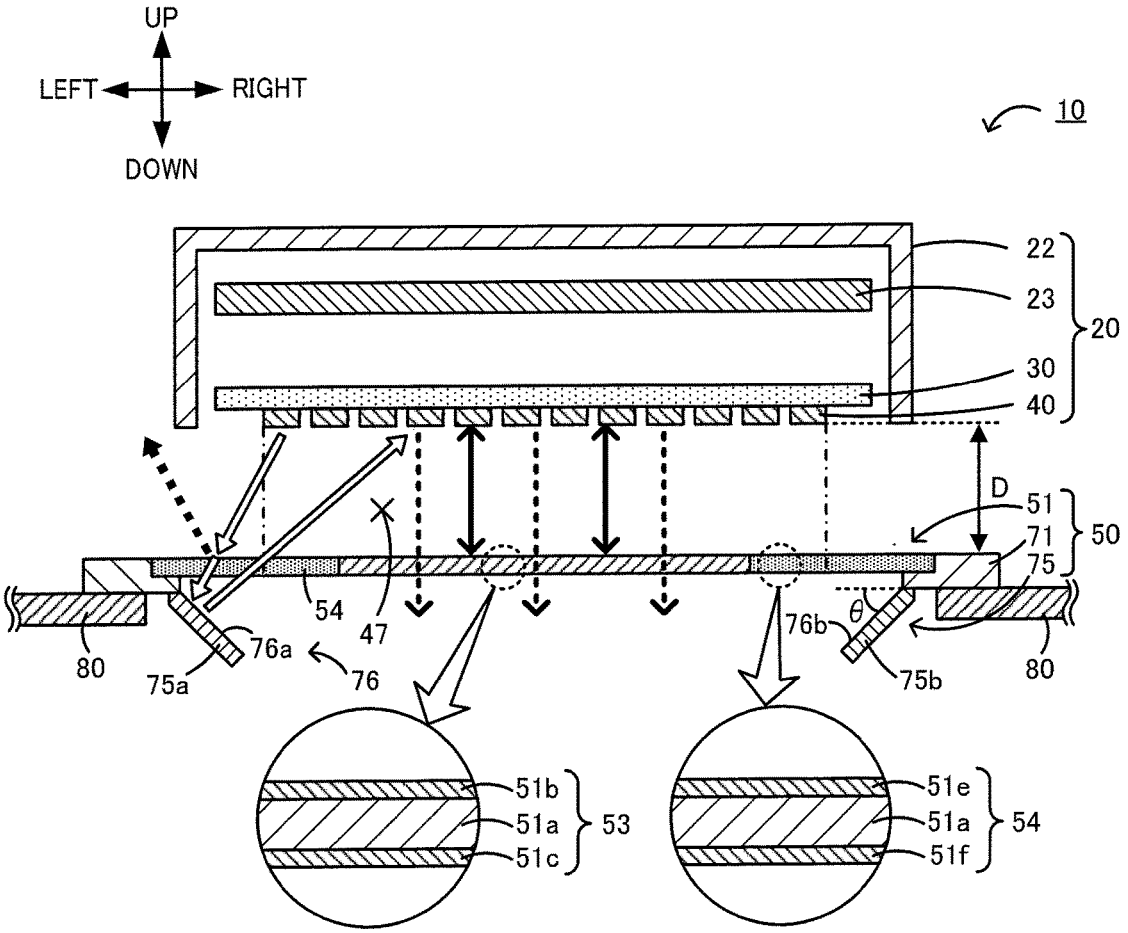
FIG. 10 is an enlarged sectional view of an infrared heater 10 according to the third embodiment.
Figure 11:
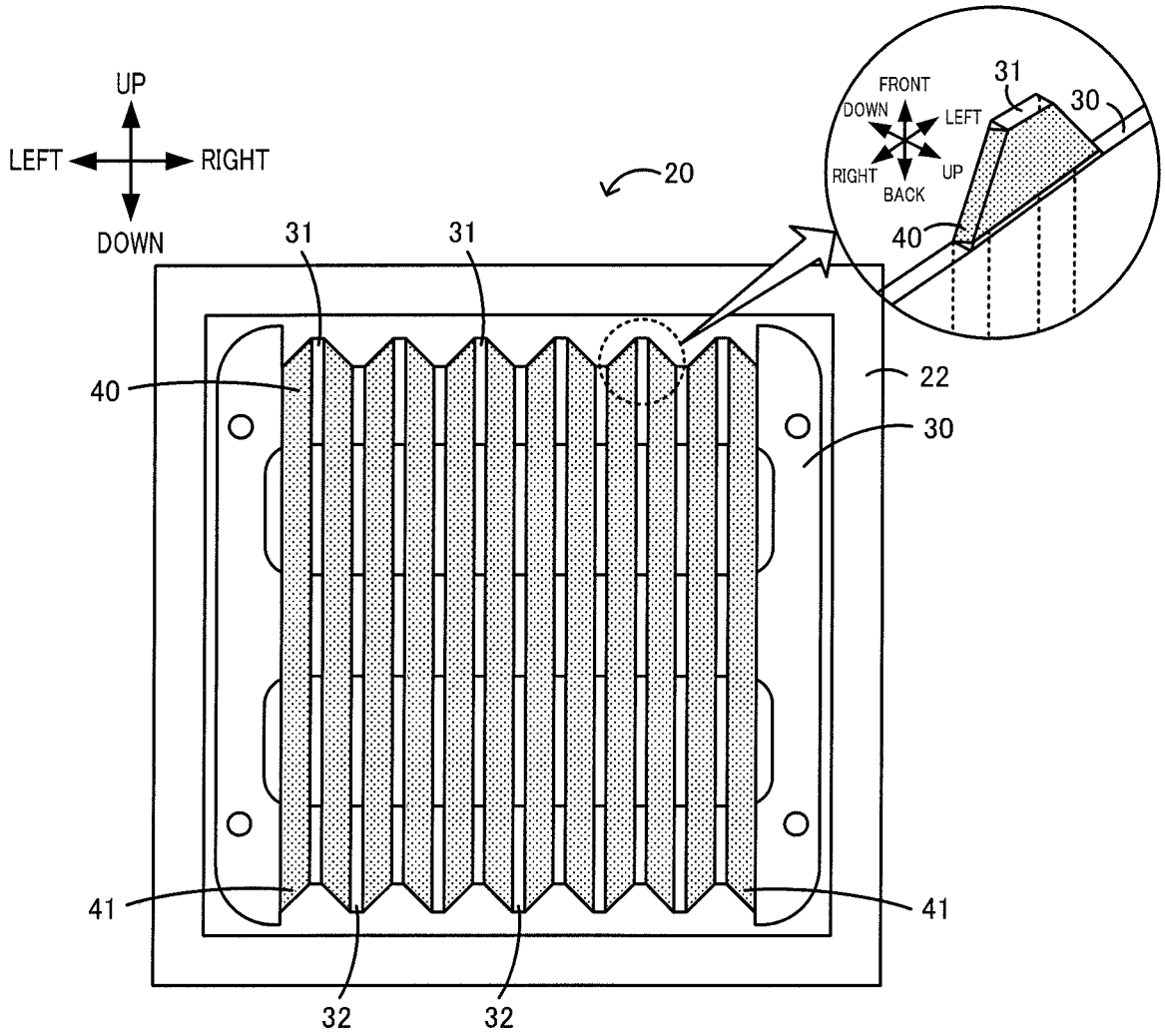
FIG. 11 is a bottom view of a heat generating unit 20 according to the third embodiment.
Figure 12:
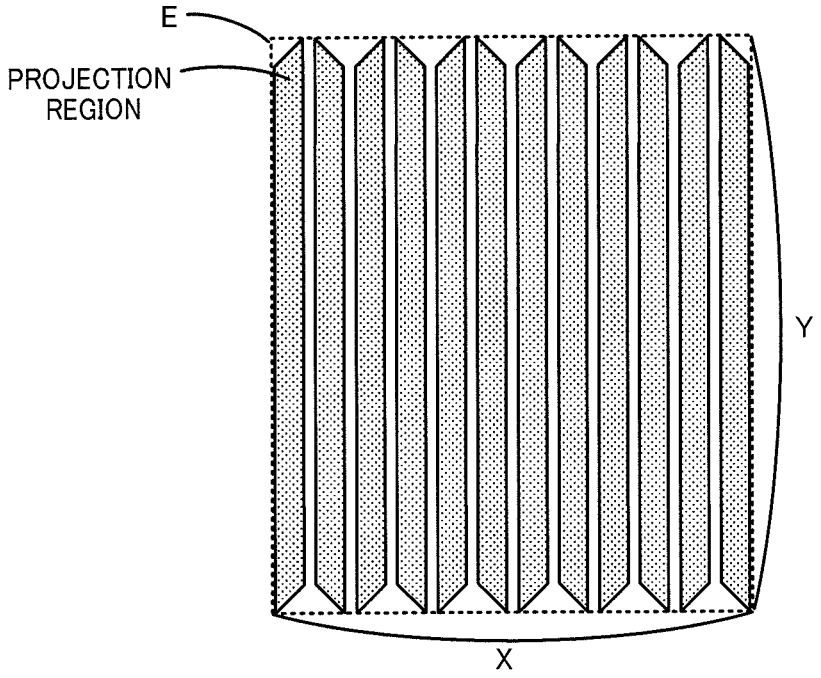
FIG. 12 illustrates the relationship between a projection region and a heating element area S according to the third embodiment.
Figure 13:
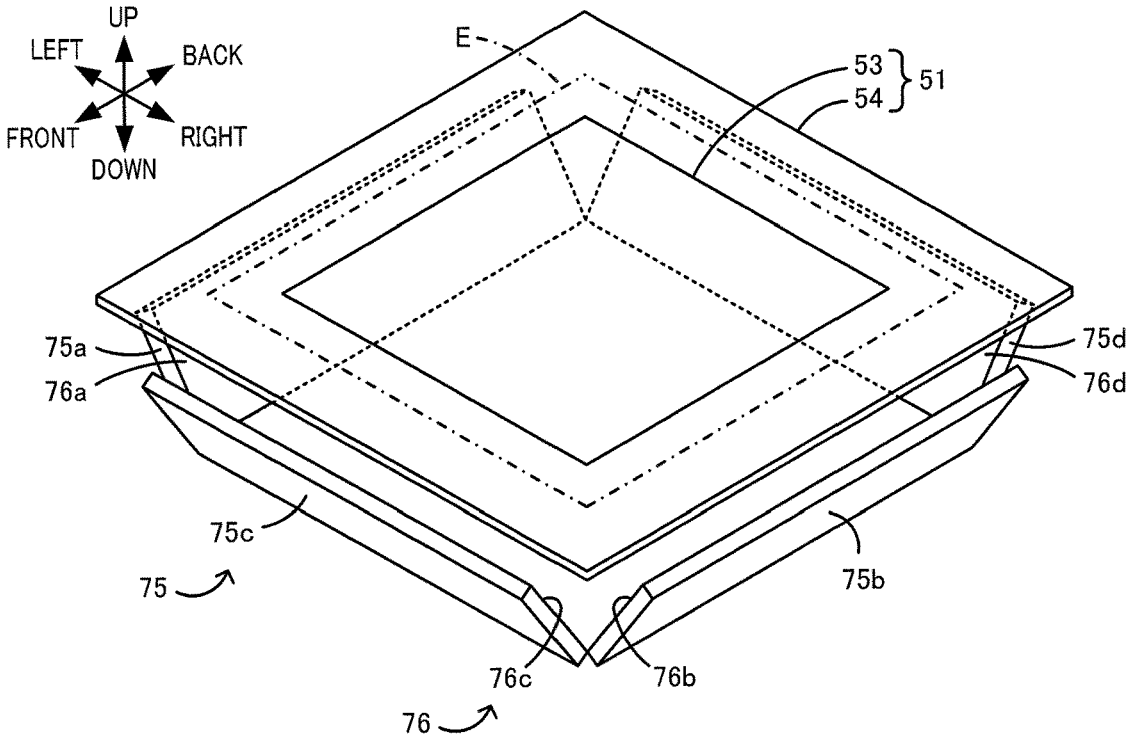
FIG. 13 is a perspective view schematically illustrating the positional relationship between a first transmission layer 51 and a transmission-layer-side reflective member 75 according to the third embodiment.
Figure 14:
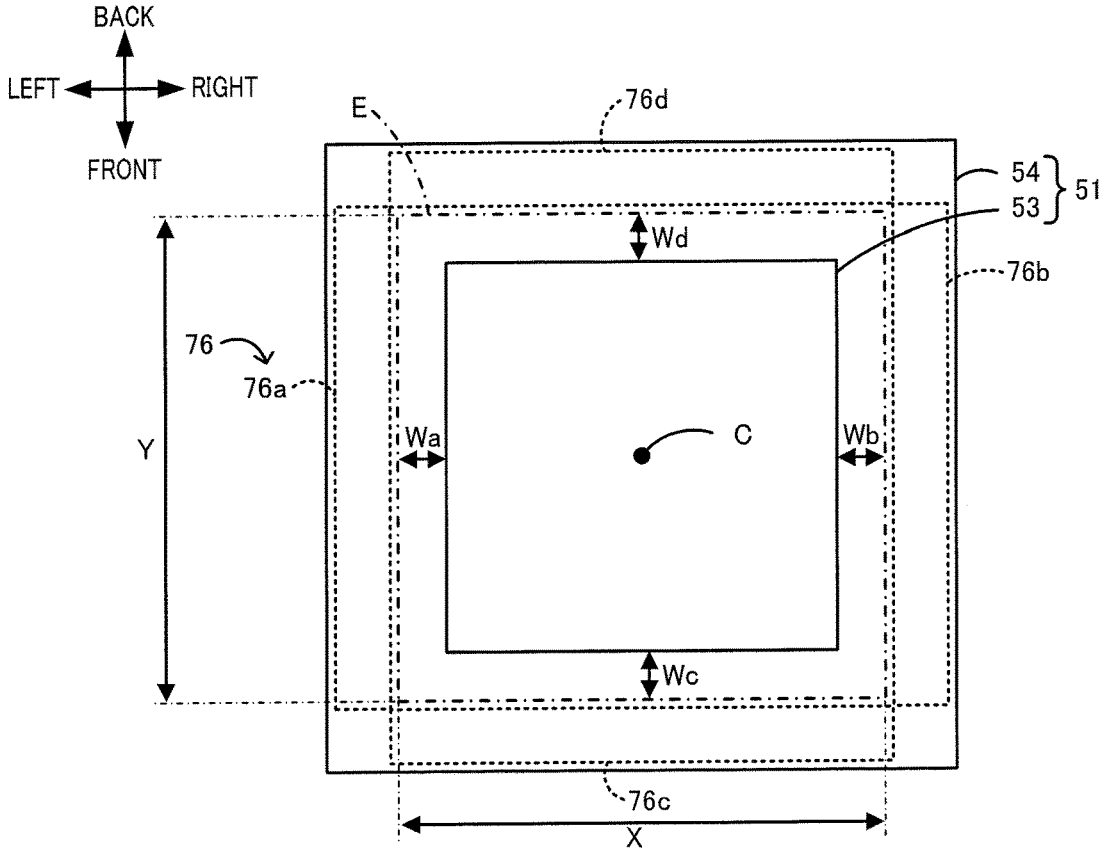
FIG. 14 is a top view illustrating the position of a reflective surface 76 projected onto the first transmission layer 51 according to the third embodiment.

Next, a third embodiment of the present invention will be described with reference to the drawings. FIG. 9 is a longitudinal sectional view of an infrared processing device 100 including a plurality of infrared heaters 10. FIG. 10 is an enlarged sectional view of one of the infrared heaters 10. FIG. 11 is a bottom view of a heat generating unit 20. FIG. 12 illustrates the relationship between a projection region of the heating element 40 and a heating element area S. FIG. 13 is a perspective view schematically illustrating the positional relationship between a first transmission layer 51 (corresponding to one or more transmission layers in the present invention) and a transmission-layer-side reflective member 75. FIG. 14 is a top view illustrating the position of a reflective surface 76 projected onto the first transmission layer 51. In the present embodiment, the up-down direction, the left-right direction, and the front-back direction are as shown in FIGS. 9 to 11, 13, and 14. Descriptions of elements of the third embodiment that are the same as those of the first embodiment will be omitted as appropriate.

The infrared heater 10 preferably satisfies $0.06 \leq D/L \leq 0.23$, and more preferably $0.12 \leq D/L \leq 0.2$, where a distance D [cm] is the distance between the heating element 40 and the first transmission layer 51, which is one of one or more transmission layers of the filter unit 50 that is closest to the heating element (see FIG. 10); a heating element area S [$cm^2$] is the area of a heating element region E, which is a smallest quadrangular or circular region that surrounds an entirety of a projection region that is formed by projecting the heating element 40 onto the first transmission layer 51 in a direction perpendicular to the first transmission layer 51 (where $0\ cm^2 < S \leq 400\ cm^2$), and a representative dimension L [cm]$=2\times\sqrt{(S/\pi)}$. In the present embodiment, the first transmission layer 51 is a flat plate-shaped member, and the heating element 40 and the first transmission layer 51 are disposed parallel to each other. Therefore, the projection region is the same as a region of the lower surface of the heating element 40 (a region having the shape of the heating element 40 in FIG. 11) when the heating element 40 is seen from below (in a direction perpendicular to the lower surface of the heating element 40 and the upper surface of the first transmission layer 51). The smallest quadrangular region that surrounds the projection region is a rectangular heating element region E shown in FIG. 12. The heating element area S is the area of the rectangular heating element region E, that is, the product of the length of X of the rectangular heating element region E in the left-right direction (=the length from the left end to the right end of the heating element 40) and the length of Y of the rectangular heating element region E in the front-back direction (=the length of the heating element 40 in the front-back direction). Thus, the heating element area S is defined as the area of a region including portions in which the heating element 40 is not present, such as gaps between parts of the heating element 40 in the left-right direction. The representative dimension L is equal to the diameter of a circle whose area is the same as the heating element area S. In the present embodiment, the heating element region E is quadrangular. However, if, for example, the shape of the heating element 40 is similar to a circle and the heating element area S becomes smaller when the projection region of the heating element 40 is surrounded by a circular region, the smallest circular region that surrounds the projection region is defined as the heating element region E, and the heating element area S is defined as the area of the heating element region E. That is, the heating element region E (the smallest quadrangular or circular region that surrounds the entirety of the projection region) is defined as a smaller one of the smallest quadrangular region that surrounds the entirety of the projection region and the smallest circular region that surrounds the entirety of the projection region. Preferably, (the area of the projection region)/(the heating element area S)≥0.5 so that the effect of satisfying $0.06 \leq D/L \leq 0.23$ can be more reliably obtained. That is, preferably, the ratio of the area of the region in which the heating element 40 (projection region) is present to the area of the heating element region E in FIG. 12 is 50% or more. The heating element area S may be in the range of $1\ cm^2 < S \leq 400\ cm^2$. Although this it not a limitation, the distance D may be in the range of 8 mm to 30 mm.

The filter unit 50 includes, as a transmission layer for transmitting at least a part of the infrared radiation from the heating element 40, the first transmission layer 51. The filter unit 50 further includes a first fixing plate 71, which is a quadrangular frame-shaped member onto which the first transmission layer 51 is placed and fixed; and the transmission-layer-side reflective member 75 (including first to fourth transmission-layer-side reflective member 75*a* to 75*d*), which is disposed on a side opposite to the heating element 40 when seen from the first transmission layer 51 (below the first transmission layer 51). The first fixing plate 71 is attached to an upper part of the furnace body 80.

As illustrated in FIGS. 13 and 14, the first transmission layer 51 is a plate-shaped member that is quadrangular in a top view. The first transmission layer 51 includes a selective reflection region 53 that is quadrangular in a top view, and a transmission region 54 that is frame-shaped in a top view and that is located so as to surround the selective reflection region 53. The selective reflection region 53 has reflection characteristics of reflecting infrared radiation in a predetermined reflection wavelength range, and also has characteristics of transmitting at least a part of the infrared radiation from the heating element 40. In the present embodiment, the selective reflection region 53 has a first transmission peak of infrared transmittance; a second transmission peak of infrared transmittance, whose wavelength is longer than that of the first transmission peak; and a reflection wavelength range between the wavelength of the first transmission peak and the wavelength of the second transmission peak. In the present embodiment, the selective reflection region 53 is structured as an interference filter (optical filter). As illustrated in FIG. 10, the selective reflection region 53 includes a substrate 51*a*, an upper coating layer 51*b* that covers the upper surface of the substrate 51*a*, and a lower coating layer 51*c* that covers the lower surface of the substrate 51*a*. The upper coating layer 51*b*, which functions as a bandpass layer, transmits downward a part of the light that is emitted from above the selective reflection region 53 and that has the wavelengths of the first and second transmission peaks or is in wavelength ranges around the wavelengths of the first and second transmission peaks. The upper coating layer 51*b* reflects infrared radiation in the reflection wavelength range upward. The lower coating layer 51*c*, which functions as an anti-reflection layer, suppresses upward reflection of infrared radiation (in particular, infrared radiation outside the reflection wavelength range) by the lower surface of the substrate 51*a*. Examples of the material of the substrate 51*a* include silicon. Examples of the material of the upper coating layer 51*b* include zinc selenide, germanium, and zinc sulfide. Examples of the material of the lower coating layer 51*c* include germanium, silicon monoxide, and zinc sulfide. At least one of the upper coating layer 51*b* and the lower coating layer 51*c* may have a multilayer structure in which layers made of different materials are stacked.

In the present embodiment, the wavelength of the first transmission peak of the selective reflection region 53 is in the range of 2 μm to 3 μm, and the wavelength of the second transmission peak of the selective reflection region 53 is in the range of 5 μm to 8.5 μm, and the reflection wavelength range of the selective reflection region 53 is 3.5 μm to 4.5 μm. For example, such filter characteristics can be obtained by using a multilayer film in which zinc sulfide and germanium are alternately stacked as the upper coating layer 51*b*, by using a multilayer film in which zinc sulfide and germanium are alternately stacked as the lower coating layer 51*c*, and by appropriately adjusting the thicknesses of the substrate 51*a*, the upper coating layer 51*b*, and the lower coating layer 51*c*. The infrared transmittance at each of the first transmission peak and the second transmission peak is preferably 80% or more, and more preferably 90% or more. The infrared reflectance in the reflection wavelength range is preferably 70% or more, more preferably 80% or more, and further preferably 90% or more. The infrared transmittance of the selective reflection region 53 in at least a part of the reflection wavelength range is preferably 10% or less, and more preferably 5% or less. The infrared transmittance of the selective reflection region 53 in the entire reflection wavelength range is preferably 10% or less, and more preferably 5% or less.

Although this it not a limitation, the infrared transmittance of the selective reflection region 53 in the wavelength range of 2 μm to 3 μm may be 40% or more. The infrared transmittance of the selective reflection region 53 in the wavelength range of 5 μm to 8.5 μm may be 80% or more. The infrared transmittance of the selective reflection region 53 in the wavelength range of 8.5 μm to 9.5 μm may be 70% or more. The infrared transmittance of the selective reflection region 53 in the wavelength range of 9.5 μm to 13 μm may be 60% or more.

The transmission region 54 has characteristics of transmitting infrared radiation in at least the reflection wavelength range (in the present embodiment, 3.5 μm to 4.5 μm). In the present embodiment, the transmission region 54 has the same structure as the selective reflection region 53 in that, as illustrated in FIG. 10, the transmission region 54 includes the substrate 51*a*, which is common to that of the selective reflection region 53; an upper coating layer 51*e* that covers the upper surface of the substrate 51*a*; and a lower coating layer 51*f* that covers the lower surface of the substrate 51*a*. In the present embodiment, the infrared transmittance of the transmission region 54 in the wavelength range of 2 μm to 8 μm, including the reflection wavelength range, is 90% or more. The materials of the upper coating layer 51*e* and the lower coating layer 51*f* may be, for example, the same as those of the upper coating layer 51*b* and the lower coating layer 51*c* described above. For example, the transmission region 54 having such characteristics can be obtained by forming each of the upper coating layer 51*e* and the lower coating layer 51*f* so as to have a multilayer structure in which different materials are stacked and making the number of the stacked materials of the upper coating layer 51*e* and the lower coating layer 51*f* be smaller than those of the upper coating layer 51*b* and the lower coating layer 51*c*, and by appropriately adjusting the thicknesses of the upper coating layer 51*e* and the lower coating layer 51*f*. The infrared transmittance of the transmission region 54 in at least a part of the reflection wavelength range is preferably 70% or more, more preferably 80% or more, and further preferably 90% or more. The infrared transmittance of the transmission region 54 in the entire reflection wavelength range is preferably 70% or more, more preferably 80% or more, and further preferably 90% or more.

The first transmission layer 51, including the selective reflection region 53 and the transmission region 54, can be integrally formed by, for example, forming the upper coating layers 51*b* and 51*e* and the lower coating layers 51*c* and 51*f* by vapor disposition of the aforementioned materials using, as necessary, a mask on the substrate 51*a*. However, it is not necessary to integrally form the selective reflection region 53 and the transmission region 54 to obtain the first transmission layer 51.

As illustrated in FIG. 13, the transmission-layer-side reflective member 75 includes first to fourth transmission-layer-side reflective members 75*a* to 75*d*. The first and second transmission-layer-side reflective members 75*a* and 75*b* are respectively disposed on the lower left side and the lower right side of the first transmission layer 51 so that the longitudinal directions thereof coincide with the front-back direction. The third and fourth transmission-layer-side reflective members 75*c* and 75*d* are respectively disposed on the lower front side and the lower back side of the first transmission layer 51 so that the longitudinal directions thereof coincide with the left-right direction. The first to fourth transmission-layer-side reflective members 75*a* to 75*d* are attached to the lower side of the first fixing plate 71. The first to fourth transmission-layer-side reflective member 75*a* to 75*d* respectively have flat reflective surfaces 76*a* to 76*d*, which face the heating element 40. The reflective surfaces 76*a* to 76*d* will be collectively referred to as the reflective surface 76. The reflective surface 76 reflects, toward the heating element 40, infrared radiation at least in the reflection wavelength range emitted from the heating element 40 and passed through the transmission region 54. Each of the reflective surfaces 76*a* to 76*d* is inclined at an angle θ with respect to a surface (upper surface) of the transmission region 54 of the first transmission layer 51 facing the heating element 40, that is, a horizontal plane so as to face the center of the heating element 40 in the front-back and left-right direction. The angle θ is larger than 0° and smaller than 90°. The angle θ may be appropriately determined in this range so that the reflective surface 76 can efficiently reflect infrared radiation toward the heating element 40 in accordance with the size of the heating element 40, the distance D, and the distance and the positional relationship between the heating element 40 and the reflective surface 76. If the angle θ is too large, the amount of infrared radiation reflected from the reflective surface 76 into the processing space 81 tends to become too large. If the angle θ is too small, the amount of infrared radiation that is reflected from the reflective surface 76 not toward the heating element 40 but toward the outside space tends to become too large. Therefore, the angle θ may be 30° or more and 60° or less. In the present embodiment, the angle θ is 45°. In the present embodiment, the transmission-layer-side reflective member 75 is made of a metal (such as SUS or aluminum). The infrared transmittance of the reflective surface 76 in the entirety of the reflection wavelength range is preferably 70% or more, more preferably 80% or more, and further preferably 90% or more. The transmission-layer-side reflective member 75 may reflect infrared radiation outside the reflection wavelength range. For example, the infrared reflectance of the transmission-layer-side reflective member 75 in the wavelength range of 2 μm to 8 μm, which is transmitted by the transmission region 54, may be 70% or more, 80% or more, or 90% or more.

Referring to FIG. 14, the positional relationship among the selective reflection region 53, the transmission region 54, the heating element region E, and the reflective surface 76 perpendicularly projected onto a surface (upper surface) of the first transmission layer 51 facing the heating element 40 will be described. In FIG. 14, the heating element region E is represented by an alternate long and short dash line, and the reflective surface 76 projected onto the first transmission layer 51 is represented by a broken line. In the present embodiment, the centers of the selective reflection region 53, the transmission region 54, and the heating element region E in the front-back and left-right directions substantially coincide with each other (the center C). As shown in FIG. 14, the selective reflection region 53 is disposed closer than the transmission region 54 to the center of the heating element 40, that is, to the center C. The selective reflection region 53 includes the center C of the heating element region E in the front-back and left-right directions. The transmission region 54 is disposed farther than the selective reflection region 53 from the center of the heating element, that is, from the center C. The transmission region 54 includes ends of the heating element region E in the front-back and left-right directions and includes the entirety of a part of the heating element region E that does not overlap the selective reflection region 53. The transmission region 54 also includes a region outside of the heating element region E. That is, a part of the transmission region 54 extends beyond the ends of the heating element 40 in the front-back and left-right directions (see also FIG. 10). The reflective surfaces 76*a*, 76*b*, 76*c*, and 76*d* are respectively disposed on the left, right, front, and back sides of the heating element region E. The reflective surfaces 76*a* to 76*d* are located so as not to overlap the heating element region E and the selective reflection region 53. That is, the reflective surface 76 (and the transmission-layer-side reflective member 75) is disposed so as not be located directly below the heating element 40 or directly below the selective reflection region 53. The reflective surfaces 76*a* to 76*d* are each located so as to be included in the transmission region 54 (so as not to extend beyond the transmission region 54).

In FIG. 14, Wa to Wd denote the widths of the overlapping portions of the transmission region 54 and the heating element region E (the size of the overlapping portions in the directions from the center C of the heating element region E outward along the upper surface of the first transmission layer 51). As the widths Wa to Wd become smaller, the selective reflection region 53 becomes larger, and the energy of infrared radiation emitted toward the coating 92 tends to increase. As the widths Wa to Wd become larger, the energy of infrared radiation reflected from the reflective surface 76 toward the heating element 40 tends to increase. Therefore, preferably, the widths Wa to Wd are determined in consideration of both of these tendencies. To be specific, preferably, each of the widths Wa and Wb is in the range of 10 to 20% of the length X of the heating element region E in the left-right direction. Preferably, each of the widths We and Wd is in the range of 10 to 20% of the length Y of the heating element region E in the front-back direction. The widths Wa to Wd may be in the range of 10 to 20% of the aforementioned representative dimension L. The widths Wa to Wd may be in the range of 90% to 110% of the aforementioned distance D. The widths Wa to Wd may be 10 mm or more and 30 mm or less. The area of the overlapping portions of the transmission region 54 and the heating element region E is preferably, for example, in the range of 30% to 65% of the heating element region E (heating element area S).

A plurality of openings, as many as the infrared heaters 10, are formed in the upper surface (ceiling) of the furnace body 80. The plurality of infrared heaters 10 are attached to the upper part of the furnace body 80 so as to close the openings. Therefore, the lower surface of the first transmission layer 51 and the transmission-layer-side reflective member 75 are exposed to the processing space 81. The processing space 81 and the first space 47 are separated from each other by the first transmission layer 51 and the first fixing plate 71 and are not directly connected to each other. However, because both the processing space 81 and the first space 47 are connected to the outside space outside the infrared processing device 100, they are connected to each other through the outside space. Each of the infrared heaters 10 is disposed so as to protrude upward from the upper surface of the furnace body 80. Therefore, the heating element 40 and the first space 47 are disposed outside the furnace body 80.

In the infrared processing device 100 having the structure described above, when the heating element 40 is heated, infrared radiation is emitted mainly from the lower surface of the heating element 40 toward the filter unit 50 (the first transmission layer 51) below. A part of the infrared radiation in the reflection wavelength range emitted from the heating element 40 toward the selective reflection region 53 is reflected upward by the selective reflection region 53, and is absorbed by the heating element 40 (see solid-line arrows in FIGS. 9 and 10). A part of the infrared radiation emitted from the heating element 40 toward the transmission region 54 passes through the transmission region 54, passes through the reflective surface 76, and is absorbed by the heating element 40 (see blank arrows in FIGS. 9 and 10). Therefore, because the heating element 40 absorbs the reflected infrared radiation, the temperature of the heating element 40 can be easily increased, and the amount of energy (electric power) needed to be supplied from the outside to heat the heating element 40 to 700° C. can be reduced. Accordingly, the energy efficiency in emitting infrared radiation from the infrared heater 10 is improved. If, for example, the first transmission layer 51 does not include the transmission region 54 and the entire surface of the first transmission layer 51 is the selective reflection region 53, infrared radiation in the reflection wavelength range may be emitted toward the outside space without being reflected toward the heating element 40 (see a thick broken line in FIG. 10). In particular, such a phenomenon tends to occur at a part of the first transmission layer 51 away from the center of the heating element 40. The energy of the infrared radiation emitted to the outer surface cannot be used. In contrast, in the infrared heater 10 according to the present embodiment, the transmission region 54 is disposed farther than the selective reflection region 53 from the center of the heating element 40. Moreover, the transmission-layer-side reflective member 75, which has the inclined reflective surface 76, is disposed on a side opposite to the heating element 40 when seen from the first transmission layer 51.

Therefore, infrared radiation in the reflection wavelength range emitted toward a part of the first transmission layer 51 away from the center of the heating element 40 can be reflected by the inclined reflective surface 76 toward the heating element 40. As a result, emission of infrared radiation in the reflection wavelength range to the outside space can be suppressed, and the temperature of the heating element 40 can be easily increased, and thereby the energy efficiency in emitting infrared radiation is improved. With the present embodiment, not only infrared radiation in the reflection wavelength range but also infrared radiation in the wavelength range of 2 μm to 8 μm can be transmitted d by the transmission region 54, reflected by the reflective surface 76, and absorbed by the heating element 40. Therefore, the energy of infrared radiation in the wavelength range of 2 μm to 8 μm emitted from the heating element 40 toward the transmission region 54 can be used to increase the temperature of the heating element 40.

The first transmission layer 51 reflects infrared radiation in the reflection wavelength range from the selective reflection region 53 and transmits infrared radiation in the reflection wavelength range through the transmission region 54. Therefore, for example, as compared with a case where the first transmission layer 51 absorbs infrared radiation in the reflection wavelength range, the temperature of the first transmission layer 51 does not increase easily. On the other hand, the temperature of the heating element 40 increases easily as described above. Moreover, because the first space 47 between the heating element 40 and the first transmission layer 51 is open to the outside space, heat accumulation in the first space 47 is suppressed and increase in the temperature of the first transmission layer 51 is suppressed. Accordingly, the infrared heater 10 is structured so that the temperature of the heating element 40 can be easily increased while the temperature of the first transmission layer 51 does not increase easily. Therefore, in the infrared heater 10, the temperature difference between the heating element 40 and the first transmission layer 51 during use can be easily increased. In order to suppress emission of infrared radiation in the reflection wavelength range to the outside space, which is described above, a reflection member may be disposed between the first transmission layer 51 and the heating element 40. In this case, however, the reflection member may impair the aforementioned effect of suppressing increase in the temperature of the first transmission layer 51 (effect of suppressing heat accumulation), which is obtained because the first space 47 is open to the outside space. In contrast, with the infrared heater 10 according to the present embodiment, because the transmission-layer-side reflective member 75 is disposed on a side opposite tot the heating element 40, the transmission-layer-side reflective member 75 does not prevent the first space 47 from being open to the outside space. Accordingly, the energy efficiency in emitting infrared radiation can be further improved, while allowing increase in the temperature difference between the heating element 40 and the first transmission layer 51 during use.

A part of the infrared radiation that is emitted from the heating element 40 toward the selective reflection region 53 and that is outside the reflection wavelength range passes through the selective reflection region 53 (see thin broken-line arrows in FIGS. 9 and 10), and is emitted into the processing space 81. Because the filter unit 50 (the first transmission layer 51) has the aforementioned filter characteristics, the infrared radiation emitted into the processing space 81 has two radiation peaks and includes substantially no infrared radiation in the reflection wavelength range (3.5 μm to 4.5 μm). Toluene has infrared absorption peaks at a wavelength of, for example, 3.3 μm or 6.7 μm. Therefore, when the infrared heater 10 emits infrared radiation having radiation peaks near these two absorption peaks into the processing space 81, toluene can be efficiently evaporated from the coating 92. When the toluene evaporates, a protective silicone film can be formed on the surface of the semiconductor device 90.

Thus, with the infrared heater 10 according to the present embodiment, infrared radiation in the wavelength range for efficiently performing infrared processing (drying of the coating 92) can pass through the filter unit 50 (the selective reflection region 53) and can be emitted toward the coating 92. On the other hand, the infrared radiation in the reflection wavelength range, whose wavelength is away from the absorption peaks of toluene, is infrared radiation in an unwanted wavelength range and does not substantially contribute to evaporation of toluene. Therefore, with the infrared heater 10, the infrared radiation in the reflection wavelength range, which does not considerably contribute to infrared processing, is reflected toward the heating element 40 and is not emitted into the processing space 81, so that the infrared radiation in the reflection wavelength range is used to heat the heating element 40. Even when the selective reflection region 53 has the same filter characteristics, the wavelength characteristics, such as the radiation peaks, of infrared radiation emitted into the processing space 81 vary in accordance with a change in the temperature of the heating element 40. Therefore, by changing the temperature of the heating element 40 during use, the wavelengths of two radiation peaks of infrared radiation emitted into the processing space 81 can be adjusted to some extent. The temperature of the heating element 40 during use can be appropriately adjusted in accordance with an object so that, for example, the wavelength of the absorption peak of the object becomes as close as possible to the radiation peak of infrared radiation emitted into the processing space 81.

The infrared heater 10 according to the present embodiment described above includes the heating element 40, which emits infrared radiation when heated and which is capable of absorbing infrared radiation in a predetermined reflection wavelength range; and the filter unit 50, which is disposed so as to be separated by the first space 47 from the heating element 40, the first space 47 being open to the outside space. The filter unit 50 includes one or more transmission layers (the first transmission layer 51) that transmit at least a part of the infrared radiation from the heating element 40, and a reflective section (the first transmission layer 51 and the transmission-layer-side reflective member 75) that reflects infrared radiation in the reflection wavelength range toward the heating element 40. With the infrared heater 10, infrared radiation is emitted when the heating element 40 is heated, the infrared radiation passes through the filter unit 50 including one or more transmission layers (the first transmission layer 51), and the infrared radiation is emitted toward, for example, an object (the coating 92). The reflective section (the first transmission layer 51 and the transmission-layer-side reflective member 75) has reflection characteristics of reflecting infrared radiation in the predetermined reflection wavelength range. The heating element 40 can absorb infrared radiation in the reflection wavelength range. Therefore, because the transmission layer (the first transmission layer 51) transmits infrared radiation from the heating element 40, the temperature of the transmission layer does not easily increase as compared with a case where the transmission layer absorbs the infrared radiation. On the other hand, because the heating element 40 can absorb a part of the infrared radiation emitted by itself and use the infrared radiation to heat itself, the temperature of the heating element 40 can be easily increased. As a result, the temperature difference between the heating element 40 and the filter unit 50 (in particular, the first transmission layer 51, which is closest to the heating element 40) during use can be increased. Because the temperature difference between the heating element 40 and the filter unit 50 can be increased, for example, the temperature of the heating element 40 can be increased while maintaining the temperature of the transmission layer (the first transmission layer 51) to be the heatproof temperature or less, and the energy of infrared radiation emitted to the object (the coating 92) can be increased. With the infrared heater 10, even when the temperature of the heating element 40 is the same, the temperature of the filter unit 50 can be maintained to be lower. Moreover, the distance between the heating element 40 and the transmission layer (the first transmission layer 51) can be reduced while maintaining the temperature of the transmission layer (the first transmission layer 51) to be the heatproof temperature or less. As a result, the distance between the heating element 40 and the object (the coating 92) can be also reduced.

In the infrared heater 10, the transmission layer includes the first transmission layer 51, and the first transmission layer 51 serves as part of the reflective section. The first transmission layer 51 has reflection characteristics of reflecting infrared radiation in a predetermined reflection wavelength range and includes the selective reflection region 53, which transmits at least a part of the infrared radiation from the heating element 40, and the transmission region 54, which transmits infrared radiation in the reflection wavelength range. The selective reflection region 53 is disposed closer than the transmission region 54 to the center of the heating element 40. The transmission region 54 is disposed farther than the selective reflection region 53 from the center of the heating element 40. The reflective section includes the transmission-layer-side reflective member 75, which is disposed on a side opposite to the heating element 40 when seen from the first transmission layer 51. The transmission-layer-side reflective member 75 has the reflective surface 76, which is inclined toward the surface of the transmission region 54 facing the heating element 40 and which reflects, toward the heating element 40, infrared radiation in the reflection wavelength range passed through the transmission region 54.

With the infrared processing device 100 according to the present embodiment described above, because the heating element 40 absorbs infrared radiation reflected by the selective reflection region 53 and the reflective surface 76, the temperature of the heating element 40 can be easily increased. Moreover, infrared radiation in the reflection wavelength range emitted toward a part of the first transmission layer 51 away from the center of the heating element 40 can be reflected by the inclined reflective surface 76 toward the heating element. As a result, emission of infrared radiation in the reflection wavelength range to the outside space can be suppressed, so that the temperature of the heating element 40 can be more easily increased. Accordingly, the energy efficiency in emitting infrared radiation is improved.

In the infrared heater 10, the temperature difference between the filter unit 50 (in particular, the first transmission layer 51) and the heating element 40 can be increased. Because the temperature difference between the heating element 40 and the filter unit 50 can be increased, for example, the temperature of the heating element 40 can be increased while maintaining the temperature of the first transmission layer 51 to be the heatproof temperature or less, and the energy of infrared radiation emitted to the coating 92 can be increased. With the infrared heater 10, even when the temperature of the heating element 40 is the same, the temperature of the filter unit 50 can be maintained to be lower, and increase in the temperatures of the coating 92 and the surrounding components (such as the furnace body 80 and the processing space 81) due to increase in the temperature of the filter unit 50 can be suppressed. The transmission-layer-side reflective member 75 is disposed below the first transmission layer 51 and allows the first space 47 to be open. Accordingly, the energy efficiency in emitting infrared radiation can be further improved, while allowing the temperature difference between the heating element 40 and the filter unit 50 to increase.

The transmission region 54 is located so as to surround the selective reflection region 53 when seen from the heating element 40. Therefore, the aforementioned effect of suppressing emission of infrared radiation in the reflection wavelength range to the outside space is increased, and the energy efficiency in emitting infrared radiation is improved. The transmission-layer-side reflective member 75 is disposed so that, when the reflective surface 76 is perpendicularly projected onto a surface of the first transmission layer 51 facing the heating element 40, the reflective surfaces 76*a* to 76*d* respectively overlap the left, right, front, and back side portions of the transmission region 54. The reflective surface 76 is located so as to surround the selective reflection region 53 when seen from the heating element 40. Therefore, for example, as compared with a case where the infrared heater 10 does not include one, two, or three of the reflective surfaces 76*a* to 76*d*, the effect of reflecting infrared radiation in the reflection wavelength range toward the heating element is increased, and the temperature of the heating element can be more easily increased. Accordingly, the efficiency in emitting infrared radiation is further improved.

The transmission-layer-side reflective member 75 is disposed so that the reflective surface 76 does not overlap the selective reflection region 53 when the reflective surface 76 is perpendicularly projected onto a surface of the first transmission layer 51 facing the heating element 40. Therefore, the transmission-layer-side reflective member 75 is not likely to block infrared radiation that has passed through the selective reflection region 53, so that the infrared radiation can be easily emitted toward the coating 92.

The infrared heater 10 includes the heating-element-side reflective member 23, which is disposed on a side opposite to the first transmission layer 51 when seen from the heating element 40 and which reflects infrared radiation in the reflection wavelength range. Therefore, the heating-element-side reflective member 23 reflects, toward the first transmission layer 51 (downward), infrared radiation emitted in a direction opposite to the first transmission layer 51 (upward) when seen from the heating element 40, and thereby the heating element 40 can be heated by infrared radiation reflected by the heating-element-side reflective member 23. Therefore, the temperature of the heating element 40 can be easily increased, and the energy efficiency in emitting infrared radiation is improved.

In the infrared heater 10, the closest transmission layer (the first transmission layer 51), which is one of the one or more transmission layers of the filter unit 50 that is closest to the heating element 40, has a surface (upper surface) that faces the heating element 40 and that is exposed to the first space 47. The infrared heater 10 satisfies $0.06 \leq D/L \leq 0.23$. As the ratio D/L decreases, heat transfer from the heating element 40 to the closest transmission layer (the first transmission layer 51) becomes increasingly and inevitably dependent on heat transfer through an atmosphere in the first space 47. As a result, heat accumulation in the first space 47 increases, and the temperature of the closest transmission layer (the first transmission layer 51) may be easily increased. By making the ratio D/L be 0.06 or more, excessive increase in the conductive heat flux can be prevented, the amount of heat transfer between the heating element 40 and the filter unit 50 during use can be reduced, and increase in the temperature of the filter unit 50 (in particular, the first transmission layer 51) can be sufficiently suppressed. As the ratio D/L increases, heat transfer in the first space 47 becomes increasingly dependent on convection. If the ratio D/L becomes excessively high, convective loss in the first space 47 increases, and the temperature of the heating element 40 may be easily reduced. In this case, by making the ratio D/L be 0.23 or less, increase in the convective heat transfer coefficient can be prevented, and decrease in the temperature of the heating element 40 due to convective loss can be sufficiently suppressed. Thus, by making the ratio D/L be in the range of $0.06 \leq D/L \leq 0.23$, the temperature difference between the heating element 40 and the filter unit 50 (in particular, the first transmission layer 51) can be further increased, while suppressing decrease in the temperature of the heating element 40 during use. Consequently, a larger amount of the energy of infrared radiation from the heating element 40 is transmitted by the filter unit 50, emitted toward an object (the coating 92), and infrared processing of the coating 92 can be efficiently performed.

The heating element 40 is a planar heating element that can emit infrared radiation toward the first transmission layer 51 and that has a flat surface that can absorb infrared radiation in the reflection wavelength range. Therefore, the heating element 40 can easily absorb infrared radiation reflected by the selective reflection region 53 and the transmission-layer-side reflective member 75 as compared with a case where, for example, the heating element 40 is a linear heating element, and the temperature of the heating element 40 can be easily increased. Accordingly, the energy efficiency in emitting infrared radiation is improved.

The infrared processing device 100 includes the infrared heater 10 and the furnace body 80. The furnace body 80 forms the processing space 81, which is not directly connected to the first space 47 and in which infrared processing is performed by using infrared radiation emitted from the heating element 40 and passed through the filter unit 50.

The present invention is not limited to the embodiments described above, and the embodiments may be modified in various ways within the technical scope of the present invention.

Figure 15:
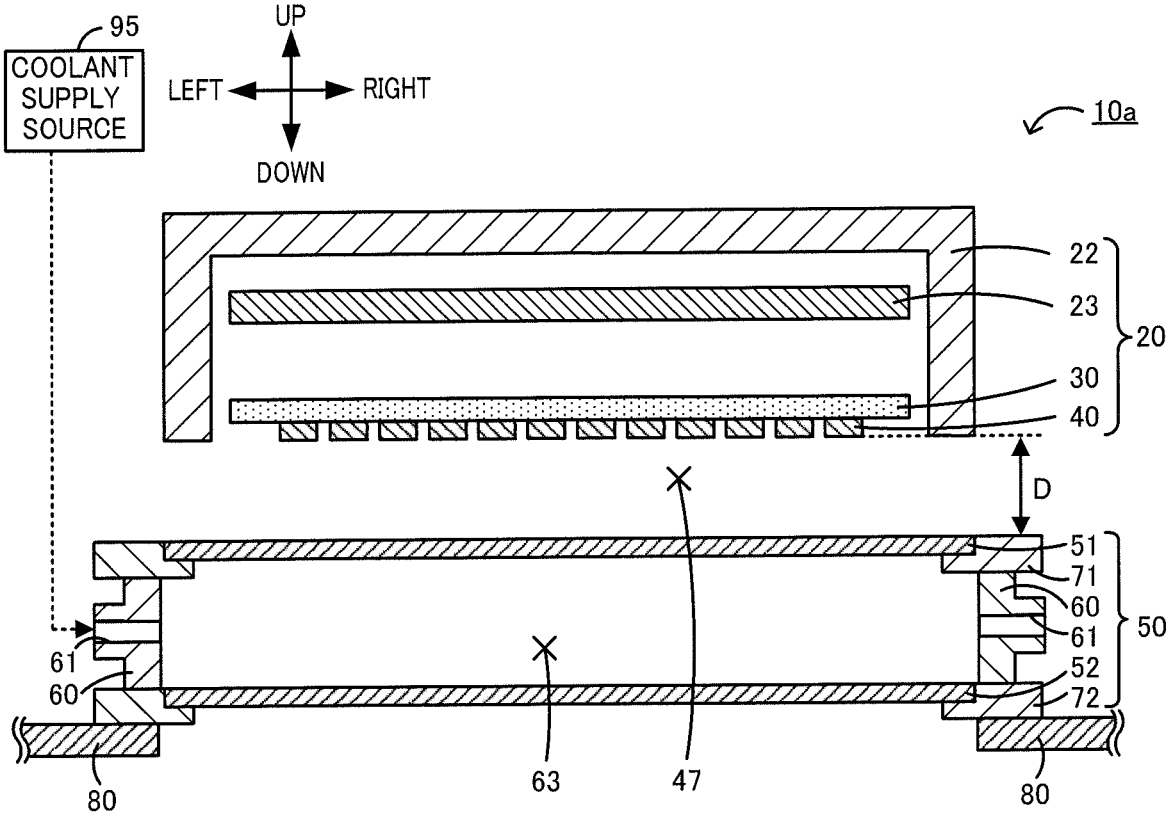
FIG. 15 is an enlarged sectional view of an infrared heater 10*a* according to a modification.

For example, in the first embodiment described above, the filter unit 50 includes the first transmission layer 51. The filter unit 50 may further include one or more transmission layers that transmit at least a part of the infrared radiation from the heating element 40. FIG. 15 is an enlarged sectional view of an infrared heater 10*a* according to a modification. The filter unit 50 of the infrared heater 10*a* includes, in addition to the first transmission layer 51 and the first fixing plate 71 described above, a second transmission layer 52, a second fixing plate 72, and a cooling case 60. The second transmission layer 52 is disposed so as to be separated by a distance below the first transmission layer 51 and transmits at least a part of the infrared radiation passed through the first transmission layer 51. The second fixing plate 72 is a quadrangular frame-shaped member onto which the second transmission layer 52 is placed and fixed. The cooling case 60 is disposed between the first transmission layer 51 and the second transmission layer 52. The second transmission layer 52 is a plate-shaped member that is quadrangular in a bottom view. The upper surface of the second transmission layer 52 faces the lower surface of the first transmission layer 51, and the second transmission layer 52 is substantially parallel to the first transmission layer 51. The second transmission layer 52 is disposed so as to be vertically separated by the second space 63 from the first transmission layer 51. The lower surface of the second transmission layer 52 is exposed to the processing space 81. It is sufficient that the second transmission layer 52 transmits at least a part of the infrared radiation emitted from the heating element 40 passed through the first transmission layer 51. The second transmission layer 52 may be made of, for example, the same material as the first transmission layer 51 and may have the same filter characteristics as the first transmission layer 51. Alternatively, the second transmission layer 52 need not have infrared reflection characteristics and may generally have high infrared transmittance. The second fixing plate 72 is attached to an upper part of the furnace body 80. The cooling case 60 is a substantially rectangular parallelepiped box-shaped member whose upper and lower sides are open. The upper and lower openings of the cooling case 60 are closed by the first transmission layer 51, the first fixing plate 71, the second transmission layer 52, and the second fixing plate 72. Therefore, the second space 63 is surrounded by the front, back, left, and right walls of the cooling case 60; the first transmission layer 51; and the second transmission layer 52. The cooling case 60 has left and right coolant holes 61. The left coolant hole 61 is connected to a coolant supply source 95 (cooling unit), which is disposed in the outside space, through a pipe. The coolant supply source 95 supplies a coolant to the second space 63 through the left coolant hole 61. After passing through the second space 63, the coolant flows to the outside through the right coolant hole 61. The coolant supplied by the coolant supply source 95 is, for example, a gas, such as air or an inert gas. The coolant cools the filter unit 50 by coming into contact with and absorbing heat from the first transmission layer 51, the second transmission layer 52, and the cooling case 60. The second space 63 may be directly connected to the outside space through the right coolant hole 61. Alternatively, a pipe or the like may be connected, and the second space 63 need not be directly connected to the outside space. The first space 47, the second space 63, and the processing space 81 are not directly connected to each other. The second space 63 is a coolant channel that allows a coolant to flow therethrough.

With an infrared processing device including the infrared heater 10*a* having the structure described above, advantages the same as those of the infrared processing device 100 according to the first embodiment described above can be obtained. Moreover, heating of the second transmission layer 52 is suppressed, because the filter unit 50 includes the second transmission layer 52 and the second space 63 is formed between the first transmission layer 51 and the second transmission layer 52. Thus, the temperature of the surface of the infrared heater 10 (the lower surface of the second transmission layer 52) is maintained to be comparatively low. Furthermore, by making a coolant flow through the second space 63, increase in the temperature of the filter unit 50 can be suppressed. Therefore, the temperature of the surface of the infrared heater 10 can be maintained to be lower, and the temperature difference between the heating element 40 and the filter unit 50 can be increased further. By maintaining the temperature of the filter unit 50 to be low, increase in the temperatures of the furnace body 80 and the processing space 81 can be suppressed.

In the infrared heater 10*a* shown in FIG. 15, a coolant need not be supplied from the coolant supply source 95, and the second space 63 may be directly connected to the outside space. The second space 63 may be open to the outside space. Even when a coolant is not supplied from the second space 63, due to the presence of the second space 63, an effect of suppressing heating of the surface of the infrared heater 10 (the lower surface of the second transmission layer 52 in FIG. 15) can be obtained. Thus, the temperature of the processing space 81, the furnace body 80, and the like can be maintained to be low. In the case where a coolant is not supplied from the coolant supply source 95, the infrared heater 10*a* need not include the cooling case 60. Also in this case, it is sufficient that the second space 63 is formed between the first transmission layer 51 and the second transmission layer 52. For example, a member that separates and supports the first fixing plate 71 and the second fixing plate 72 may be disposed between these fixing plates.

In the infrared heater 10*a* shown in FIG. 15, the second transmission layer 52 is disposed below the first transmission layer 51. The infrared heater 10*a* may further include another transmission layer (for example, a layer that reflects infrared radiation in the reflection wavelength range) above the first transmission layer 51. Also in this case, the first transmission layer 51 reflects infrared radiation in the reflection wavelength range passed through the upper transmission layer, and thereby the heating element 40 can be heated. Therefore, advantages the same as those of the infrared heater 10 according to the first embodiment described above can be obtained. In this case, it can be considered that the first transmission layer 51 corresponds to the second transmission layer 52 according to the second embodiment, and the upper transmission layer corresponds to the first transmission layer 51 according to the second embodiment. In this case, the closest transmission layer, which is one of the one or more transmission layers that is closest to the heating element 40, is the upper transmission layer. Therefore, the distance D used to calculate the ratio D/L is the distance between the heating element 40 and the upper transmission layer.

In the first embodiment described above, the first transmission layer 51 includes the substrate 51*a* and the upper and lower coating layer 51*b* and 51*c* formed on the surface of the substrate 51*a*. However, this is not a limitation. As long as the first transmission layer 51 at least has the aforementioned reflection characteristics, for example, at least one of the upper coating layer 51*b* and the lower coating layer 51*c* may be omitted.

In the first embodiment described above, the wavelength of the first transmission peak of the filter unit 50 is in the range of 2 μm to 3 μm, the wavelength of the second transmission peak is in the range of 5 μm to 8.5 μm, and the reflection wavelength range is 3.5 μm to 4.5 μm. However, this is not a limitation. For example, by appropriately adjusting the thicknesses of the substrate 51*a*, the upper coating layer 51*b*, and the lower coating layer 51*c* of the first transmission layer 51, one or more of the wavelength of the first transmission peak, the wavelength of the second transmission peak, and the reflection wavelength range may be changed from those of the first embodiment described above.

The heating element 40 is not limited to those in the first to third embodiments described above. For example, in the embodiments, the lower surface of the heating element 40 is coated with a thermally sprayed ceramic coating. Alternatively, the lower surface and the upper surface may be coated, or a thermally sprayed ceramic coating may be omitted. The heating element 40 is a planar ribbon heating element that is wound around the support plate 30. However, this is not a limitation. For example, the heating element 40 may be a zig-zag planar heating element formed by punching a metal plate. Alternatively, the heating element 40 may be a linear heating element. In the embodiments, the heating element 40 is wound around and supported by the support plate 30. Alternatively, the heating element 40 may be attached to the support plate 30 by using, for example, a bolt extending through the heating element 40.

In the first to third embodiments described above, the first transmission layer 51 is plate-shaped member that is quadrangular in a bottom view. This is not a limitation. The first transmission layer 51 may be, for example, a disk-shaped member. The same applies to the second transmission layer 52. The same applies to the shapes of the selective reflection region 53 and the transmission region 54.

In the first to third embodiments described above, the infrared heater 10 includes the heating-element-side reflective member 23. Alternatively, the heating-element-side reflective member 23 may be omitted, and the case 22 may be made from a material that reflects infrared. For example, the lower surface of the heating-element-side reflective member 23 may be coated with an infrared reflection coating. The infrared heater 10 need not have the heating-element-side reflective member 23, or the case 22 need not reflect infrared radiation. In other words, the infrared heater 10 need not have a heating-element-side reflective member above the heating element 40.

In the first and third embodiments described above, in the infrared processing device 100, the infrared heater 10 is disposed on the upper part of the furnace body 80, and the first transmission layer 51 is exposed to the processing space 81. However, this is not a limitation. For example, the infrared heater 10 may be disposed inside the furnace body 80. Also in this case, for example, by using a pipe or a partitioning member, the first space 47 may be open to the outside space and not directly connected to the processing space 81.

For example, in the second embodiment described above, the infrared processing device 100 includes the coolant supply source 95. However, this is not a limitation. In this case, the second space 63 may be a tightly closed space or may be connected to the outside space through the coolant hole 61. The atmosphere in the second space 63 be a vacuum atmosphere or a non-vacuum atmosphere.

In the second embodiment described above, the entirety of the partition member 58 is an infrared reflection member, and the entirety of the partition member 58 corresponds to a transmission-layer-side reflective member in the present invention. However, this is not a limitation. The transmission-layer-side reflective member, which can reflect infrared radiation, may be at least a part of the partition member 58. For example, only the cooling case 60 of the partition member 58 may be capable of reflecting infrared radiation in the reflection wavelength range. It is sufficient that the transmission-layer-side reflective member reflect infrared radiation at least in the reflection wavelength range. The partition member 58 may be a member that does not reflect infrared radiation. That is, the reflective section 55 need not include a transmission-layer-side reflective member. Also in this case, in the second embodiment described above, because the reflective section 55 of the infrared heater 10 includes the second transmission layer 52, infrared radiation in the reflection wavelength range can be reflected and the temperature of the heating element 40 can be increased. The filter unit 50 need not include the partition member 58. For example, the filter unit 50, which includes the first fixing plate 71 and the second fixing plate 72, need not include the cooling case 60. Instead, a member that separates and supports the first fixing plate 71 and the second fixing plate 72 may be disposed between these fixing plates. When the partition member 58 is omitted, the second space 63 may be directly connected to the outside space or may be open to the outside space.

In the second embodiment described above, the second transmission layer 52 is disposed substantially parallel to the heating element 40 so that infrared radiation from the heating element 40 can be directly reflected toward the heating element 40. However, this is not a limitation. It is sufficient that the reflective section 55 as a whole can reflect infrared radiation toward the heating element 40. For example, the partition member 58 may reflect infrared radiation reflected by the second transmission layer 52, so that infrared radiation in the reflection wavelength range can be reflected toward the heating element 40.

In the second embodiment described above, the first transmission layer 51 transmits infrared radiation in the reflection wavelength range. However, it is sufficient that the first transmission layer 51 may transmit at least a part of the infrared radiation from the heating element 40, and the first transmission layer 51 may reflect infrared radiation in the reflection wavelength range. For example, the first transmission layer 51 may have the same filter characteristics as the second transmission layer 52. However, as described above, preferably, the first transmission layer 51 does not have infrared reflection characteristics (that is, transmits infrared radiation in a wide wavelength range) because, in this case, the infrared absorptance of the first transmission layer 51 is reduced and increase in the temperature of the first transmission layer 51 can be more easily suppressed.

In the second embodiment described above, the filter unit 50 includes the first transmission layer 51 and the second transmission layer 52. However, this is not a limitation. It is sufficient that the filter unit 50 includes one or more transmission layers. For example, when the first transmission layer 51 has reflection characteristics of reflecting infrared radiation in the reflection wavelength range, the second transmission layer 52 may be omitted. In this case, the first transmission layer 51 also serves as at least a part of the reflective section 55. When the transmission-layer-side reflective member (such as the partition member 58) is capable of reflecting infrared radiation in the reflection wavelength range toward the heating element 40, the second transmission layer 52 can be omitted even if the first transmission layer 51 does not have reflection characteristics.

In the second embodiment described above, the filter unit 50 includes the first transmission layer 51 and the second transmission layer 52. However, this is not a limitation. For example, the filter unit 50 may further include a transmission layer that can transmit at least a part of the infrared radiation from the heating element 40. For example, the filter unit 50 may further include a transmission layer closer than the first transmission layer 51 to the heating element 40. In this case, the closest transmission layer is not the first transmission layer 51 but the transmission layer closest to the heating element 40.

In the second embodiment described above, the upper surface of the first transmission layer 51 is exposed to the first space 47. However, this is not a limitation. It is sufficient that the filter unit 50 is separated by the first space 47 from the heating element 40. For example, if the filter unit 50 includes a closest transmission layer that is not the first transmission layer 51, the upper surface of the closest transmission layer may be exposed to the first space 47.

In the second embodiment described above, the transmission-layer-side reflective member (the partition member 58) is made of a metal. However, the material of the transmission-layer-side reflective member is not limited to a metal as long as it can reflect infrared radiation in the reflection wavelength range passed through the first transmission layer 51. For example, the inner peripheral surface of the partition member 58 may be covered with a reflection coating that reflects infrared radiation. In this case, it is not necessary that the entirety of the transmission-layer-side reflective member be made of a material that can reflect infrared radiation. Likewise, it is sufficient that the heating-element-side reflective member 23 can reflect infrared radiation at least in the reflection wavelength range. For example, the lower surface of the heating-element-side reflective member 23 may be covered with a reflection coating.

In the second embodiment described above, the first transmission layer 51 includes the upper coating layer 51*b* and the lower coating layer 51*c* formed on the substrate 51*a*. However, this is not a limitation. As long as the first transmission layer 51 at least has the aforementioned filter characteristics, at least one of the upper coating layer 51*b* and the lower coating layer 51*c* may be omitted. The same applies to the second transmission layer 52. It is sufficient that the first transmission layer 51 has filter characteristics of transmitting at least a part of the infrared radiation from the heating element 40. It is sufficient that the second transmission layer 52 has filter characteristics of reflecting infrared radiation in the reflection wavelength range and transmitting at least a part of the infrared radiation emitted from the heating element 40 and passed through the first transmission layer 51.

In the second embodiment described above, the second transmission layer 52 has a first transmission peak in the wavelength range of 2 μm to 3 μm, a second transmission peak in the wavelength range of 5 μm to 8.5 μm, and a reflection wavelength range of 3.5 μm to 4.5 μm. However, this is not a limitation. For example, by appropriately adjusting the thicknesses the substrate 52*a*, the upper coating layer 52*b*, and the lower coating layer 52*c* of the second transmission layer 52, one or more of the wavelength of the first transmission peak, the wavelength of the second transmission peak, and the reflection wavelength range may be changed from those of the second embodiment. Preferably, the wavelength of the first transmission peak and the wavelength of the second transmission peak are as close as possible to the wavelength of infrared radiation to be emitted toward an object on which infrared processing is to be performed (the infrared absorption peak of the object or the like). Preferably, the reflection wavelength range is a wavelength range that is not necessary for infrared processing.

In the second embodiment described above, in the infrared processing device 100, the infrared heater 10 is disposed on an upper part of the furnace body 80, and the second transmission layer 52 is exposed to the processing space 81. However, this is not a limitation. For example, the infrared heater 10 may be disposed inside the furnace body 80. Also in this case, for example, by using a pipe and a partition member, the first space 47 may be open to the outside space without being directly connected to the processing space 81. Likewise, the partition member 58 and the second transmission layer 52 may be disposed inside the furnace body 80, and the first transmission layer 51 may close an opening in the upper surface (ceiling) of the furnace body 80. That is, the first transmission layer 51 and the first space 47 may be located outside the furnace body 80, and the second space 63 may be located inside the furnace body 80.

For example, in the third embodiment described above, the filter unit 50 includes the first transmission layer 51. However, it is sufficient that the filter unit 50 includes one or more transmission layers including the first transmission layer 51. For example, the filter unit 50 may further include one or more transmission layers that transmit at least a part of the infrared radiation from the heating element 40. For example, the filter unit 50 may include, in addition to the first transmission layer 51, a transmission layer closer than the first transmission layer 51 to the heating element 40. In this case, the closest transmission layer is not the first transmission layer 51 but the transmission layer closest to the heating element 40. If there is a transmission layer closer than the first transmission layer 51 to the heating element 40, the transmission layer may have, as with the transmission region 54, characteristics of transmitting infrared radiation at least in the reflection wavelength range, or may have characteristics of transmitting infrared radiation at least in the reflection wavelength range and in the wavelength of 2 μm to 8 μm. Alternatively, the filter unit 50 may further include, in addition to the first transmission layer, a transmission layer that is located opposite to the heating element 40 when seen from the first transmission layer 51. For example, the filter unit 50 may include a transmission layer on a side opposite to the first transmission layer 51 when seen from the transmission-layer-side reflective member 75 (below the transmission-layer-side reflective member 75 in FIG. 10). This transmission layer may have characteristics similar to those of the selective reflection region 53 or may have characteristics similar to those of the transmission region 54.

In the third embodiment described above, the upper surface of the first transmission layer 51 is exposed to the first space 47. However, this is not a limitation. It is sufficient that the filter unit 50 is separated by the first space 47 from the heating element 40. For example, if the filter unit 50 includes a closest transmission layer that is different from the first transmission layer 51, the upper surface of the closest transmission layer may be exposed to the first space 47.

Figure 16:
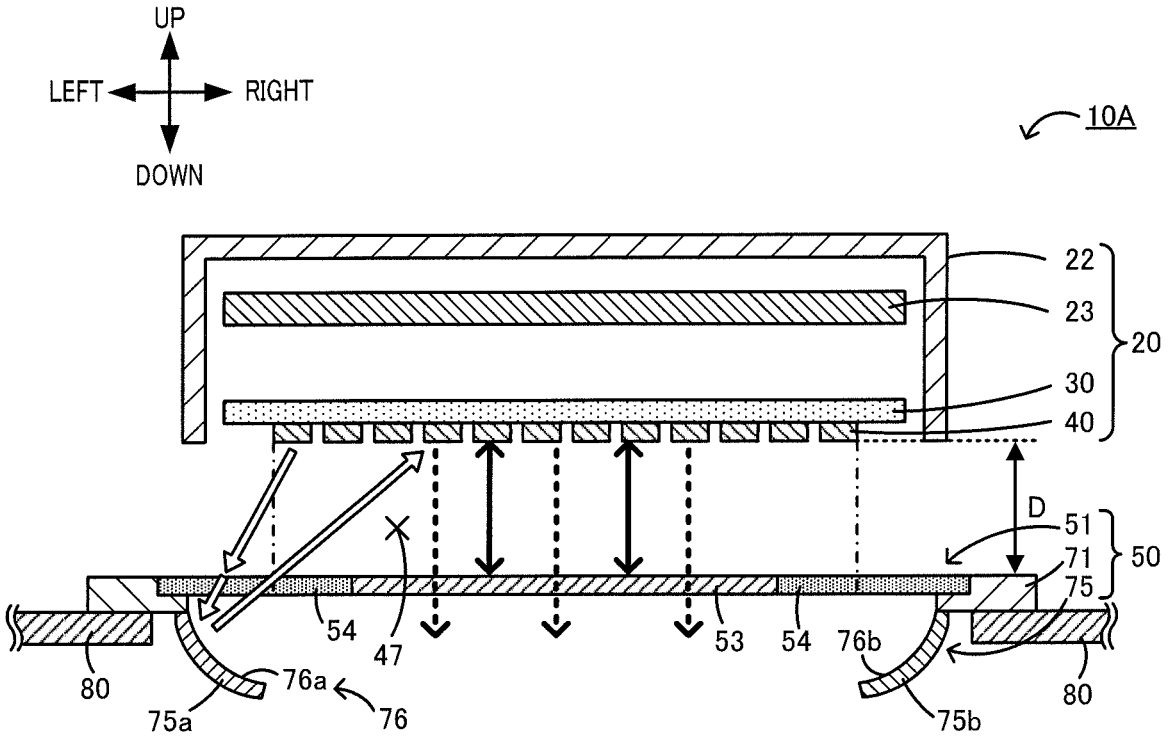
FIG. 16 is an enlarged sectional view of an infrared heater 10A according to a modification.

In the third embodiment described above, the reflective surface 76 is a flat surface. However, as long as the reflective surface 76 is inclined with respect to (is not parallel to) a surface of the transmission region 54 facing the heating element 40, the reflective surface 76 need not be a flat surface. For example, as in an infrared heater 10A according to the modification shown in FIG. 16, the reflective surface 76 may be a curved (convex) surface. If the reflective surface 76 is a curved surface, the cross sectional shape of the reflective surface 76 may be a curved shape, such as a parabola, an elliptical arc, or a circular arc. The position of the focus of the curved surface of the reflective surface 76 may be determined to that the reflective surface 76 can efficiently reflect infrared radiation toward the heating element 40.

The positional relationships among and the shapes of the selective reflection region 53, the transmission region 54, the heating element region E, and the reflective surface 76 projected onto the upper surface of the first transmission layer 51, and the vertical distances between the heating element 40, the first transmission layer 51, and the reflective surface 76 are not limited to those in the third embodiment described above. These may be appropriately determined so that the reflective surface 76 can efficiently reflect infrared radiation toward the heating element 40 by, for example, experiment. For example, in the third embodiment, the transmission region 54 surrounds the selective reflection region 53. However, this is not a limitation. For example, the transmission region 54 may be located only on the left and right sides of the selective reflection region 53 or only on the front and back sides of the selective reflection region 53. In the third embodiment, the reflective surface 76 projected onto the first transmission layer 51 does not overlap the heating element region E and the selective reflection region 53. However, the reflective surface 76 projected onto the first transmission layer 51 may overlap at least one of the heating element region E and the selective reflection region 53. When seen from the heating element 40, at least a part of the reflective surface 76 may protrude outward beyond the transmission region 54 in at least one of the front, back, left, and right directions. The transmission region 54 need not overlap the heating element region E or may be included in the inside of the heating element region E. The center of at least one of the selective reflection region 53, the transmission region 54, and the heating element region E need not coincide with the center of another of these. The widths Wa to Wd may all be the same, or at least one of Wa to Wd may be different from the others.

In the third embodiment described above, the selective reflection region 53 is a region in which the upper coating layer 51*b* and the lower coating layer 51*c* are formed on the substrate 51*a*. However, this is not a limitation. As long as the selective reflection region 53 at least has the aforementioned filter characteristics, at least one of the upper coating layer 51*b* and the lower coating layer 51*c* may be omitted. The same applies to the transmission region 54. The first transmission layer 51 may further include a region having characteristics different from those of the selective reflection region 53 and the transmission region 54.

In the third embodiment described above, the filter unit 50 has the first transmission peak in the wavelength range of 2 μm to 3 μm, a second transmission peak in the wavelength range of 5 μm to 8.5 μm, and the reflection wavelength range of 3.5 μm to 4.5 μm. However, this is not a limitation. For example, by appropriately adjusting the thicknesses of the substrate 51*a*, the upper coating layer 51*b*, and the lower coating layer 51*c* in the selective reflection region 53, one or more of the wavelength of the first transmission peak, the wavelength of the second transmission peak, and the reflection wavelength range may be changed from those of the third embodiment. Preferably, the wavelength of the first transmission peak and the wavelength of the second transmission peak are as close as possible to the wavelength of infrared radiation to be emitted to an object on which infrared processing is to be performed (such as the wavelength of the infrared absorption peak of the object). Preferably, the reflection wavelength range is a wavelength range that is not necessary for infrared processing.

In the third embodiment described above, the transmission-layer-side reflective member 75 is made of a metal. However, it is sufficient that the reflective surface 76 can reflect infrared radiation. For example, the reflective surface 76 may be coated with an infrared reflection coating. In this case, it is not necessary that the entirety of the transmission-layer-side reflective member 75 be made of a material that can reflect infrared radiation. Likewise, the lower surface of the heating-element-side reflective member 23 may be coated with a reflection coating.

In the third embodiment described above, the infrared heater 10 includes four transmission-layer-side reflective members 75. However, this is not a limitation, and it is sufficient that the infrared heater includes one or more transmission-layer-side reflective members 75. In the present embodiment, the angles θ of the reflective surfaces 76*a* to 76*d* are all the same. However, this is not a limitation. At least one of the angles θ of the reflective surfaces 76*a* to 76*d* may differ from the others. It is not necessary that the shapes of the first to fourth transmission-layer-side reflective members 75*a* to 76*d* and the shapes of the reflective surfaces 76*a* to 76*d* be all the same.

Figure 17:
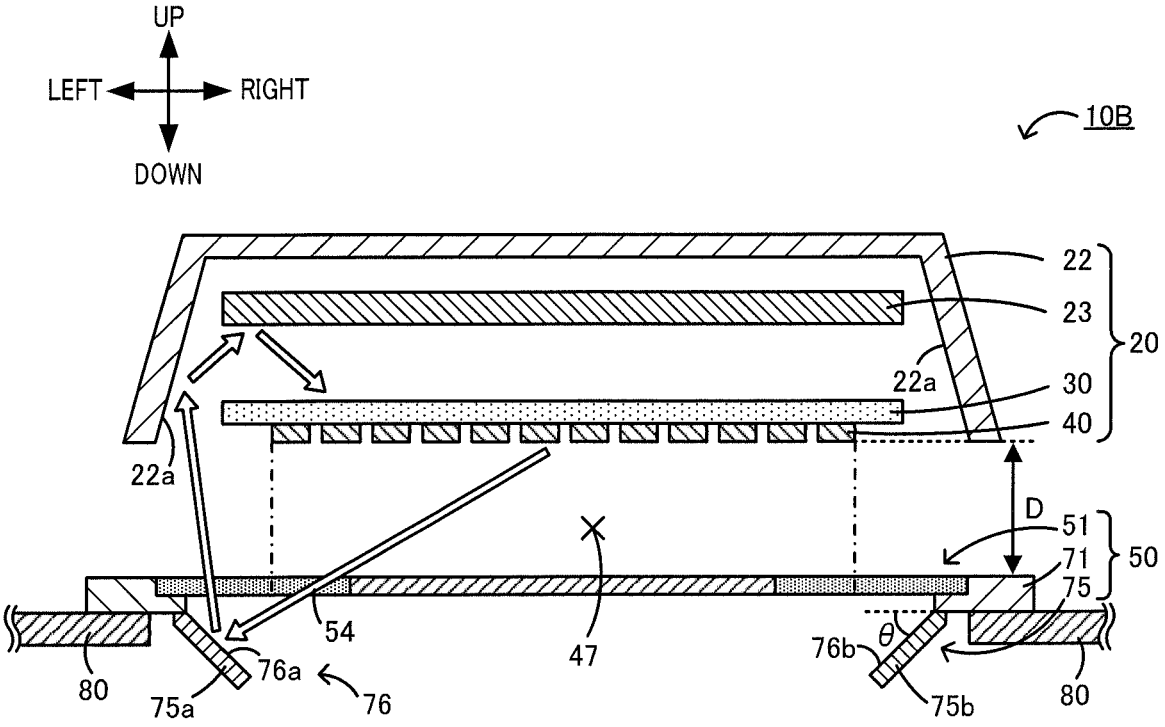
FIG. 17 is an enlarged sectional view of an infrared heater 10B according to a modification.

In the third embodiment described above, the infrared heater 10 includes the heating-element-side reflective member 23. Instead of providing the heating-element-side reflective member 23 or in addition to providing the heating-element-side reflective member 23, the case 22 may be made of an infrared reflecting material. If the case 22 can reflect infrared radiation, as in an infrared heater 10B according to a modification shown in FIG. 17, the case 22 may include a reflective surface 22*a* that is inclined with respect to the surface of a part of the transmission region 54 facing the heating element 40 and partially protrudes outward beyond the heating element 40 in a bottom view. In this case, if infrared radiation is reflected by the reflective surface 76 in a direction other than a direction toward the heating element 40, the reflective surface 22*a* reflects the infrared radiation, and subsequently the upper inner surface of the case 22 or the heating-element-side reflective member 23 further reflects the infrared radiation, so that the heating element 40 can absorb the infrared radiation. The infrared heater 10 need not include the heating-element-side reflective member 23 and the case 22 need not reflect infrared radiation. In this case, the infrared heater 10 does not have a heating-element-side reflective member above the heating element 40.

The structures of some of the first to third embodiments or the modification of the first to third Embodiments described above may be applied to other embodiments or modifications as appropriate, or two or more of the structures described above may be used in combination as appropriate. It is sufficient that the infrared heater includes one or more transmission layers that transmit at least a part of the infrared radiation from the heating element. For example, the filter unit may include, as the transmission layer, one or more of the first transmission layer 51 according to the first embodiment, the first transmission layer 51 according to the second embodiment, the second transmission layer 52 according to the second embodiment, and the first transmission layer 51 according to the third embodiment. The reflective section may include one or more of the first transmission layer 51 according to the first embodiment, the second transmission layer 52 according to the second embodiment, the transmission-layer-side reflective member (the partition member 58) according to the second embodiment, the first transmission layer 51 (in particular, the selective reflection region 53) according to the third embodiment, and the transmission-layer-side reflective member 75 according to the third embodiment.

EXAMPLES

Hereinafter, examples in which infrared heaters and infrared processing devices including the infrared heaters were actually made will be described as Examples. Examples 1 to 10, 1B to 10B, 1C to 18C correspond to examples according to the present invention. The present invention not limited to the following Examples.

Examples 1 to 10

In Examples 1 to 10, infrared processing devices including infrared heaters were made while changing the ratio D/L as shown in Table 1. Each of the infrared heaters had the same structure as the infrared heater 10*a*, except that the infrared heaters did not have the cooling case 60 and the second space 63 was open to the outside space. Each of the first transmission layer 51 and the second transmission layer 52 were made of the same material and had the same filter characteristics as the first transmission layer 51 of the first embodiment described above. In each of the infrared processing devices, only one infrared heater was attached to the furnace body 80. The heating element 40 had the shape shown in FIGS. 3 and 4, and the representative dimension L of the heating element 40 was 135.4 mm. The heating element 40 was made of a Ni—Cr alloy, and the surface of the heating element 40 facing the first transmission layer 51 was coated with a thermally sprayed ceramic coating of alumina. The outside space was an air atmosphere.

Evaluation Test

In each of the infrared processing devices of Examples 1 to 10, an object was placed at a position in the processing space 81 directly below the infrared heater. Electric power of about 300 W was supplied to the heating element 40, and the infrared processing device was let stand until the temperature thereof stabilized, and the temperatures of the heating element 40, the first transmission layer 51, the second transmission layer 52, the object, and the processing space 81 were measured. Table 1 shows the distance D, the ratio D/L, and the measured temperatures of Examples 1 to 10.

TABLE 1

| | Distance D (mm) | Distance D/ Representative Dimension L (=Ratio D/L) | Temperature (° C.) Heating Element | First Transmission Layer | Second Transmission Layer | Object | Processing Time |
|---|---|---|---|---|---|---|---|
| EXAMPLE 1 | 10 | 0.074 | 672 | 450 | 145 | 171 | 40 |
| EXAMPLE 2 | 12 | 0.089 | 648 | 375 | 139 | 168 | 42 |
| EXAMPLE 3 | 15 | 0.111 | 635 | 300 | 127 | 155 | 39 |
| EXAMPLE 4 | 18 | 0.133 | 612 | 246 | 118 | 141 | 36 |
| EXAMPLE 5 | 21 | 0.155 | 615 | 214 | 112 | 134 | 33 |
| EXAMPLE 6 | 24 | 0.177 | 600 | 191 | 109 | 136 | 35 |
| EXAMPLE 7 | 27 | 0.199 | 595 | 178 | 105 | 129 | 34 |
| EXAMPLE 8 | 30 | 0.222 | 596 | 165 | 100 | 126 | 32 |
| EXAMPLE 9 | 40 | 0.295 | 572 | 134 | 90 | 112 | 32 |
| EXAMPLE 10 | 48 | 0.354 | 571 | 125 | 87 | 109 | 33 |

Figure 18:
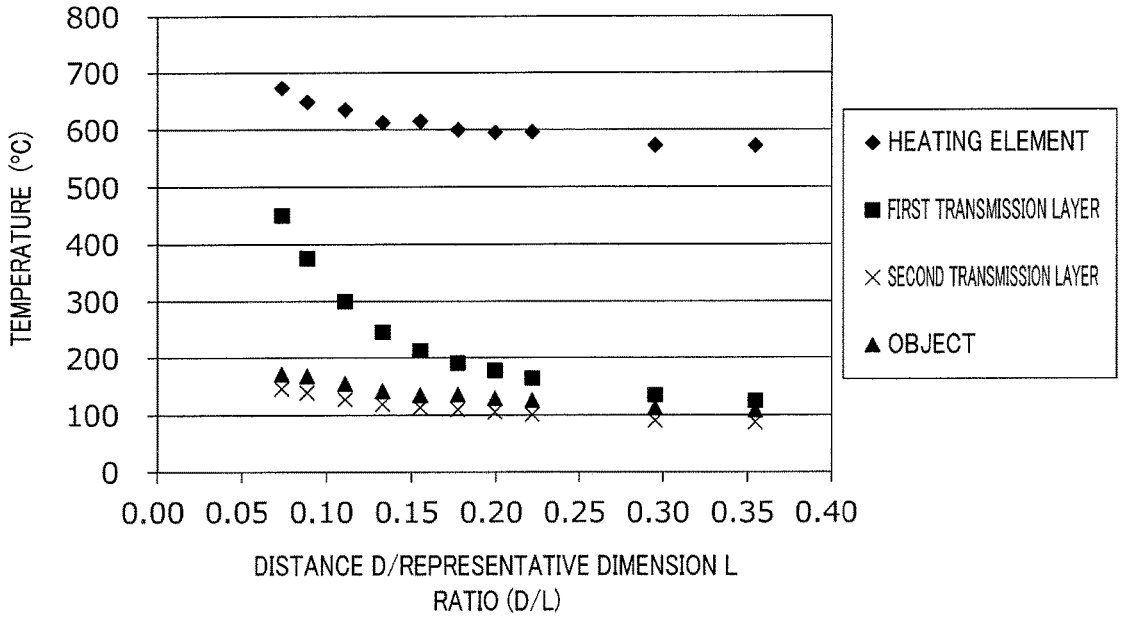
FIG. 18 is a graph representing the relationships between the ratio D/L and the temperatures of a heating element 40, a first transmission layer 51, a second transmission layer 52, and an object in Examples 1 to 10.

FIG. 18 is a graph representing the relationships between the ratio D/L and the temperatures of the heating element 40, the first transmission layer 51, the second transmission layer 52, and the object in Examples 1 to 10. As can be seen from Table 1 and FIG. 18, in each of Examples 1 to 10, the temperature difference between the heating element 40 and the filter unit 50 (the first transmission layer 51 and the second transmission layer 52) during use was large. As the ratio D/L increased, the temperature of the first transmission layer 51 tended to decrease and the temperature difference between the heating element 40 and the first transmission layer 51 tended to increase. In each of Examples 2 to 10, in which the ratio D/L was 0.08 or more, increase in the temperature of the first transmission layer 51 was successfully suppressed, and therefore it is considered that preferably the ratio D/L is 0.08 or more. In the region in which the ratio D/L was 0.14 or less, as the ratio D/L increased, the effect of suppressing increase in the temperature of the first transmission layer 51 increased sharply, and in the region in which the ratio D/L was 0.14 or more, increase in the temperature of the first transmission layer 51 was further suppressed. As the ratio D/L increased, the temperature of the heating element 40 tended to decrease. In each of Examples 1 to 8, in which the ratio D/L was 0.23 or less, decrease in the temperature of the heating element 40 was successfully suppressed, and therefore it is considered that preferably the ratio D/L is 0.23 or less. When the ratio D/L was 0.19 or less, the temperature of the heating element 40 was maintained to be 600° C. or more, and decrease in the temperature of the heating element 40 was further suppressed. Thus, the ratio D/L is preferably 0.08 or more or 0.14 or more and 0.23 or less or 0.19 or less. In Examples in which the temperature of the first transmission layer 51 was maintained to be low, there was a tendency in which the temperatures of the second transmission layer 52, the object, and the processing space 81 were maintained to be low.

Examples 1B to 5B

In Examples 1B to 5B, infrared processing devices including infrared heaters were made while changing the ratio D/L as shown in Table 2. Each of the infrared heaters had the same structure as the infrared heater 10 according to the second embodiment, except that the second space 63 was directly connected to the outside space through the left and right coolant holes 61. Each of the first transmission layer 51 and the second transmission layer 52 was made of the same material and had the same filter characteristics as the first transmission layer 51 of the second embodiment described above. The infrared transmittance of the first transmission layer 51 in the reflection wavelength range was 80%, the infrared reflectance of the first transmission layer 51 in the reflection wavelength range was 15%, and the infrared absorptance of the first transmission layer 51 in the reflection wavelength range was 5%. The infrared transmittance of the first transmission layer 51 in the wavelength range of 2 to 8 μm was 80%, the infrared reflectance of the first transmission layer 51 in the wavelength range of 2 to 8 μm was 15%, and the infrared absorptance of the first transmission layer 51 in the wavelength range of 2 to 8 μm was 5%. The infrared transmittance of the second transmission layer 52 in the reflection wavelength range was 10%, the infrared reflectance of the second transmission layer 52 in the reflection wavelength range was 80%, and the infrared absorptance of the second transmission layer 52 in the reflection wavelength range was 10%. The wavelength of the first transmission peak of the second transmission layer 52 was 2.5 μm, the infrared transmittance of the second transmission layer 52 at the first transmission peak was 80%, the infrared reflectance of the second transmission layer 52 at the first transmission peak was 10%, and the infrared absorptance of the second transmission layer 52 at the first transmission peak was 10%. The wavelength of the second transmission peak of the second transmission layer 52 was 5.5 μm, the infrared transmittance of the second transmission layer 52 at the second transmission peak was 80%, the infrared reflectance of the second transmission layer 52 at the second transmission peak was 10%, and the infrared absorptance of the second transmission layer 52 at the second transmission peak was 10%. Each of the infrared processing devices did not include the coolant supply source 95, and only one infrared heater was attached to the furnace body 80. The heating element 40 had the shape shown in FIGS. 7 and 8, and the representative dimension L of the heating element 40 was 135.4 mm. The heating element 40 was made of a Ni—Cr alloy, and the surface of the first transmission layer 51 was coated with a thermally sprayed ceramic coating of alumina. The outside space was an air atmosphere.

Examples 6B to 10B

In Examples 6B to 10B, infrared processing devices including infrared heaters were made while changing the ratio D/L as shown in Table 2. In the infrared heaters of Examples 6B to 10B, the filter characteristics of the first transmission layer 51 and the second transmission layer 52 were the same as those of the second transmission layer 52 of Examples 1B to 5B. That is, the first transmission layer 51 was capable of reflecting infrared radiation in the reflection wavelength range (3.5 μm to 4.5 μm). In other respects, Examples 6B to 10B were the same as Examples 1B to 5B. The values of the ratio D/L in Examples 6B to 10B were respectively the same as those in Examples 1B to 5B.

Evaluation Test

In the infrared processing devices of Examples 1B to 10B, electric power of about 300 W was supplied to the heating element 40, and the infrared processing device was let stand until the temperature thereof stabilized, and the temperatures of the heating element 40 and the first transmission layer 51 were measured. Table 2 shows the distance D, the ratio D/L, and the measured temperatures of Examples 1B to 10B.

TABLE 2

| | | | Temperature (° C.) | |
|---|---|---|---|---|
| | Distance D (mm) | Ratio D/L | Heating Element | First Transmission Layer |
| EXAMPLE 1B | 10 | 0.074 | 620 | 345 |
| EXAMPLE 2B | 15 | 0.111 | 602 | 193 |
| EXAMPLE 3B | 18 | 0.133 | 587 | 144 |
| EXAMPLE 4B | 21 | 0.155 | 584 | 124 |
| EXAMPLE 5B | 27 | 0.199 | 571 | 109 |
| EXAMPLE 6B | 10 | 0.074 | 672 | 450 |
| EXAMPLE 7B | 15 | 0.111 | 635 | 300 |
| EXAMPLE 8B | 18 | 0.133 | 612 | 246 |
| EXAMPLE 9B | 21 | 0.155 | 615 | 214 |
| EXAMPLE 10B | 27 | 0.199 | 595 | 178 |

Figure 19:
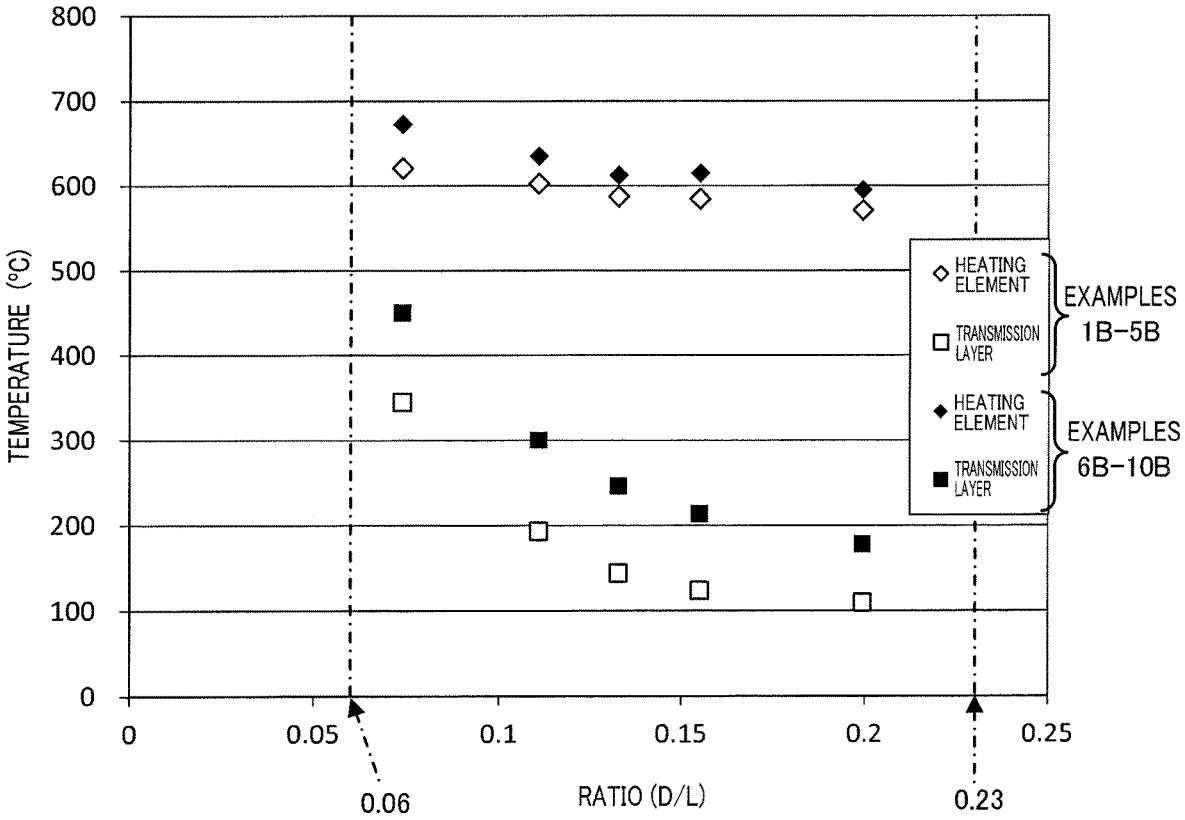
FIG. 19 is a graph representing the relationships between the ratio D/L and the temperatures of a heating element 40 and a first transmission layer 51 in Examples 1B to 10B.

FIG. 19 is a graph representing the relationships between the ratio D/L and the temperatures of the heating element 40 and the first transmission layer 51 in Examples 1B to 10B. As can be seen from Table 2 and FIG. 19, in each of Examples 1B to 10B, in which the ratio D/L was 0.06 or more and 0.23 or less, the temperature difference between the heating element 40 and the filter unit 50 (the first transmission layer 51) during use was large. As the ratio D/L increased, the temperature of the first transmission layer 51 tended to decrease and the temperature difference between the heating element 40 and the first transmission layer 51 tended to increase. As the ratio D/L decreased, decrease in the temperature of the heating element 40 tended to be smaller. In each of Examples 1B to 5B, in which the first transmission layer 51 had filter characteristics of transmitting infrared radiation in the reflection wavelength range, as compared with Examples 6B to 10B, in which the first transmission layer 51 had filter characteristics of reflecting infrared radiation in the reflection wavelength range, even when the ratio D/L was the same, increase in the temperature of the first transmission layer 51 was more successfully suppressed. It is considered that this is because the infrared absorptance of the first transmission layer 51 in Examples 1B to 5B was lower than that of the first transmission layer 51 in Example 6B to 10B.

Examples 1C to 9C

In Examples 1C to 9C, infrared processing devices including infrared heaters were made while changing the ratio D/L as shown in Table 3. Each of the infrared heaters had the same structure as the infrared heater 10 shown in FIGS. 9 to 14. The first transmission layer 51 included the selective reflection region 53 and the transmission region 54 of the third embodiment in a plane and the widths Wa, Wb, Wc, and Wd were each 20 mm. The heating element region E had a quadrangular shape having a length X=120 am in the left-right direction and a length Y=120 mm in the front-back direction. The infrared transmittance of the selective reflection region 53 in the reflection wavelength range was 10%, the infrared reflectance of the selective reflection region 53 in the reflection wavelength range was 80%, and the infrared absorptance of the selective reflection region 53 in the reflection wavelength range was 10%. The wavelength of the first transmission peak of the selective reflection region 53 was 2.5 μm, the infrared transmittance of the selective reflection region 53 at the first transmission peak was 80%, the infrared reflectance of the selective reflection region 53 at the first transmission peak was 10%, and the infrared absorptance of the selective reflection region 53 at the first transmission peak was 10%. The wavelength of the second transmission peak of the selective reflection region 53 was 5.5 μm, the infrared transmittance of the selective reflection region 53 at the second transmission peak was 80%, the infrared reflectance of the selective reflection region 53 at the second transmission peak was 10%, and the infrared absorptance of the selective reflection region 53 at the second transmission peak was 10%. The infrared transmittance of the transmission region 54 in the reflection wavelength range was 80%, the infrared reflectance of the transmission region 54 in the reflection wavelength range was 15%, and the infrared absorptance of the transmission region 54 in the reflection wavelength range was 5%. The infrared transmittance of the transmission region 54 in the wavelength range of 2 to 8 μm was 80%, the infrared reflectance of the transmission region 54 in the wavelength range of 2 to 8 μm was 15%, and the infrared absorptance of the transmission region 54 in the wavelength range of 2 to 8 μm was 5%. In each of the infrared processing devices, only one infrared heater attached to the furnace body 80. The heating element 40 had the shape shown in FIGS. 11 and 12, and the representative dimension L of the heating element 40 was 135.4 mm. The heating element 40 was made of a Ni—Cr alloy, and the surface of the heating element 40 facing the first transmission layer 51 was coated with a thermally sprayed ceramic coating of alumina. The outside space was an air atmosphere.

Examples 10C to 18C

In Examples 10C to 18C, infrared processing devices including infrared heaters were made while changing the ratio D/L as shown in Table 3. Each of the infrared heaters of Examples 10C to 18C had the same structure as the infrared heater 10, except that the entirety of the first transmission layer 51 was the selective reflection region 53 and the transmission-layer-side reflective member 75 (the first to fourth transmission-layer-side reflective members 75*a* to 75*d*) was omitted. The values of the ratio D/L in Examples 10C to 18C were respectively the same as those in Examples 1C to 9C.

Evaluation Test

In each of the infrared processing devices of Examples 1C to 18C, an object was placed at position in the processing space 81 directly below the infrared heater. Electric power of about 300 W was supplied to the heating element 40, and the infrared processing device was let stand until the temperature thereof stabilized, and the temperatures of the heating element 40, the first transmission layer 51, and the object were measured. Table 3 shows the distance D, the ratio D/L, and the measured temperatures of Examples 1C to 18C. A polyimide resin film was used as the object. The temperature of the first transmission layer 51 was measured at the center in the front-back and left-right directions.

TABLE 3

| | | | Temperature (° C.) | | |
|---|---|---|---|---|---|
| | Distance D (mm) | Ratio D/L | Heating Element | First Transmission Layer | Object |
| EXAMPLE 1C | 6.0 | 0.044 | 698 | 475 | 225 |
| EXAMPLE 2C | 8.0 | 0.059 | 685 | 372 | 215 |
| EXAMPLE 3C | 9.5 | 0.070 | 677 | 320 | 208 |
| EXAMPLE 4C | 15.0 | 0.111 | 659 | 227 | 188 |
| EXAMPLE 5C | 21.0 | 0.155 | 642 | 161 | 170 |
| EXAMPLE 6C | 27.0 | 0.199 | 631 | 133 | 156 |
| EXAMPLE 7C | 30.0 | 0.222 | 626 | 124 | 150 |
| EXAMPLE 8C | 40.0 | 0.295 | 615 | 112 | 141 |
| EXAMPLE 9C | 48.0 | 0.355 | 610 | 108 | 136 |
| EXAMPLE 10C | 6.0 | 0.044 | 675 | 413 | 210 |
| EXAMPLE 11C | 8.0 | 0.059 | 659 | 328 | 200 |
| EXAMPLE 12C | 9.5 | 0.063 | 650 | 289 | 196 |
| EXAMPLE 13C | 15.0 | 0.111 | 629 | 197 | 175 |
| EXAMPLE 14C | 21.0 | 0.155 | 612 | 138 | 158 |
| EXAMPLE 15C | 27.0 | 0.199 | 601 | 113 | 144 |
| EXAMPLE 16C | 30.0 | 0.222 | 597 | 106 | 139 |
| EXAMPLE 17C | 40.0 | 0.295 | 585 | 95 | 127 |
| EXAMPLE 18C | 48.0 | 0.355 | 580 | 90 | 121 |

Figure 20:
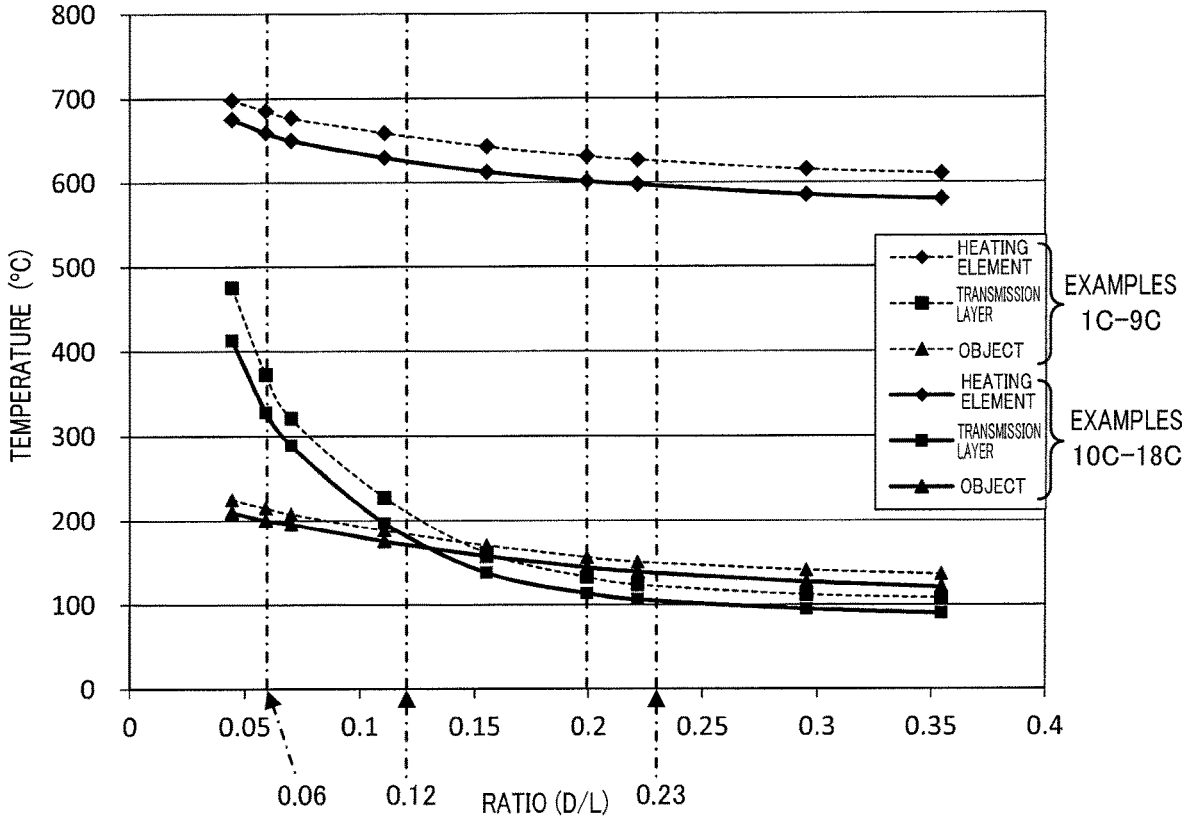
FIG. 20 is a graph representing the relationships between the ratio D/L and the temperatures of a heating element 40, a first transmission layer 51, and an object in Examples 1C to 18C.

FIG. 20 is a graph representing the relationships between the ratio D/L and the temperatures of the heating element 40, the first transmission layer 51, and the object in Examples 1C to 18C. As can be seen from Table 3 and FIG. 20, in each of Examples 1C to 18C, the temperature difference between the heating element 40 and the filter unit 50 (the first transmission layer 51) during use was large. As the ratio D/L increased, the temperature of the first transmission layer 51 tended to decrease and the temperature difference between the heating element 40 and the first transmission layer 51 tended to increase. However, in each of Examples 1C to 9C, in which the transmission region 54 and the transmission-layer-side reflective member 75 were provided, the temperature of the heating element 40, the temperature of the first transmission layer 51, and the temperature of the object were higher than those in corresponding one of Examples 10C to 18C. That is, it was confirmed that, in Examples 1C to 9C, when the energy (of electric power) supplied to the heating element 40 from the outside was the same, the heating ability (the energy efficiency) was improved. In each of Examples 3C to 9C, in which the ratio D/L was 0.06 or more, increase in the temperature of the first transmission layer 51 was successfully suppressed, and it is considered that preferably the ratio D/L is 0.06 or more. In the region in which the ratio D/L was 0.12 or less, as the ratio D/L increased, the effect of suppressing increase in the temperature of the first transmission layer 51 increased sharply, and in the region in which the ratio D/L was 0.12 or more, increase in the temperature of the first transmission layer 51 was further suppressed. As the ratio D/L increased, the temperature of the heating element 40 tended to decrease. In each of Examples 1C to 7C, in which the ratio D/L was 0.23 or less, decrease in the temperature of the heating element 40 was successfully suppressed, and it is considered that preferably the ratio D/L is 0.23 or less. When the ratio D/L was 0.2 or less, the temperature of the object was increased to 150° C. or more, and it is considered that the infrared heater can be operated with a higher heating effect. Thus, preferably, the ratio D/L is 0.06 or more, and more preferably 0.12 or more. Preferably, the ratio D/L is 0.23 or less, and more preferably 0.2 or less.

The present application claims priority from Japanese patent application No. 2014-241192 filed on Nov. 28, 2014, Japanese patent application No. 2015-088633 filed on Apr. 23, 2015, and Japanese patent application No. 2015-088634 filed on Apr. 23, 2015, the entire contents of all of which are incorporated herein by reference.

What is claimed is:

1. An infrared heater comprising:

a heating element that emits infrared radiation when heated and that is capable of absorbing infrared radiation in a predetermined reflection wavelength range, the heating element being disposed in a case having an upper surface portion and right and left side surface portions, at least one of the side surface portions extending a first distance away from the upper surface portion to a distal end; and a filter unit including one or more transmission layers that transmit at least a part of the infrared radiation emitted from the heating element and a reflective section that reflects infrared radiation in the reflection wavelength range toward the heating element, the one or more transmission layers including a closest transmission layer, the closest transmission layer being the transmission layer of the one or more transmission layers which is positioned closest to the heating element, and being disposed a second distance, greater than the first distance, away from the upper surface portion, thereby defining a first space between the heating element and the closest transmission layer, which is open to an outside space, via at least one opening defined between the closest transmission layer and the distal end of the at least one of the side surface portions;

wherein an infrared emissivity of a surface portion of the heating element facing the closest transmission layer is higher than that of a surface portion of the heating element facing away from the closest transmission layer.

2. The infrared heater according to claim 1, wherein the closest transmission layer is a first transmission layer, the first transmission layer also serves as at least a part of the reflective section, and the first transmission layer has reflection characteristics of reflecting infrared radiation in the predetermined reflection wavelength range and transmits at least a part of the infrared radiation from the heating element.

3. The infrared heater according to claim 2, wherein $0.08 \leq D/L \leq 0.23$, where a distance D [cm] is a distance between the heating element and the first transmission layer, a heating element area S [$cm^2$] is an area of a smallest quadrangular or circular region that surrounds an entirety of a projection region that is formed by projecting the heating element onto the first transmission layer in a direction perpendicular to the first transmission layer (where $0\ cm^2 < S \leq 400\ cm^2$), and a representative dimension L [cm]$=2\times\sqrt{(S/\pi)}$, wherein the representative dimension L is equal to a diameter of a circle whose area is the same as the heating element area S.

4. The infrared heater according to claim 2, wherein the filter unit includes a second transmission layer that is disposed so as to be separated by a second space from the first transmission layer, and that reflects at least a part of the infrared radiation emitted from the heating element and passed through the first transmission layer.

5. The infrared heater according to claim 1, wherein the closest transmission layer is a first transmission layer, and further comprising a second transmission layer that is disposed so as to be separated by a second space from the first transmission layer on a side opposite to the heating element when seen from the first transmission layer, wherein the first transmission layer transmits infrared radiation in the reflection wavelength range, and the second transmission layer is at least a part of the reflective section, and reflects infrared radiation in the reflection wavelength range while transmitting at least a part of the infrared radiation emitted from the heating element and passed through the first transmission layer.

6. The infrared heater according to claim 5, wherein the filter unit includes a partition member that partitions the second space from outside of the filter unit, and the reflective section includes a transmission-layer-side reflective member that is at least a part of the partition member and that reflects infrared radiation in the reflection wavelength range.

7. The infrared heater according to claim 5, wherein the second space is a coolant channel that allows a coolant to flow therethrough.

8. The infrared heater according to claim 1, wherein $0.06 \leq D/L \leq 0.23$, where a distance D [cm] is a distance between the heating element and the closest transmission layer, a heating element area S [$cm^2$] is an area of a smallest quadrangular or circular region that surrounds an entirety of a projection region that is formed by projecting the heating element onto the closest transmission layer in a direction perpendicular to the closest transmission layer (where $0\ cm^2 < S \leq 400\ cm^2$), and a representative dimension L [cm]$=2\times\sqrt{(S/\pi)}$, wherein the representative dimension L is equal to a diameter of a circle whose area is the same as the heating element area S.

9. The infrared heater according to claim 1, further comprising:

a heating-element-side reflective member that is disposed on a side opposite to the one or more transmission layers when seen from the heating element and that reflects infrared radiation in the reflection wavelength range.

10. The infrared heater according to claim 1, wherein the heating element is a planar heating element having a flat surface that is capable of emitting infrared radiation toward the one or more transmission layers and absorbing infrared radiation in the reflection wavelength range.

11. An infrared heater comprising:

a heating element that emits infrared radiation when heated and that is capable of absorbing infrared radiation in a predetermined reflection wavelength range, and a filter unit including one or more transmission layers that transmit at least a part of the infrared radiation emitted from the heating element and a reflective section that reflects infrared radiation in the predetermined reflection wavelength range toward the heating element, the filter unit being disposed so as to be separated by a first space, which is open to an outside space, from the heating element, wherein the one or more transmission layers include a first transmission layer, the first transmission layer also serves as a part of the reflective section, the first transmission layer includes a selective reflection region that has reflection characteristics of reflecting infrared radiation in the reflection wavelength range and that transmits at least a part of the infrared radiation emitted from the heating element and a transmission region that transmits infrared radiation in the reflection wavelength range, the selective reflection region being disposed closer than the transmission region to a center of the heating element, the transmission region being disposed farther than the selective reflection region from the center of the heating element, and the reflective section includes a transmission-layer-side reflective member that is disposed on a side opposite to the heating element when seen from the first transmission layer and that has a reflective surface inclined with respect to a surface of the transmission region facing the heating element, the reflective surface reflecting toward the heating element infrared radiation in the reflection wavelength range passed through the transmission region.

12. The infrared heater according to claim 11, wherein the transmission region of the first transmission layer is located so as to surround the selective reflection region when seen from the heating element.

13. The infrared heater according to claim 11, wherein the transmission-layer-side reflective member is disposed so that the reflective surface does not overlap the selective reflection region when the reflective surface is projected onto a surface of the first transmission layer facing the heating element.

14. The infrared heater according to claim 11, wherein the reflective surface of the transmission-layer-side reflective member is a concave surface.

15. An infrared processing device for performing infrared processing by emitting infrared radiation toward an object, the infrared processing device comprising:

the infrared heater according to claim 1; and a furnace body that forms a processing space which is not directly connected to the first space and in which the infrared processing is performed by using infrared radiation emitted from the heating element and passed through the filter unit.

16. The infrared processing device according to claim 15, wherein the heating element and the first space are located outside the furnace body.

* * * * *